US007028772B2

(12) United States Patent
Wright et al.

(10) Patent No.: US 7,028,772 B2
(45) Date of Patent: Apr. 18, 2006

(54) TREATMENT WELL TILTMETER SYSTEM

(75) Inventors: Chris Wright, Mill Valley, CA (US); Eric Davis, El Cerrito, CA (US); James Ward, San Francisco, CA (US); Eitienne Samson, San Francisco, CA (US); Gang Wang, Martinez, CA (US); Larry Griffin, Spring, TX (US); Sharon Demetrius, San Francisco, CA (US); Kevin Fisher, Katy, TX (US)

(73) Assignee: Pinnacle Technologies, Inc., San Francisco, CA (US)

( * ) Notice: Subject to any disclaimer, the term of this patent is extended or adjusted under 35 U.S.C. 154(b) by 61 days.

(21) Appl. No.: 10/258,669

(22) PCT Filed: Apr. 26, 2001

(86) PCT No.: PCT/US01/13594

§ 371 (c)(1),
(2), (4) Date: Feb. 11, 2003

(87) PCT Pub. No.: WO01/81724

PCT Pub. Date: Nov. 1, 2001

(65) Prior Publication Data

US 2003/0205375 A1 Nov. 6, 2003

Related U.S. Application Data

(60) Provisional application No. 60/199,779, filed on Apr. 26, 2000.

(51) Int. Cl.
*E21B 47/022* (2006.01)

(52) U.S. Cl. ..... 166/250.01; 166/66; 73/152.18

(58) Field of Classification Search ..... 166/250.01, 166/254.2, 250.1, 66, 308.1; 175/50; 73/152.02, 73/152.18, 152.39, 152.41
See application file for complete search history.

(56) References Cited

U.S. PATENT DOCUMENTS

| | | | | |
|---|---|---|---|---|
| 4,271,696 | A * | 6/1981 | Wood | 73/37 |
| 4,353,244 | A | 10/1982 | Wood | |
| 4,673,890 | A | 6/1987 | Copland et al. | |
| 4,690,214 | A | 9/1987 | Wittrisch | 166/250 |
| 4,747,454 | A * | 5/1988 | Perryman | 166/380 |
| 5,002,431 | A | 3/1991 | Heymans et al. | 405/128 |
| 5,010,527 | A | 4/1991 | Mahrer | |

(Continued)

FOREIGN PATENT DOCUMENTS

WO WO 00/29716 5/2000

(Continued)

OTHER PUBLICATIONS

Mayerhofer, M., et al; Surface Tiltmeter Mapping; XP -002176044.

(Continued)

*Primary Examiner*—Kenneth Thompson
(74) *Attorney, Agent, or Firm*—Haynes and Boone, L.L.P.; Priscilla L. Ferguson

(57) ABSTRACT

The treatment well tiltmeter system comprises one or more tiltmeter assemblies which are located within an active treatment well. The treatment well tiltmeter system provides data from the downhole tiltmeters, and can be used to map hydraulic fracture growth or other subsurface processes from the collected downhole tilt data versus time. The system provides tilt data inversion of data from each of the treatment well tiltmeter assemblies, and provides isolation of data signals from noise associated with the treatment well environment. As well, the treatment well tiltmeter system provides geomechanical modeling for treatment well processes.

112 Claims, 51 Drawing Sheets

U.S. PATENT DOCUMENTS

| | | | | |
|---|---|---|---|---|
| 5,040,414 | A * | 8/1991 | Graebner | 73/152.59 |
| 5,377,104 | A | 12/1994 | Sorrells et al. | |
| 5,417,103 | A | 5/1995 | Hunter et al. | 73/37 |
| 5,503,225 | A | 4/1996 | Withers | 166/250.1 |
| 5,574,218 | A | 11/1996 | Withers | |
| 5,747,750 | A | 5/1998 | Bailey et al. | |
| 5,771,170 | A | 6/1998 | Withers et al. | |
| 5,774,419 | A | 6/1998 | Uhl et al. | |
| 5,917,160 | A | 6/1999 | Bailey | |
| 5,934,373 | A | 8/1999 | Warpinski et al. | 166/250.1 |
| 5,944,446 | A | 8/1999 | Hocking | 405/128 |
| 5,963,508 | A | 10/1999 | Withers | |
| 5,996,726 | A | 12/1999 | Sorrells et al. | |
| 6,049,508 | A | 4/2000 | Deflandre | |
| 6,253,870 | B1 | 7/2001 | Tokimatsu et al. | |
| 6,370,784 | B1 | 4/2002 | Hunter et al. | |
| 2005/0060099 | A1 | 3/2005 | Sorrells et al. | |

FOREIGN PATENT DOCUMENTS

WO WO 01/81724 11/2001

OTHER PUBLICATIONS

Warpinski, N. et al.; Microseismic Monitoring of the B-Sand Hydraulic Fracture Experiment at the DOE/GRI Multisite Project.

Wright, Chris; Tiltmeter Fracture Mapping: From the Surface and Now Downhole.

C. Cipolla and C. Wright, Diagnostic Techniques to Understand Hydraulic Fracturing: What? Why? and How? SPE 59735, 2000 SPE/CERI Gas Technology Symposium, Apr. 3-5, 2000, Calgary, Alberta, Canada.

E. Davis, C. Wright, S. Demetrius, J. Choi, and G. Craley, Precise Tiltmeter Subsidence Monitoring Enhances Reservoir Management, SPE 62577, SPE Western Regional Conference, Jun. 19-23, 2000, Long Beach, CA.

P. Davis, Surface Deformation Associated with a Dipping Hydro fracture, Journal of Geophysical Research, vol. 88, No. B7, 1983, pp. 5826-5834.

L. Griffin, C. Wright, Z. Moschovidis, Tiltmeter Mapping to Monitor Drill Cuttings Disposal, presented at the 37th US Rock Mechanics Symposium, Vail, CO, Jun. 6-9, 1999.

L. Griffin, C. Wright, E. Davis, S. Wolhart, and E. Davis, Surface and Downhole Tiltmeter Mapping: An Effective Tool for Monitoring Downhole Drill Cuttings Disposal, SPE 63032, 2000 SPE Annual Technical Conference, Oct. 1-4, 2000, Dallas TX.

K. Lang, Improvements in Fracture Stimulation Technology, PTTC Network News, vol. 7, No. 1, 1st Quarter 2001.

Nihei, Kurt T., "Natural Fracture Characterization Using Passive Seismic Illumination", Jan. 2003.

P. Perri, M. Emanuele, W. Fong, M. Morea, Lost Hills $CO_2$ Pilot Evaluation, Design, Injectivity Test Results, and Implementation, SPE 62526, SPE Western Regional Conference, Jun. 19-23, 2000, Long Beach, CA.

Warpinski et al., "Improved Microseismic Fracture Mapping Using perforation Timing Measurements for Velocity Calibration," SPE 84488, SPE Annual Technical Conference and Exhibition, Oct. 5-8, 2003, Denver, Colorado.

Warpinski et al., "Analysis and Prediction of Microseismicity Induced by Hydraulic Fracturing", SPE 71649, SPE Annual Technical Conference and Exhibition, Sep. 3—Oct. 3, 2001, New Orleans, LA.

C. Wright, E. Davis, W. Minner, J. Ward, L. Weijers, E. Schell, and S. Hunter, Surface Tiltmeter Fracture Mapping reaches New Depths—10,000 Feet, and Beyond?, SPE 39919, SPE Rocky Mountain Regional Conference, Apr. 5-8, 1998, Denver, CO.

C. Wright, E. Davis, G. Golich, J. Ward, S. Demetrius, W. Minner, and L. Weijers, Downhole Tiltmeter Fracture: Finally Measuring Hydraulic Fracture Dimensions, SPE 46194, SPE Western Regional Conference, May 10-13, 1998, Bakersfield, CA C. Wright, E. Davis, L. Weijers, Downhole Tiltmeter Fracture Mapping: A New Tool for Directly Measuring Hydraulic Fracture Dimensions, SPE 49193, 1998 SPE Annual Technical Conference and Exhibition, Sep. 1998, New Orleans, LA.

Communication from the International Preliminary Examining Authority dated Apr. 12, 2002 regarding International Application No. PCT/US01/13594.

Communication from the International Searching Authority dated Sep. 13, 2001 regarding International Application No. PCT/US01/13594.

Communication from the International Searching Authority dated Apr. 6, 2005 regarding International Application No. PCT/US04/29962.

Communication from the U.S. Patent and Trademark Office dated Nov. 23, 2004 regarding U.S. Appl. No. 10/674,937.

Communication from the U.S. Patent and Trademark Office dated Apr. 7, 2005 regarding U.S. Appl. No. 10/674,937.

* cited by examiner

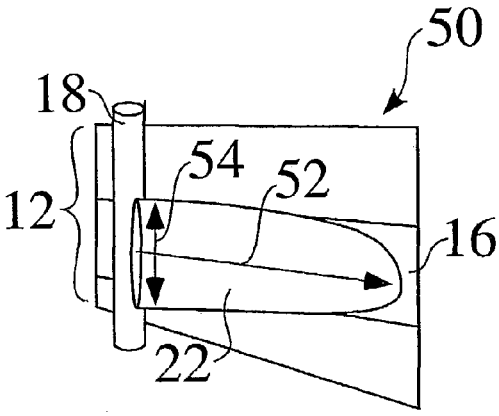
Fig. 3
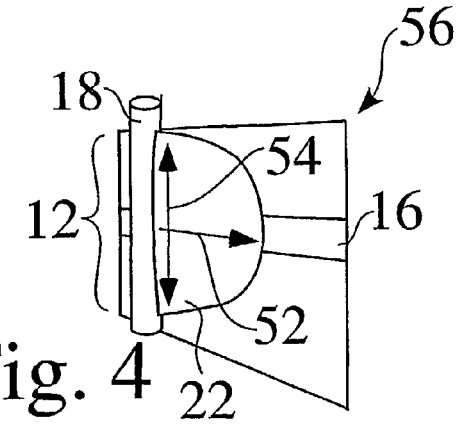
Fig. 4
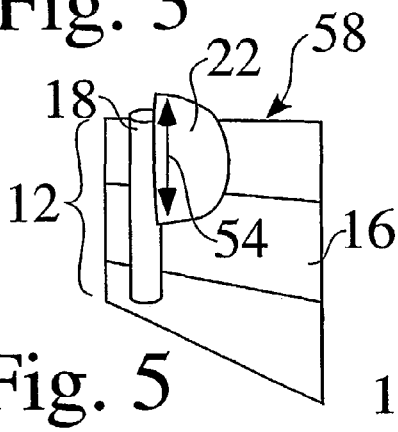
Fig. 5
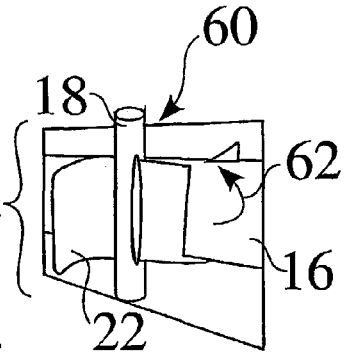
Fig. 6
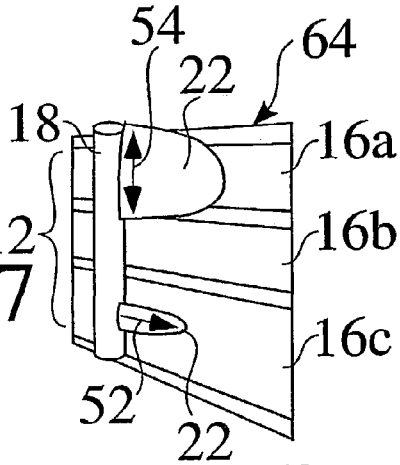
Fig. 7
Fig. 8
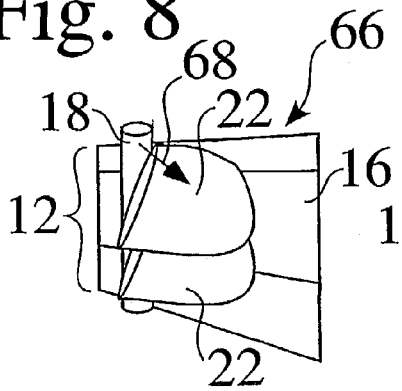
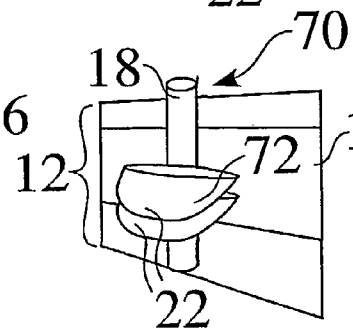
Fig. 9
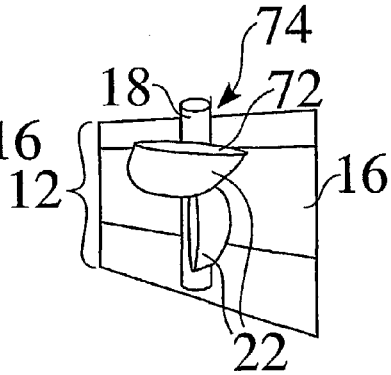
Fig. 10

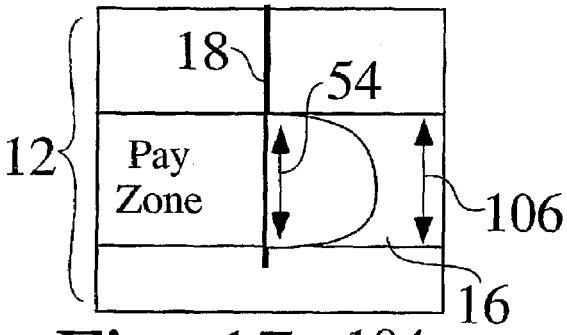
Fig. 17 104
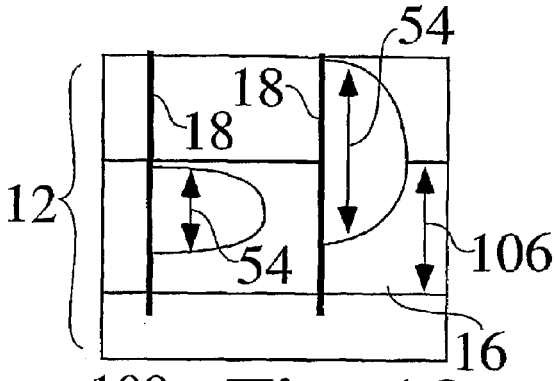
108 Fig. 18
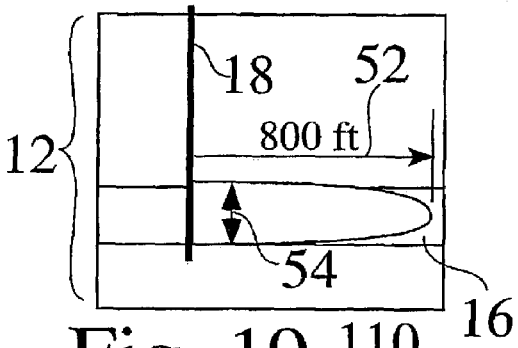
Fig. 19 110
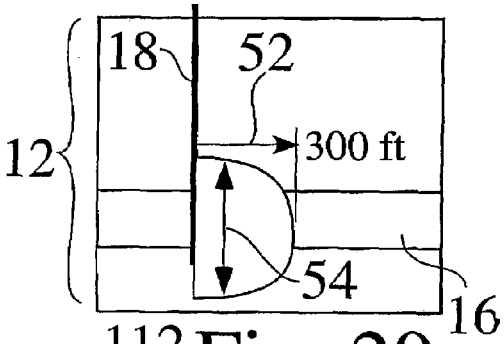
112 Fig. 20
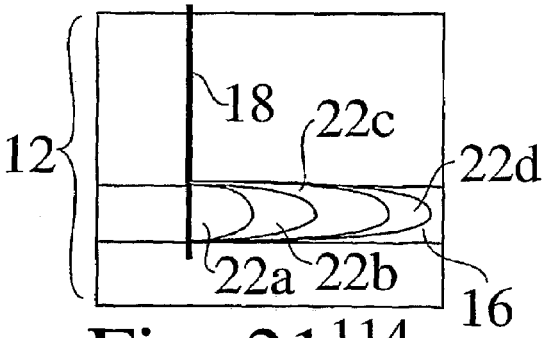
Fig. 21 114
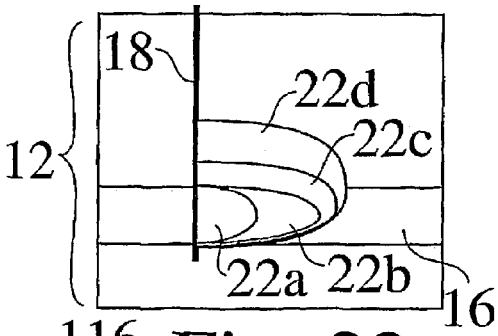
116 Fig. 22

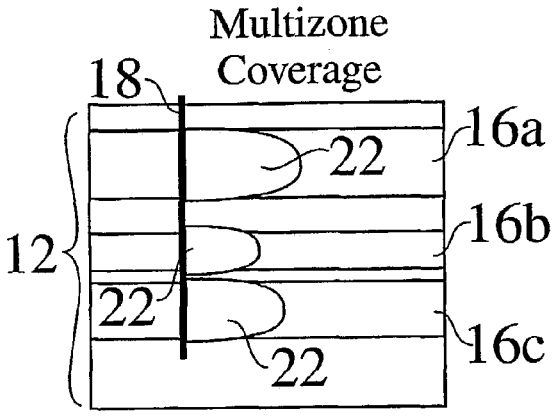
Fig. 23 118
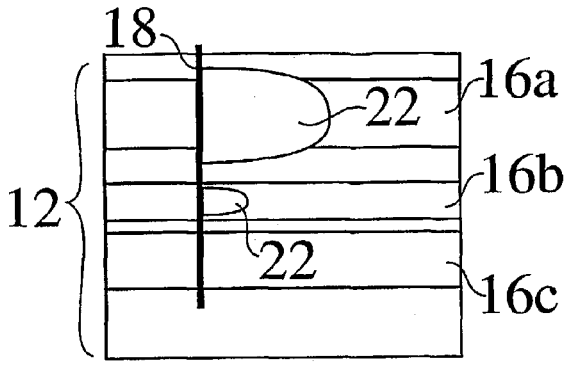
120 Fig. 24
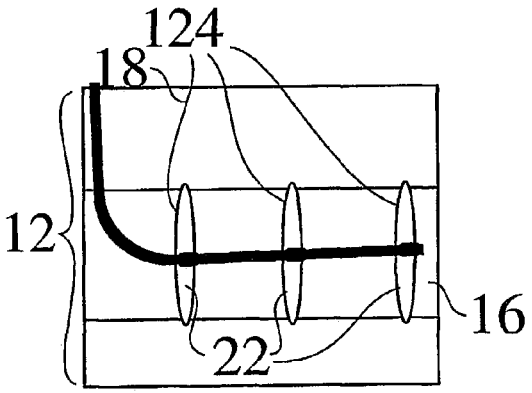
Fig. 25 122
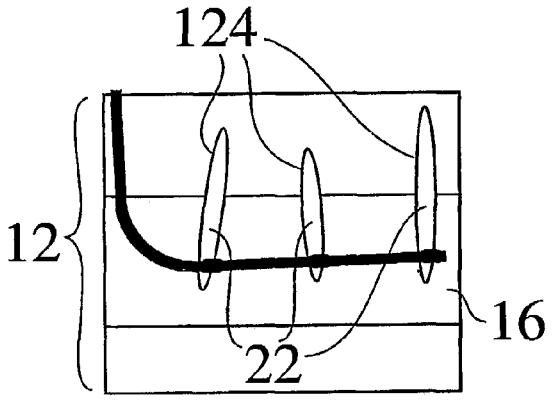
126 Fig. 26
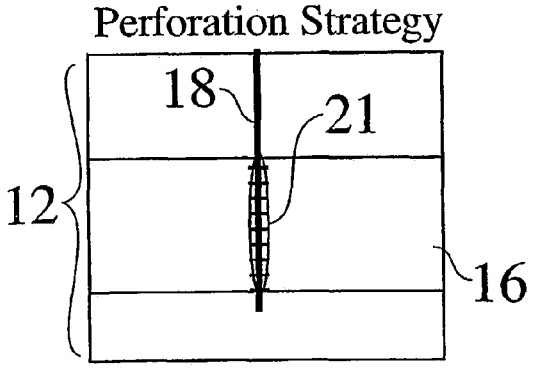
Fig. 27 128
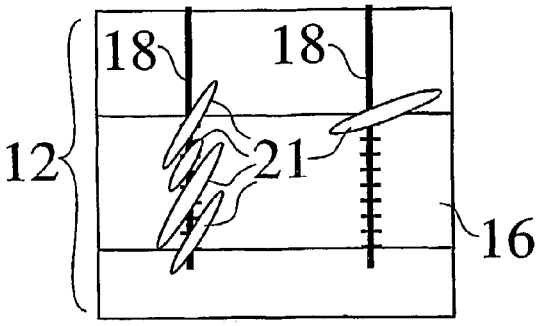
130 Fig. 28

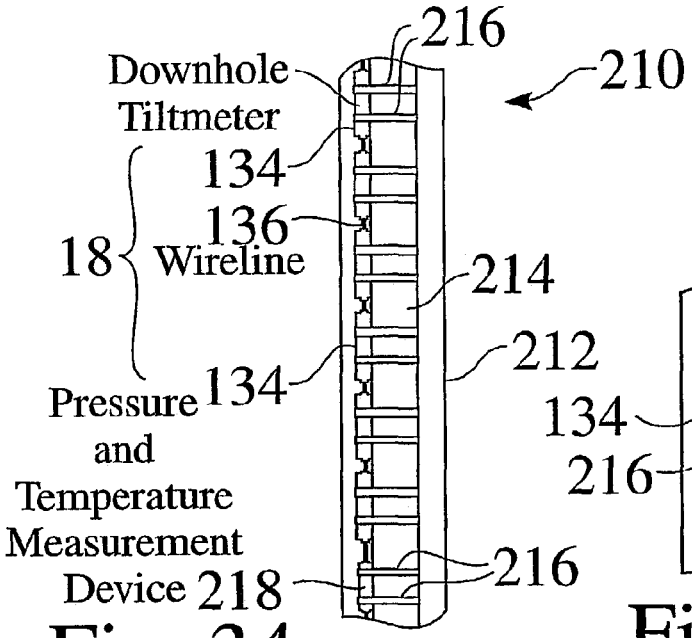
Fig. 34
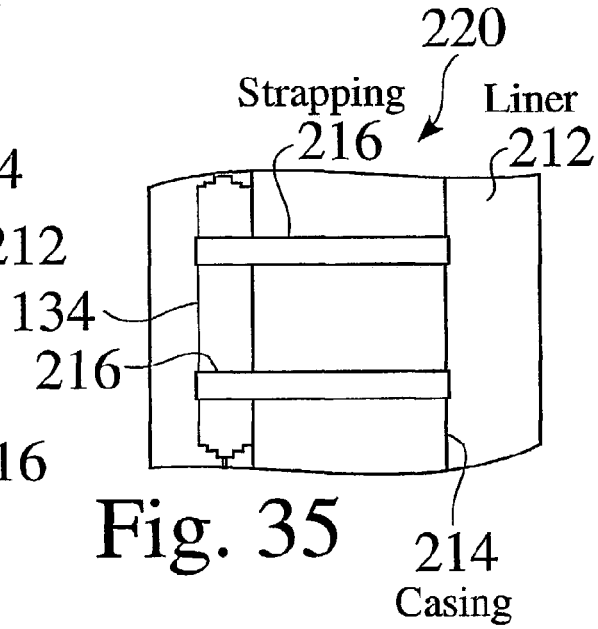
Fig. 35
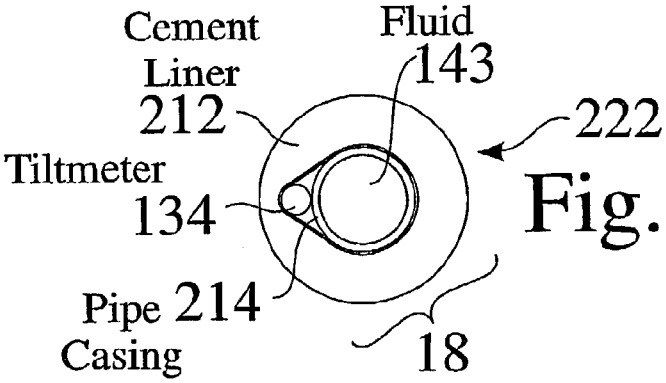
Fig. 36
Fig. 37
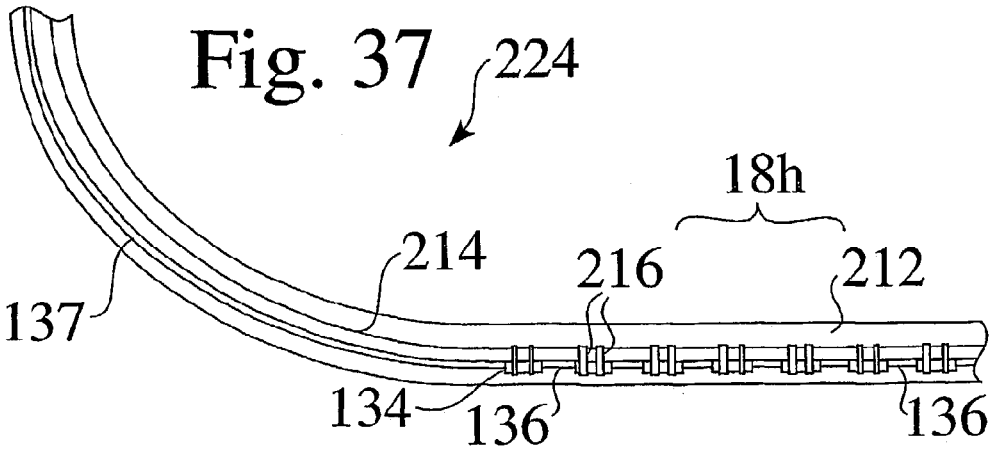

Fig. 56
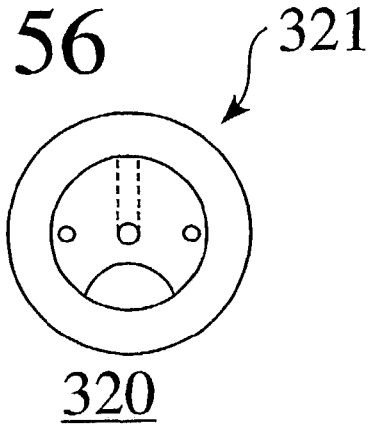
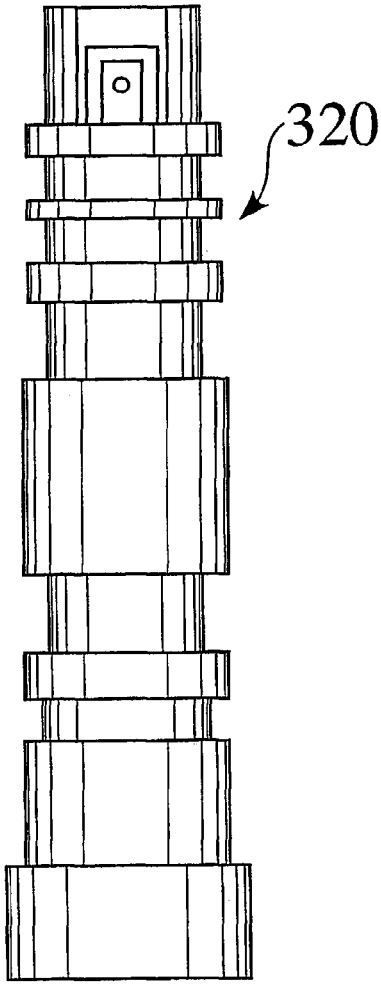
Fig. 55
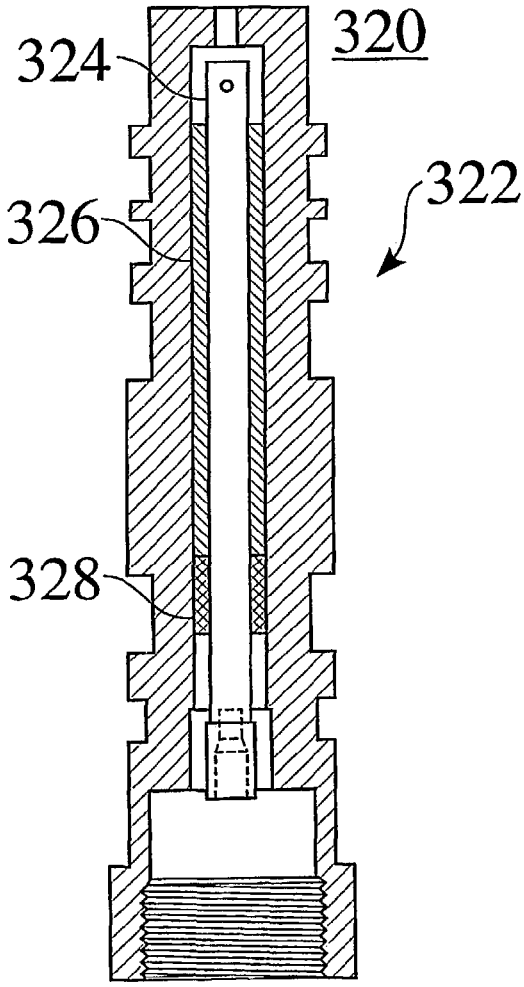
Fig. 57

362
290

364
368
378
366
290
374
372
370
376

366

368

370

372

374

376

378

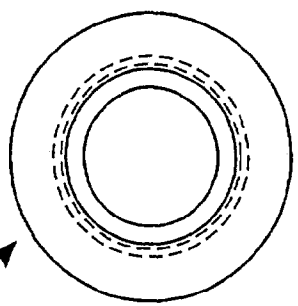
Fig. 103
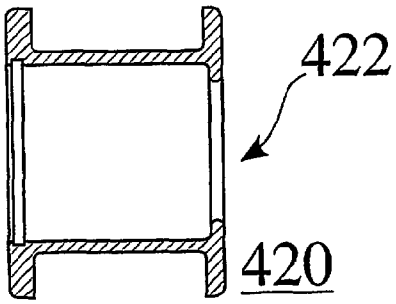
Fig. 104
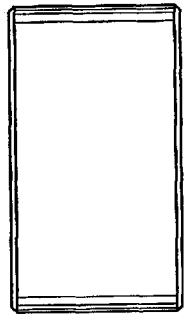
Fig. 105
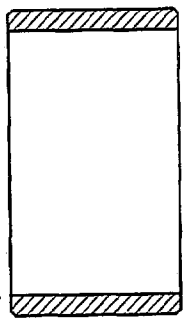
Fig. 107
Fig. 106

Accelerometer Board
X and Y

Fig. 119
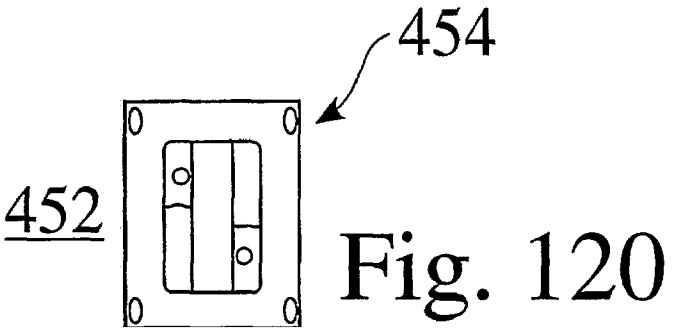
Fig. 120
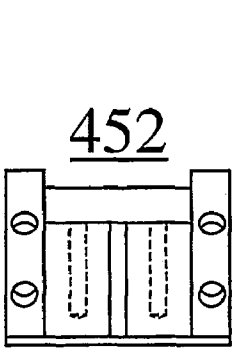
Fig. 121
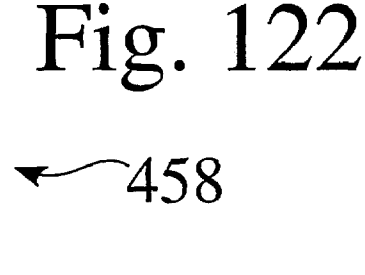
Fig. 122
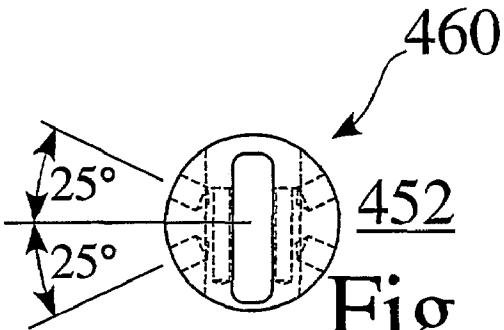
Fig. 123
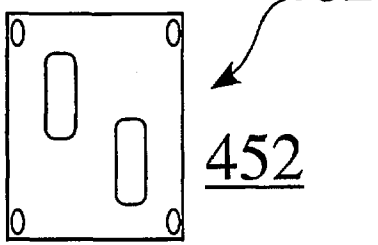
Fig. 124

TREATMENT WELL TILTMETER SYSTEM

This application claims the benefit of provisional application No. 60/199,779, file Apr. 26, 2000.

FIELD OF THE INVENTION

The invention relates to the field of tiltmeter systems and instrumentation in wellbore systems. More particularly, the invention relates to tiltmeter and instrumentation systems for treatment wells.

BACKGROUND OF THE INVENTION

For a variety of applications, fluids are injected into the earth, such as for hydraulic fracture stimulation, waste injection, produced water re-injection, or for enhanced oil recovery processes like water flooding, steam flooding, or $CO_2$ flooding. In other applications, fluids are produced, i.e. removed, from the earth, such as for oil and gas production, geothermal steam production, or for waste clean-up.

Hydraulic fracturing is a worldwide multi-billion dollar industry, and is often used to increase the production of oil or gas from a well. The subsurface injection of pressurized fluid results in a deformation to the subsurface strata. This deformation may be in the form of a large planar parting of the rock, in the case of hydraulic fracture stimulation, or other processes where injection is above formation parting pressure. The resultant deformation may also be more complex, such as in cases where no fracturing is occurring, wherein the subsurface strata (rock layers) compact or swell, due to the poroelastic effects from altering the fluid pressure within the various rock layers.

The preparation of a new well for hydraulic fracturing typically comprises the steps of drilling a well, cementing a casing into the well to seal the well from the rock, and creating perforations at a desired target interval. Perforations are small holes through the casing, which are formed with an explosive device. The target interval is the desired depth within the well, which typically is at the level of a pay zone of oil and/or gas. A bridge plug is then inserted below the perforated interval, to seal off the lower region of the well.

Hydraulic fracturing within a prepared wellbore comprises the pumping of fluid, under high pressure, down the well. The only place that the fluid can escape is through the formed perforations, and into the target zone. The pressure created by the fluid is greater than the in situ stress on the rock, so fractures (cracks, fissures) are created. Proppant (usually sand) is then pumped into the prepared well, so that when the fluid leaks off into the rock (via natural porosity), the proppant creates a conductive path for the oil/gas to flow into the well bore. Creation of a hydraulic fracture, therefore, involves parting of the rock, and displacing the fracture faces, to create fracture width. As a result of hydraulic fracturing, the induced deformation field radiates in all directions.

Surface and offset well tiltmeter fracture mapping has been used to estimate and model the geometry of formed hydraulic fractures, by measuring fracture-induced rock deformation.

Surface tilt mapping typically requires a large number of tiltmeters, each located in a near-surface offset bore, which surround an active treatment well that is to be mapped. For example, surface tilt mapping installations often comprise approximately 12 to 30 surface tiltmeters. Tilt data collected from the array of tiltmeters from hydraulic fracturing is then used to estimate the direction, i.e. the orientation, of a fracture which is created in the active well.

G. Holzhausen, *Analysis of Earth Tilts Resulting from Formation of Six Hydraulic Fractures,* Crack'r Frac, Mar. 27–28, 1979, describes early development in tilt data analysis.

M. Wood, Method of Determining Change in Subsurface Structure due to Application of Fluid Pressure to the Earth, U.S. Pat. No. 4,271,696, issued 09 Jun. 1981, describes "a method of determination of the change in subsurface structure of the earth resulting from the application of fluid pressure at a selected point, at a selected depth, in the earth, by measuring at least one physical parameter of the contour of the subsurface of the earth above the point of application of fluid pressure. The method involves positioning a plurality of tiltmeters on the earth above the point of application of fluid pressure arranged in a known array, and measuring the change in angle of tilt of the earth's surface at the point of placement of each sensor while varying the pressure and flow rate of fluid into the earth at the selected point."

M. Wood, Method of Determining the Azimuth and Length of a Deep Vertical Fracture in the Earth, U.S. Pat. No. 4,353,244, issued 12, Oct. 1982, describes "a method of determination of the change in subsurface structure of the earth resulting from the application of fluid pressure at a selected point, at a selected depth, in the earth, by measuring at least one physical parameter of the contour of the surface of the earth above the point of application of fluid pressure. The method involves positioning a plurality of tiltmeters on the earth above the point of application of fluid pressure arranged in a known array, and measuring the change in angle of tilt of the earth's surface at the point of placement of each sensor while varying the pressure and flow rate of fluid into the earth at the selected point. This invention further teaches how the individual values of incremental tilt at selected points on the earth's surface can be processed to provide indication of the azimuth of the vertical fracture in the earth, and an estimate of length of the fracture."

However, in addition to the direction of a fracture, other details of the formed fracture are important, such as the length and the height of the fracture region. Surface measurements do not accurately reflect the magnitude and dimensions of a formed fracture, due primarily to the relative isolation of the surface tiltmeters from the fracture area. For example, surface tiltemeters are typically installed within ten to fifty feet of the surface, whereas fractures are commonly formed much deeper into the strata.

Recently, downhole offset tilt mapping has been developed, comprising an array of tiltmeters located in a well which is offset from the active treatment well. Offset tiltmeter arrays often comprise a string of seven to thirteen tiltmeters. The plurality of offset tiltmeters are usually located at depths which are comparable to the fracture region, e.g. such as within the fracture zone, as well as above and/or below the fracture zone. For example, for a fracture at a depth of 5,000 feet, with an estimated fracture height of 300 feet, and array having a plurality of offset tiltmeters, having a span larger than 300 feet, e.g. such as an 800 foot string array, may be located in an offset hole near the active well. The use of a larger number of offset tiltmeters, located above, within, and below a fracture zone, which aids in estimating the extent of the formed fracture zone.

The distance between an active well and an offset well in which an array of offset tiltmeters is located is often dependent on the location of existing wells, and the permeability of the local strata. For example, in existing oil well fields in many locations in California, the surrounding strata has low fluid mobility, which requires that wells are often located relatively close together, e.g. such as a 200 ft. spacing. In contrast to closely spaced wells in California, for gas well fields in many locations in Texas, the surrounding strata has higher fluid mobility, which allows gas wells to be located relatively far apart, e.g. such as a 1,000–5,000 ft. spacing.

P. Davis, *Surface Deformation Associated with a Dipping Hydrofracture,* Journal of Geophysical Research, Vol. 88, No. B7, Pages 5826–5834, 10, Jul. 1983, describes the modeling of crustal deformations associated with hydrofractures.

C. Wright, *Tiltmeter Fracture Mapping: From the Surface, and Now Downhole,* Hart's Petroleum International, January 1998, describes the use of surface and downhole offset tiltmeters for fracture mapping.

C. Wright, E. Davis, W. Minner, J. Ward, L. Weijers, E. Schell, and S. Hunter, *Surface Tiltmeter Fracture Mapping reaches New Depths—10,000 Feet, and Beyond?,* SPE 39919, Society of Petroleum Engineers Rocky Mountain Regional Conference, May 1998, Denver, Colo., describe surface tilt measurement and mapping techniques for resolution of fracture induced tilts.

C. Wright, E. Davis, G. Golich, J. Ward, S. Demetrius, W. Minner, and L. Weijers, *Downhole Tiltmeter Fracture: Finally Measuring Hydraulic Fracture Dimensions,* SPE 46194, Society of Petroleum Engineers Western Regional Conference, May 10–13, 1998, Bakersfield, Calif., describe downhole tiltmeter fracture mapping for offset wells.

P. Perri, M. Emanuele, W. Fong, M. Morea, *Lost Hills CO2 Pilot: Evaluation, Injectivity Test Results, and Implementation,* SPE 62526, Society of Petroleum Engineers Western Regional Conference, Jun. 19–23, 2000, Long Beach, Calif., describe the evaluation, design, and implementation of a $CO_2$ pilot project and mapping of $CO_2$ migration.

E. Davis, C. Wright, S. Demetrius, J. Choi, and G. Craley, *Precise Tiltmeter Subsidence Monitoring Enhances Reservoir Management,* SPE 62577, Society of Petroleum Engineers Western Regional Conference, Jun. 19–23, 2000, Long Beach, Calif., describe tiltmeter-based long term reservoir compaction and dilation due to fluid withdrawal and injection.

L. Griffin, C. Wright, E. Davis, S. Wolhart, and Z. Moschovidis, *Surface and Downhole Tiltmeter Mapping: An effective Tool for Monitoring Downhole Drill Cuttings Disposal,* SPE 63032, 2000 Society of Petroleum Engineers Annual Technical Conference, Oct. 1–4 2000, Dallas Tex., describe the use of both surface tiltmeters and offset downhole tiltmeters for drill cuttings disposal monitoring applications.

N. Warpinski, T. Steinfort, P. Branigan, and R. Wilmer, Apparatus and Method for Monitoring Underground Fracturing, U.S. Pat. No. 5,934,373, Issued 10, Aug. 1999, describe "an apparatus and method for measuring deformation of a rock mass around the vicinity of a fracture, commonly induced by hydraulic fracturing is provided. To this end, a well is drilled offset from the proposed fracture region, if no existing well is present. Once the well is formed to a depth approximately equal or exceeding the depth of the proposed fracture, a plurality of inclinometers, for example tiltmeters, are inserted downhole in the well. The inclinometers are located both above and below the approximate depth of the proposed fracture. The plurality of inclinometers may be arranged on a wireline that may be retrieved from the downhole portion of the well and used again or, alternatively, the inclinometers may be cemented in place. In either event, the inclinometers are used to measure the deformation of the rock around the induced fracture."

The disclosed prior art systems and methodologies thus provide tiltmeter assemblies and systems for surface and offset tilt mapping. However, the prior art systems and methodologies fail to provide tiltmeter assemblies and systems within active wells, nor do they provide structures which can be used in an active well environment.

C. Wright, E. Davis, J. Ward, L. Griffin, M. Fisher, L. Lehman, D. Fulton, and J. Podowski, *Real-Time Fracture Mapping from the Live Treatment Well,* Abstract No. SPE71648, submitted December 2000 to Society of Petroleum Engineers for Annual Technical Conference, Sep. 30–Oct. 3, 2001, describes early development in hydraulic fracture mapping from within a treatment well.

It would be advantageous to provide a system for mapping an active wellbore which does not require either an offset wellbore or the installation of surface tilt arrays. It would be advantageous to construct a measurement device that could be placed into and survive within in an active treatment well, particularly during the pumping of a hydraulic fracture treatment. Furthermore, it would be advantageous to provide a tiltmeter in which induced motion of the subsurface strata is discernable from the induced motion from active fluid flow in the borehole. It would also be advantageous to provide a system for mapping an active wellbore which operates in a wider range of environments and provides a high resolution of fracture width and/or rock deformation pattern data across the subsurface rock strata. Furthermore, it would be advantageous to provide a system for mapping an active wellbore which can be deployed and survive in the hostile treatment well environment.

SUMMARY OF THE INVENTION

The treatment well tiltmeter system comprises one or more tiltmeter assemblies which are located within an active treatment well. The treatment well tiltmeter system provides data from the downhole tiltmeters, which is used to map hydraulic fracture growth or other subsurface processes from the collected downhole tilt data versus time. The system provides data from each of the treatment well tiltmeter assemblies, and provides isolation of data signals from noise associated with the treatment well environment. As well, the treatment well tiltmeter system provides geomechanical modeling for treatment well processes, based upon the treatment well data.

BRIEF DESCRIPTION OF THE DRAWINGS

FIG. 3 is a view of a fracture-induced deformation having vertically confined growth;

FIG. 4 is a view of a fracture-induced deformation having out of zone growth;

FIG. 5 shows fracture-induced deformation having upward fracture growth;

FIG. 6 is a view of a fracture-induced deformation having twisting fractures;

FIG. 7 is a view of a fracture-induced deformation having poor fluid diversion;

FIG. 8 is a simplified view of a fracture-induced deformation having multiple fractures which dip from vertical;

FIG. 9 is a simplified view of a fracture-induced deformation having horizontal fractures;

FIG. 10 is a view of a fracture-induced deformation having T-shaped fractures;

FIG. 17 is a simplified view of fracture-induced deformation which is located within and substantially accesses the vertical extent of a pay zone;

FIG. 18 is a simplified view of fracture-induced deformations which incompletely access the vertical extent of a pay zone region;

FIG. 19 is a simplified view of fracture-induced deformation which is substantially located within and extends well into a pay zone;

FIG. 20 is a view of a fracture-induced deformation which extends vertically above and below pay zone, in which the deformation length is relatively small;

FIG. 21 is a view of fracture-induced deformation as a function of time, in which the deformation continues to extend into a pay zone region;

FIG. 22 is a view of fracture-induced deformation as a function of time, in which the deformation extends vertically beyond a pay zone;

FIG. 23 is a view of multi-zone coverage fracture-induced deformation, in which the deformations are substantially located within and extend well into each of a plurality of pay zones;

FIG. 24 is a view of multi-zone coverage fracture-induced deformation, in which the deformations are do not extend into each of a plurality of pay zones;

FIG. 25 is a view of fracture-induced deformation for a substantially horizontal well, in which the deformations extend generally across the vertical extent of the pay zone strata;

FIG. 26 is a view of fracture-induced deformation for a substantially horizontal well, in which the deformations are not substantially centered across the vertical extent of the pay zone strata;

FIG. 27 is a view of fracture-induced deformation, in which the formed perforation region for the well is aligned with and extends across the pay zone strata;

FIG. 28 is a view of fracture-induced deformation, in which one or more formed perforation regions are misaligned with the pay zone;

FIG. 34 is a partial cutaway view of a treatment well tiltmeter system, in which the tiltmeters are permanently attached to the outside of a well casing;

FIG. 35 is a detailed cutaway view of a tiltmeter which is permanently attached to the outside of a well casing;

FIG. 36 is an end view of a tiltmeter which is permanently attached to the outside of a well casing;

FIG. 37 is a partial cutaway view of a horizontal treatment well tiltmeter system, in which the tiltmeters are permanently attached to the outside of a well casing;

FIG. 55 is a side view of a tiltmeter bottom end cap;

FIG. 56 is a first end view of a tiltmeter bottom end cap;

FIG. 57 is a partial cross-sectional side view of a tiltmeter bottom end cap;

FIG. 103 is a front view of a tiltmeter bearing holder;

FIG. 104 is a side view of a tiltmeter bearing holder;

FIG. 105 is a front view of a tiltmeter fluoropolymer ring;

FIG. 106 is a side view of a tiltmeter fluoropolymer ring;

FIG. 107 is a side cross-sectional view of a tiltmeter fluoropolymer ring;

FIG. 119 is a front view of a tiltmeter tensioner;

FIG. 120 is a top view of a tiltmeter tensioner;

FIG. 121 is a first cross-sectional view of a tiltmeter tensioner;

FIG. 122 is a side view of a tiltmeter tensioner;

FIG. 123 is a second cross-sectional view of a tiltmeter tensioner;

FIG. 124 is a bottom view of a tiltmeter tensioner;

FIG. 125 is a side view of a tiltmeter spring pole;

FIG. 126 is an end view of a tiltmeter spring pole;

FIG. 127 is a side view of a tiltmeter tensioner shaft;

FIG. 128 is a side view of a tiltmeter power supply board solenoid mount;

FIG. 129 is a top view of a tiltmeter power supply board solenoid mount;

FIG. 130 is an end view of a tiltmeter power supply board solenoid mount;

FIG. 131 is a top view of a tiltmeter reed switch board;

Figure 132:
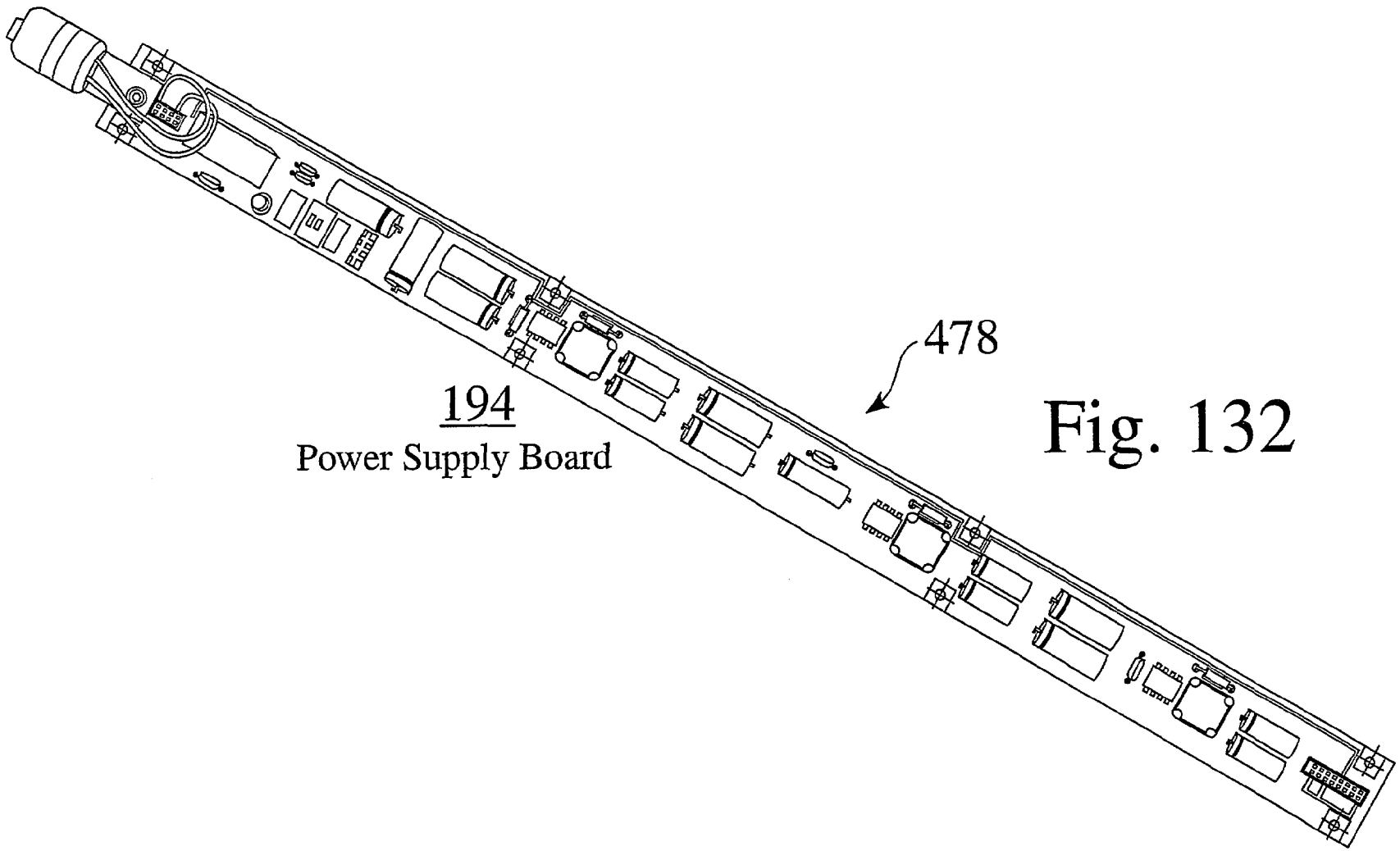
Figure 133:
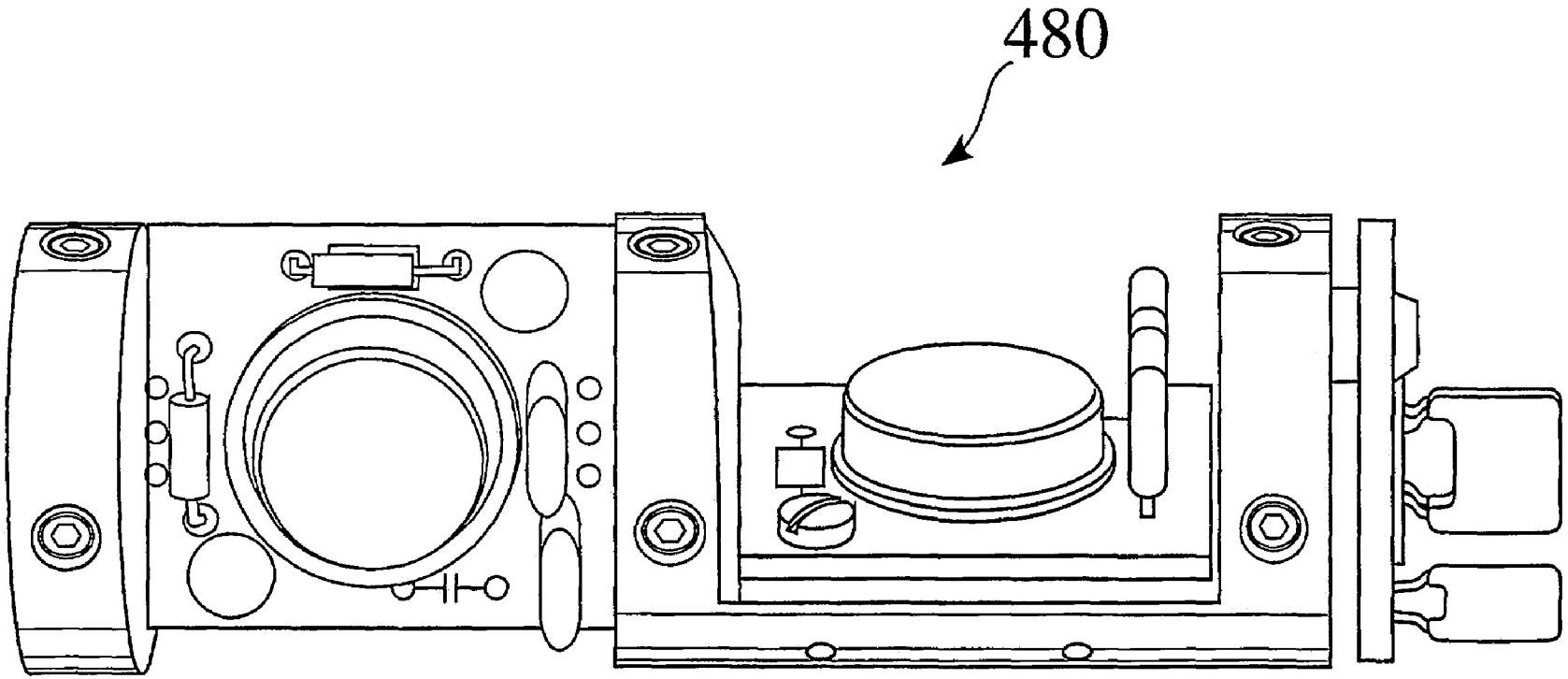
Figure 134:
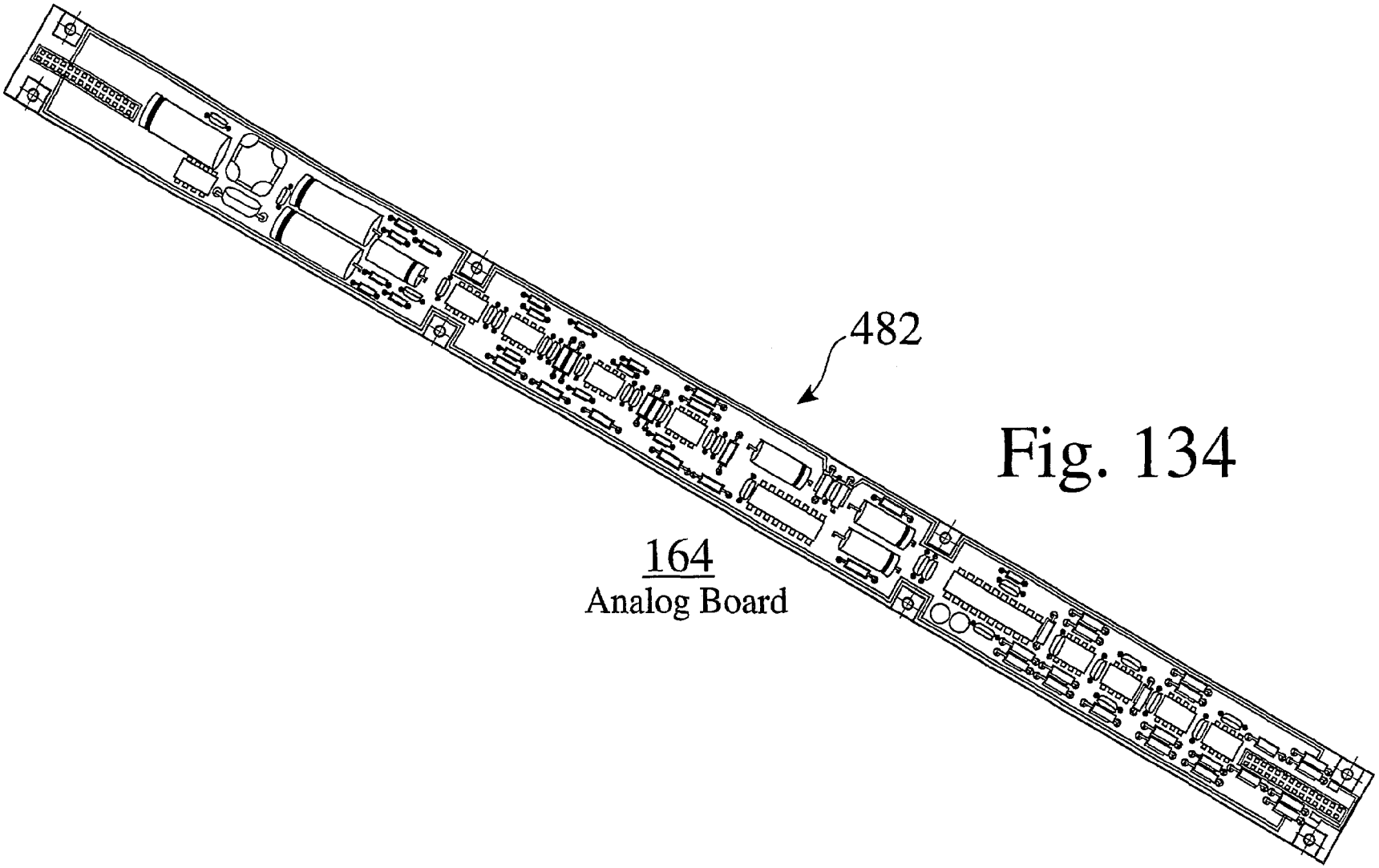
Figure 135:
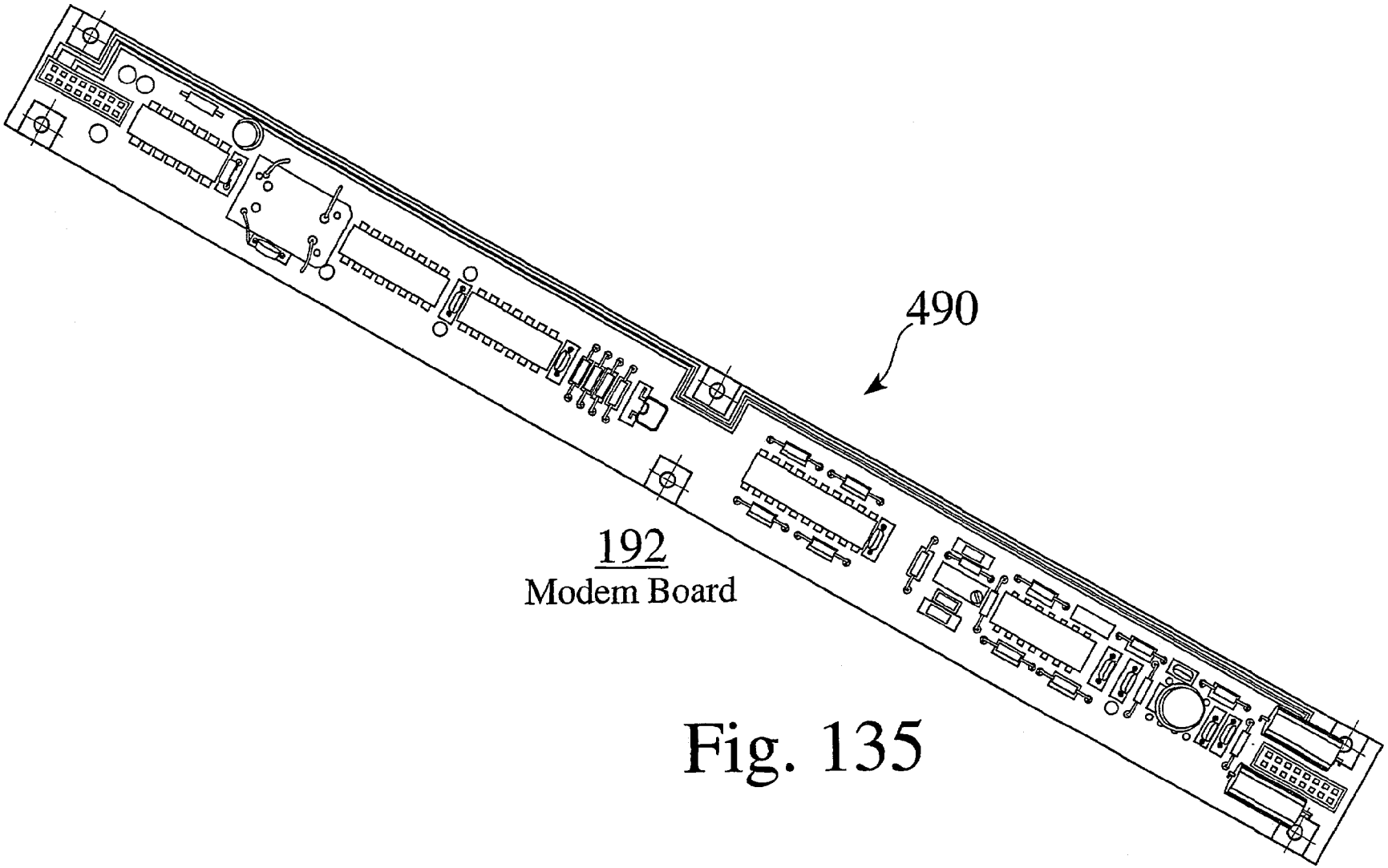
Figure 136:
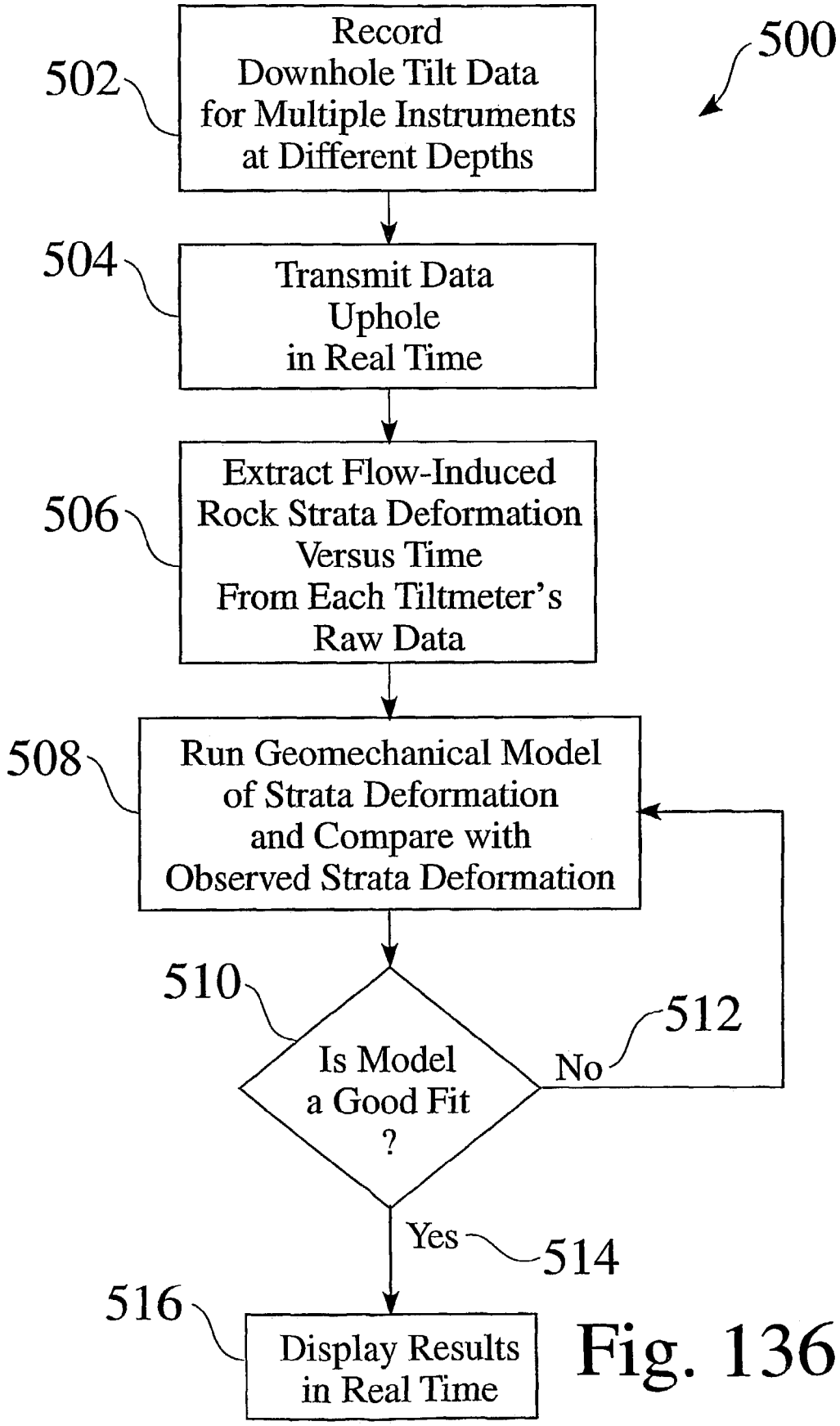
Figure 137:
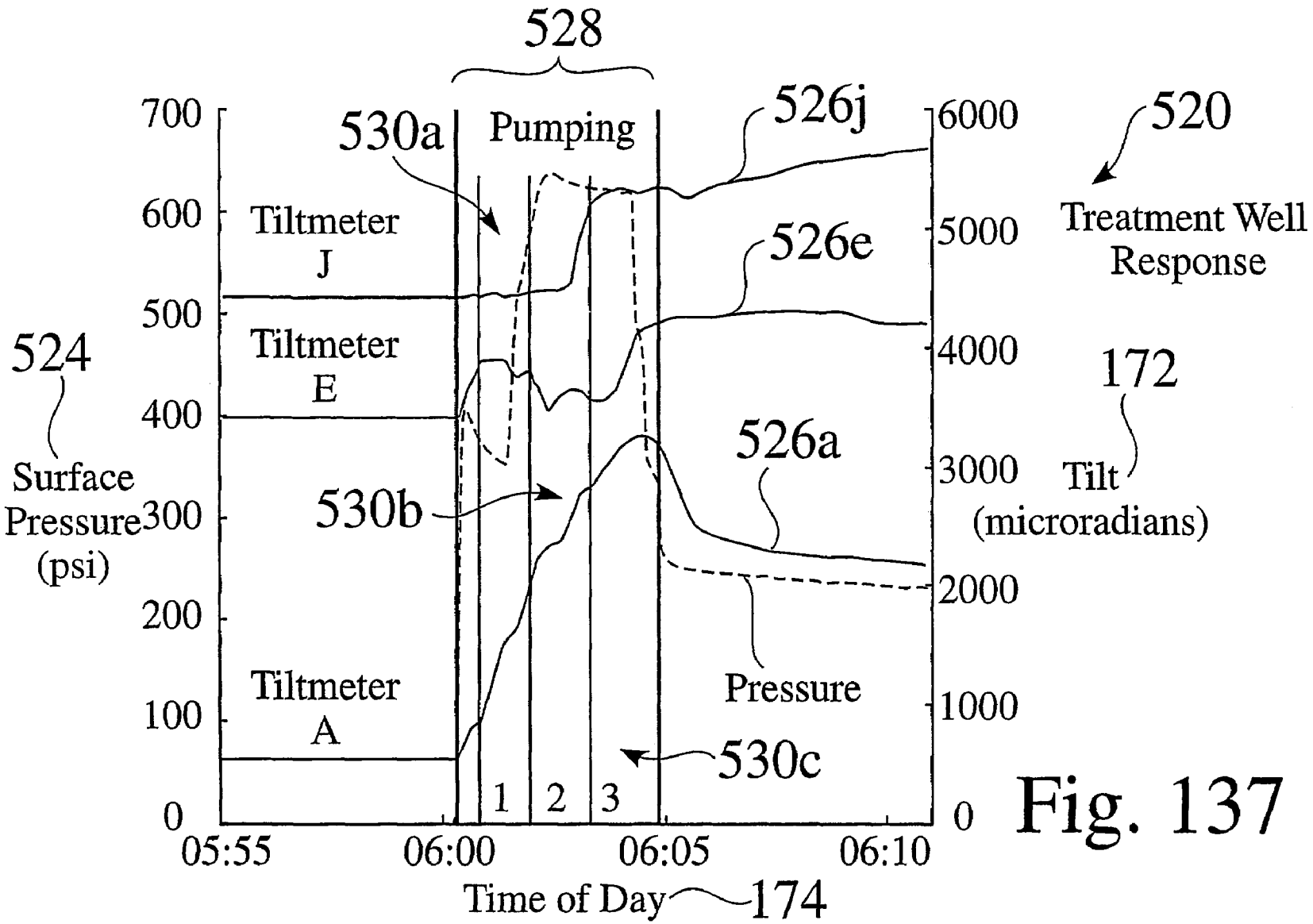
Figure 138:
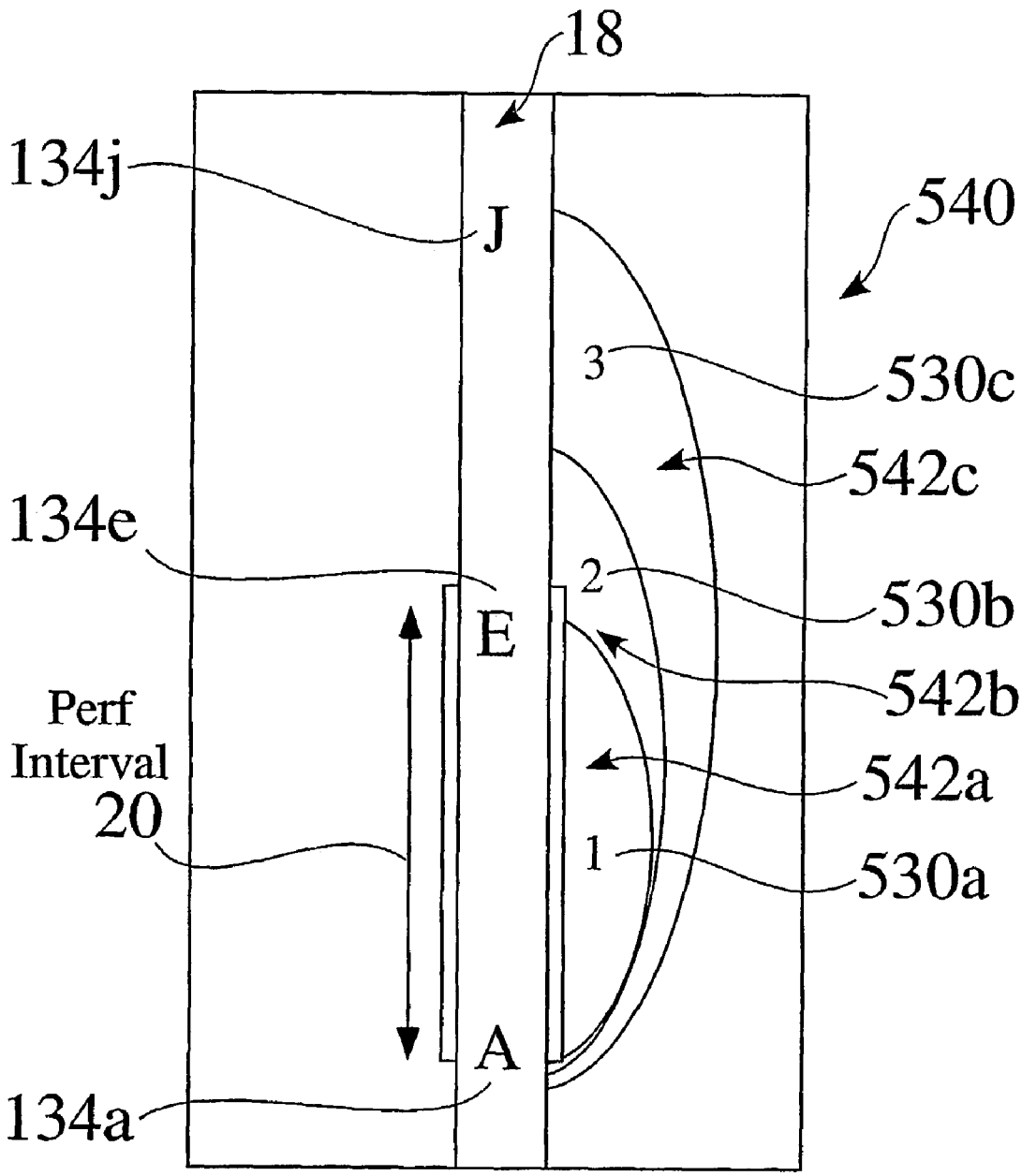
Figure 139:
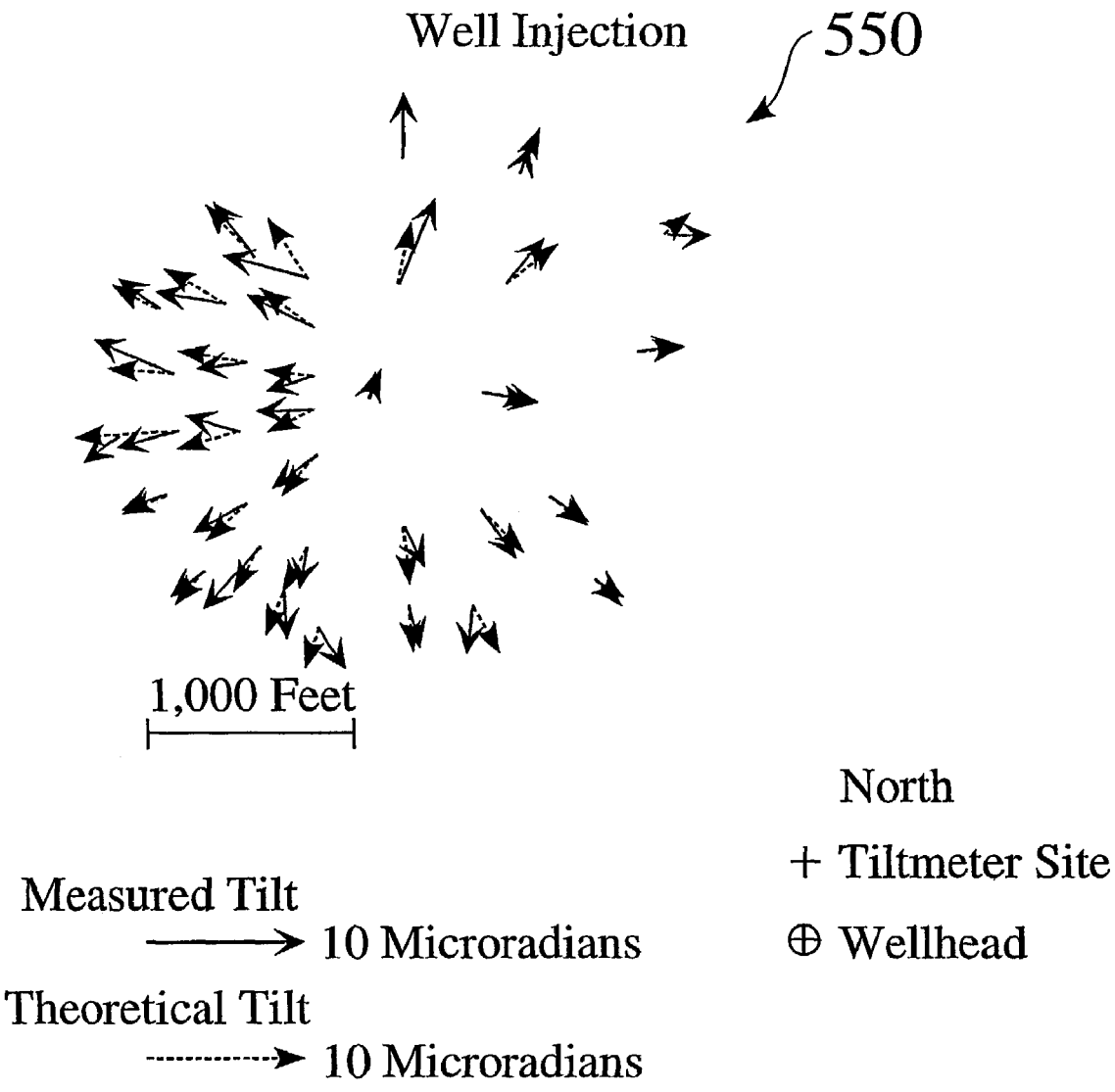
Figure 140:
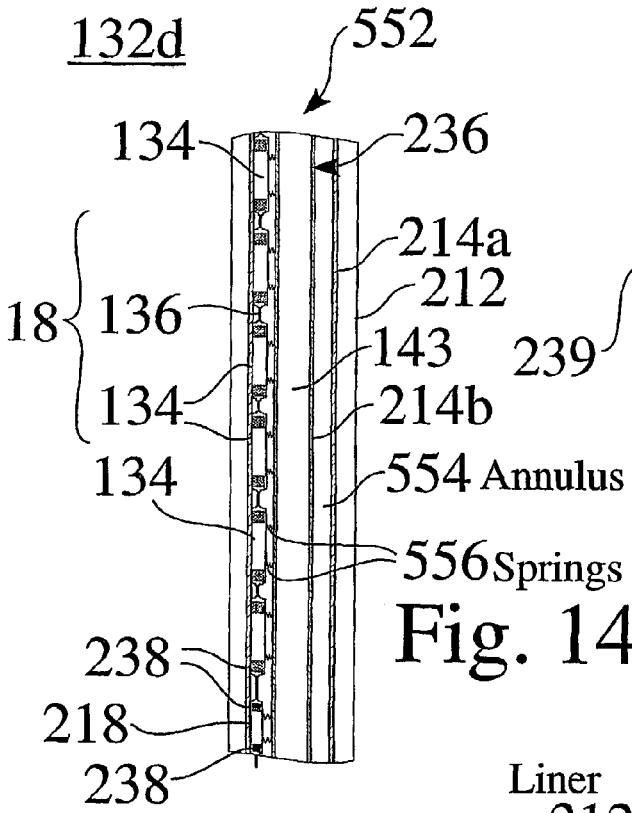
Figure 141:
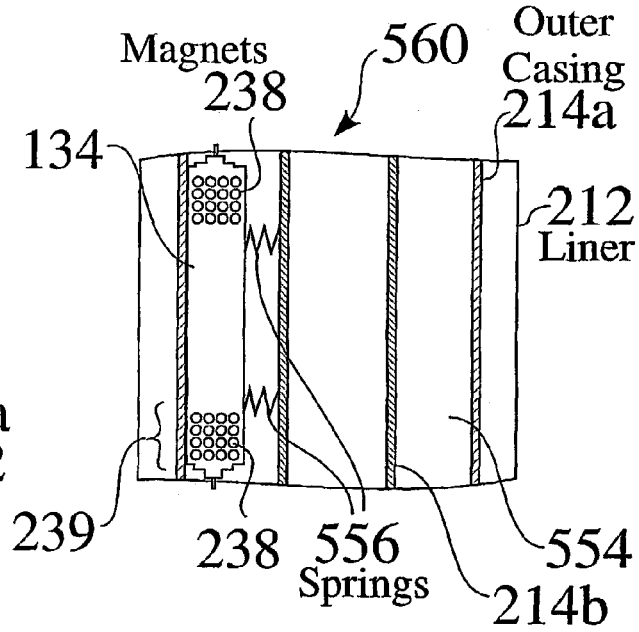
Figure 142:
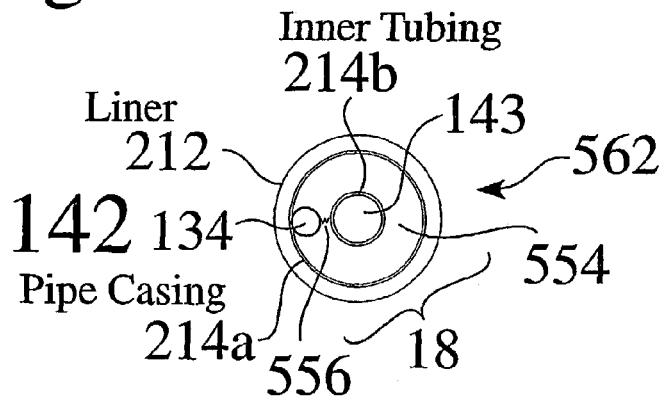
Figure 143:
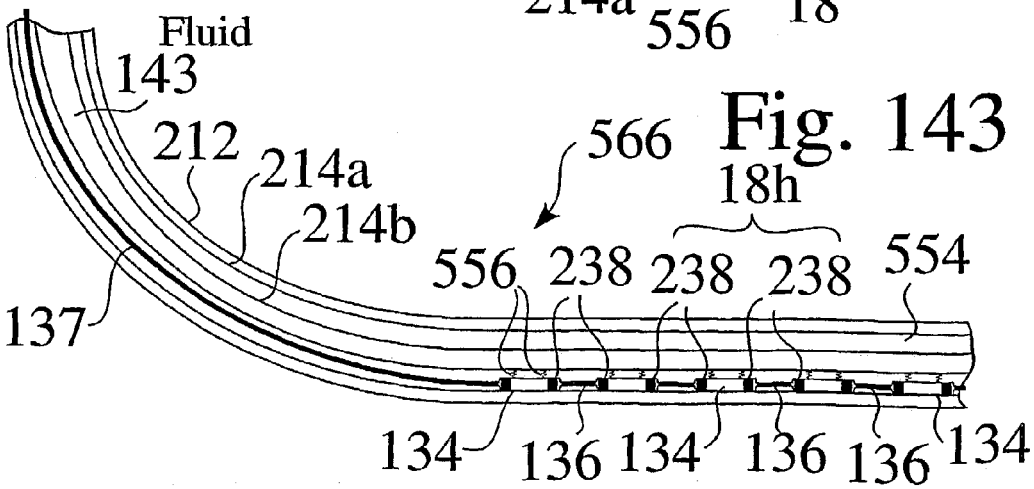

FIG. 132 is a detailed plan view of a tiltmeter power supply board;

FIG. 133 shows a tiltmeter accelerometer assembly;

FIG. 134 is a detailed plan view of a tiltmeter analog board;

FIG. 135 is a detailed plan view of a tiltmeter modem board;

FIG. 136 is a simplified flow chart of treatment well tiltmeter data acquisition, data analysis, and real-time data display;

FIG. 137 is a chart of treatment well tilt response to applied surface pressure for a plurality of tiltmeters;

FIG. 138 is a graph which represents fracture-induced deformation for a well, based upon the measured tilt mapping data from a plurality of treatment well tiltmeters;

FIG. 139 shows a plan view of measured and projected tilt for a plurality of surface tiltmeters;

FIG. 140 is a partial cutaway view of a treatment well tiltmeter system, in which the tiltmeters are magnetically attached to a well casing, in an annular region formed between the casing and an inner tube;

FIG. 141 is a detailed cutaway view of a tiltmeter which is magnetically attached to a well casing in an annular region formed between the casing and an inner tube;

FIG. 142 is an end view of a tiltmeter which is magnetically attached to well casing in an annular region formed between the casing and an inner tube; and FIG. 143 is a partial cutaway view of a horizontal treatment well tiltmeter system, in which the tiltmeters are magnetically attached to the well casing in an annular region formed between the casing and an inner tube.

DETAILED DESCRIPTION OF PREFERRED EMBODIMENTS

Figure 1:
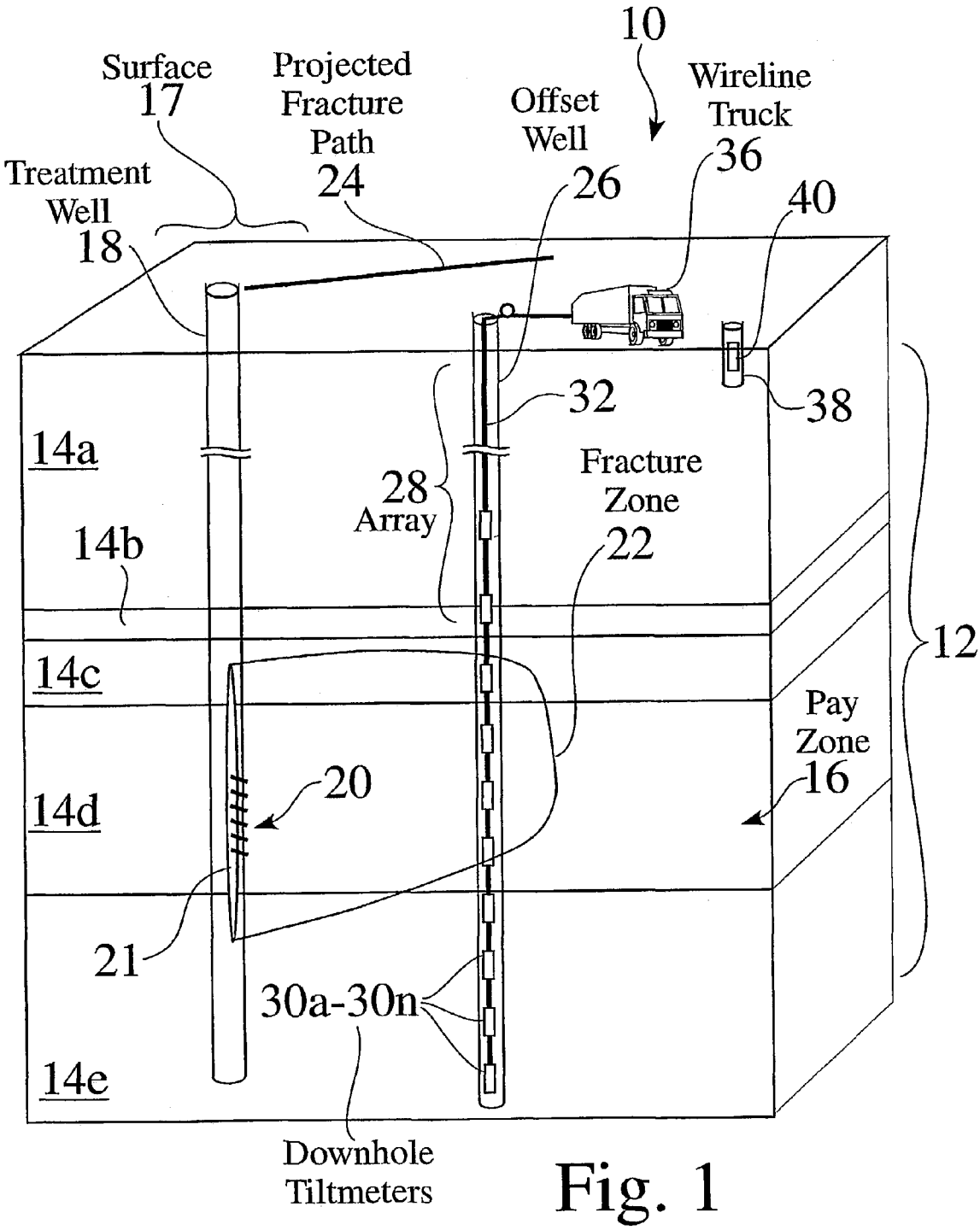
FIG. 1 shows an offset well tiltmeter system.

FIG. 1 is a partial cutaway view 10 showing a treatment well 18 which extends downward into strata 12, through one or more geological layers 14*a*–14*e*. A fracture zone 22 is formed within a previously formed perforation region 20 in the treatment well 18, such as to extend into one or more pay zones 16 within the strata 12. A fracture process is typically designed to coincide with a desired projected fracture path 24, such as to extend into a pay zone 16.

Surface tilt meters 40 are often placed in shallow surface bores 38, to record the tilt of the surface region at one or more locations surrounding the treatment well 18. The surface bores 38 have a typical depth of ten to forty feet. Tilt data collected from the surface tilt meters 40 from a treatment well fracture process is used to estimate the orientation of the formed fracture zone 22.

As seen in FIG. 1, an array 28 of offset well tilt meters 30*a*–30*n* are placed in an offset wellbore 26, to record data from each of the tiltmeters 30*a*–30*n* at different depths within the offset well 26, during a fracture process within the treatment well 18. The array 28 of offset well tilt meters 30*a*–30*n* further comprises a wireline 32, which extends to the surface, as well as between each of the offset well tiltmeters 30*a*–30*n*. The wireline 32 is typically provided by a wireline truck 36. Tilt data collected from the offset well tilt meters 30*a*–30*n* from a treatment well fracture process can be used to estimate the extent, i.e. the height, length and width, of the formed fracture zone 22.

Figure 2:
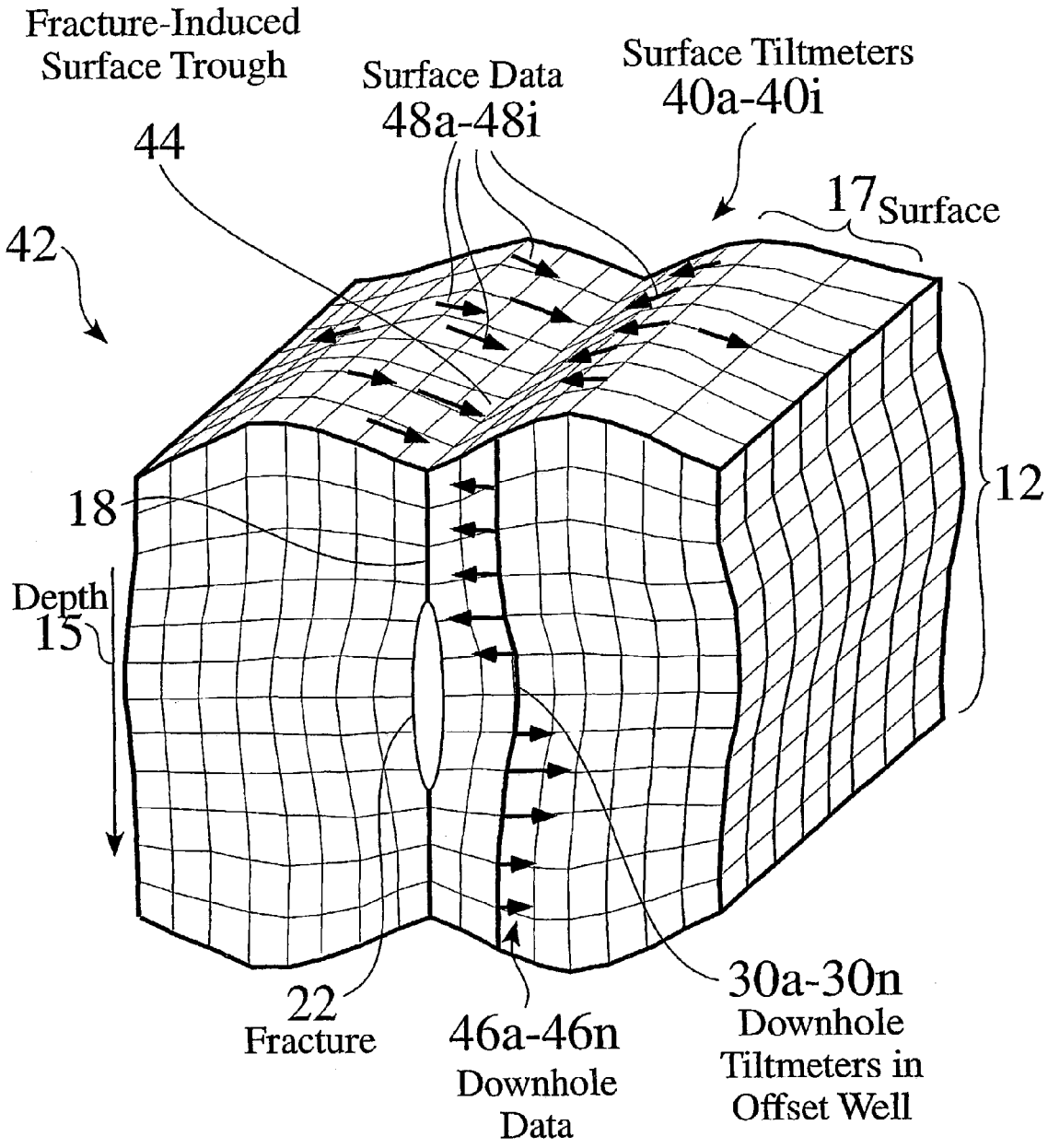
FIG. 2 is a perspective view of fracture-induced deformation.

FIG. 2 is a schematic view of a fracture-induced deformation field 42, as seen both downhole, by an offset tiltmeter array 28, and at the surface 17, by a plurality of tiltmeters 40*a*–40*i*. A fracture 22 is induced within a treatment well 18, at a desired depth 15. One or more surface tiltmeters 40*a*–40*i* record surface tilt data 48*a*–48*i* at surface locations near the treatment well 18. As seen in FIG. 2, the surface tilt data 48*a*–48*i* indicates the presence of a surface trough 44 formed by a vertical fracture 22. Surface tiltmeters 40 which are located close to the formed trough 44 point downhill, towards the trough 44, while surface tiltmeters further away point away from the fracture zone 22.

One or more offset well tiltmeters 30*a*–30*n* record offset well tilt data 46*a*–46*n* at different depths within the offset well 26, during a fracture process within the treatment well 18. As seen in FIG. 2, the offset well tilt data 46*a*–46*n* indicates the depth 15 and magnitude of the fracture 22. The measured deformation field at the surface 17, with a two-dimensional array 40*a*–40*i*, gives a very different view of the deformation field than a one-dimensional (linear array) 30*a*–30*n* downhole in an offset wellbore 26.

While induced fractures 22 are typically intended to extend along a projected fracture path 24 (FIG. 1), at a controlled depth 15, the actual wellbore 18 and strata 12 conditions commonly yield a variety of actual fracture results.

FIG. 3 is a view 50 of a fracture-induced deformation 22 extending from a treatment well 18 having vertically confined growth, at a depth 15 which corresponds with a pay zone 16. The vertical extent 54 of the fracture extends substantially across the pay zone 16, and the length 54 of the fracture 22 extends well within the pay zone 16.

FIG. 4 is a view 56 of a fracture-induced deformation having out of zone growth. While the fracture 22 has vertically confined growth, the vertical extent 54 of the fracture extends beyond the pay zone 16, and the length 54 of the fracture extends only a short distance into the pay zone 16.

FIG. 5 shows fracture-induced deformation 22 having upward fracture growth 58. While the upper fracture 22 has vertically confined growth, the vertical extent 54 of the fracture 22 extends upward beyond the pay zone 16, and fails to extend substantially across the lower region of the pay zone 16.

FIG. 6 is a view of a fracture-induced deformation 22 having twisting fractures 62. While the fracture 22 has vertically confined growth, the vertical extent 54 of the fracture is twisted axially within the pay zone 16.

FIG. 7 is a view of a fracture-induced deformation 64 having poor fluid diversion across one or more of a plurality of pay zones 16*a*–16*c*. While the upper fracture 22 has vertically confined growth, the vertical extent 54 of the fracture extends beyond the pay zone 16*a*. The fracture 22 generally located in the lowest pay zone 16*c* fails to extend substantially across the lowest pay zone 16*c*, and there is no fracture 22 that is generally formed into the middle pay zone 16*b*.

FIG. 8 is a simplified view 66 of a fracture-induced deformation having multiple fractures 68 which dip from vertical. While the fractures 22 generally extend into the strata 12 in the pay zone region, the fractures 22 are not substantially aligned with a vertically aligned well bore 18.

FIG. 9 is a simplified view 70 of a fracture-induced deformation having horizontal fractures 72. While the fractures 22 generally extend into the strata 12 in the pay zone region 16, the horizontal fractures 72 are not substantially aligned with either the treatment well 18 or the vertically aligned pay zone 16. FIG. 10 is a view of a fracture-induced deformation 74 having T-shaped fractures 22,72, in which a combination of fractures 22 having different alignments are formed, and do not necessarily extend across the pay zone 16.

Filed Development Optimization. While the knowledge of fracture induced deformations 22 for a single well are often beneficial, the overall knowledge of the strata and fracture growth obtained through one or more tilt-mapped fractures from a plurality of boreholes can also yield a wealth of information for full field development.

Figure 11:
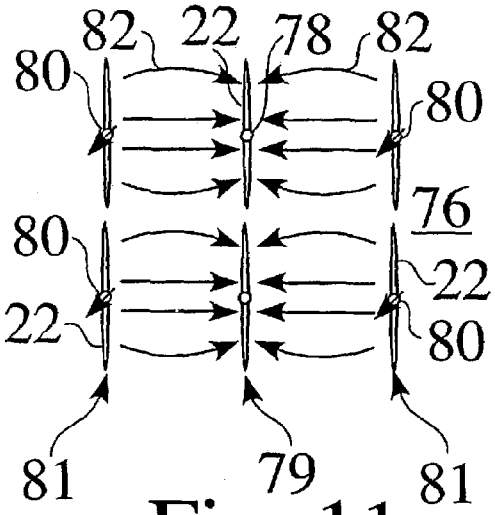
FIG. 11 is a plan view of optimized water/steam flood injection in a well field.

FIG. 11 is a plan view 76 of an optimized water/steam flood injection well pattern in a field. Water and/or steam injection is often used to enhance hydrocarbon recovery. In FIG. 11, Water and or steam is injected through injector well bores 80, and producer wells 78 are used to obtain product, e.g. oil and/or gas. For strata 12 in which induced fractures 22 are generally aligned to coincide with the injector lines 81 of injector well bores 80 and the producer line of producer wells 78, the injected enhancement fluid 82 substantially increases the flow of product across the strata 12 toward the fracture zones 22 of the producer wells 78.

Figure 12:
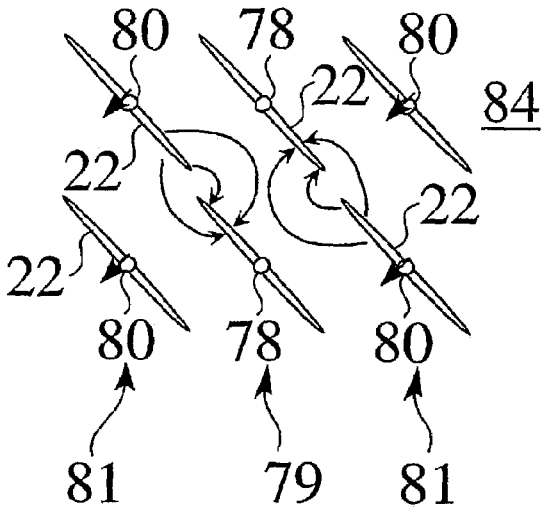
FIG. 12 is a plan view of non-optimal water/steam flood injection in a well field.

FIG. 12 is a plan view of non-optimal water/steam flood injection in a well field. As seen in FIG. 12, the induced fractures 22 are not generally aligned to coincide with the injector lines 81 of injector well bores 80 and the producer line of producer wells 78. Therefore, injected enhancement fluid 82 may not substantially increase the flow of product across the strata 12 toward the fracture zones 22 of the producer wells 78.

Figure 13:
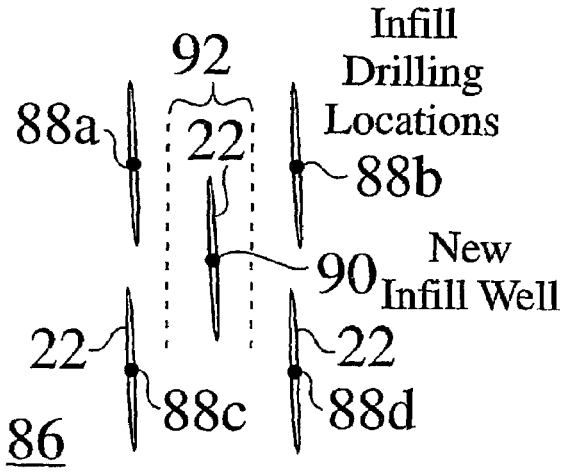
FIG. 13 is a plan view showing the placement of an infill well in a well field.
Figure 14:
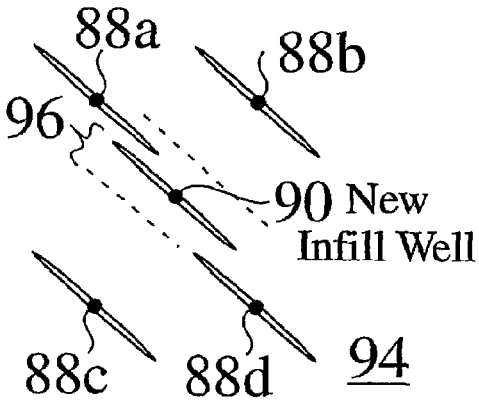
FIG. 14 is a plan view showing non-optimal placement of an infill well in a well field.

In field development, it is often desirable to add a new well 18 to an existing field, such as to access a pay zone region 16 which is not efficiently accessed by existing Wells 18. FIG. 13 is a plan view showing the placement 86 of an infill well 90 in a well field of existing wells 88*a*–88*d*. The infill well accesses a region 92 that is not previously accessed by the fracture regions 22 of the existing wells 88*a*–88*d*. FIG. 14 is a plan view showing non-optimal placement of an infill well 90 in a field of existing wells 88*a*–88*d*. In FIG. 14, the fracture regions 22 of the infill well 90 access a region 96 which is generally aligned with and is accessed by the existing fracture regions 22 of existing wells 88*a*–88*d*. While the plan view of existing well heads 88*a*–88*d* in FIG. 13 and FIG. 14 are similar, the existing strata 12 and fracture regions 22 are different. Field development for infill wells 90 can therefore be improved, based upon accurate data acquisition and analysis of the natural and formed structures.

Figure 15:
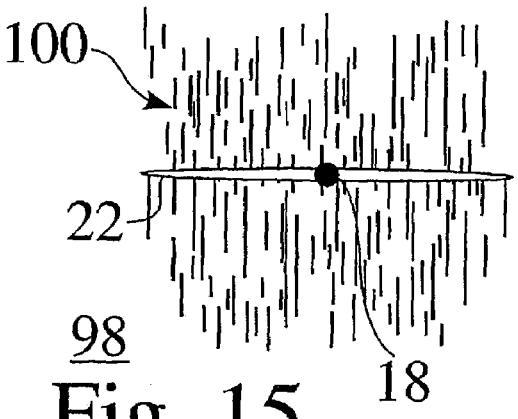
FIG. 15 is a plan view of fracture-induced deformation which crosses natural fractures.
Figure 16:
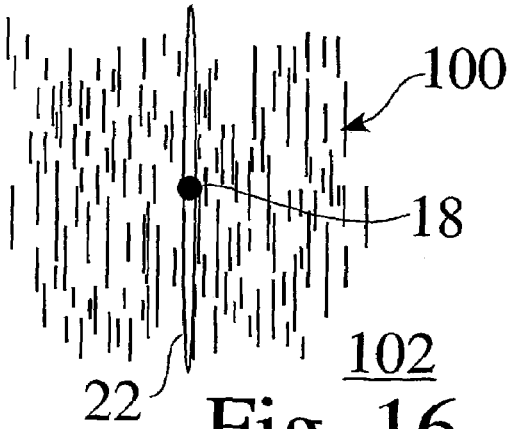
FIG. 16 is a plan view of fracture-induced deformation which is substantially aligned with natural fractures.

FIG. 15 is a plan view 98 of fracture-induced deformation 22 which crosses natural frac structures 100. The fracture region 22 accesses a large portion of the natural frac structure 100. FIG. 16 is a plan view 102 of fracture-induced-deformation 22 which is substantially aligned with natural fractures. The fracture region 22 in FIG. 16 accesses a limited portion of the natural frac structure 100. Treatment well fracturing is often enhanced by the controlled establishment of a perforation zone 20 and fracture structure 22 which accesses a large portion of a surrounding natural frac structure 100.

Fracture Treatment Optimization. FIG. 17 is a simplified view of fracture-induced deformation 104 which is located within and substantially covers the vertical height 106 of a pay zone 16. FIG. 18 is a simplified view of fracture-induced deformations 108 which incompletely access the vertical height 106 of a pay zone region 16.

FIG. 19 is a simplified view of fracture geometry 110 which is substantially located within and extends 52 well into a pay zone 16. FIG. 20 is a view of a fracture geometry 112 which extends vertically above and below pay zone 16, in which the fracture length 52 is relatively small.

FIG. 21 is a view 114 of fracture-induced deformation geometry as a function of time, in which the deformations 22*a*, 22*b*, 22*c*, 22*d* continue to extend within a pay zone region 16. FIG. 22 is a view 116 of fracture-induced deformation geometry as a function of time, in which the deformation 22*a*, 22*b*, 22*c*, 22*d* tends to extend vertically beyond a pay zone 16.

FIG. 23 is a view 118 of multi-zone coverage fracture-induced deformation, in which the deformations are substantially located within and extend well into each of a plurality of pay zones 16*a*, 16*b*, 16*c*. FIG. 24 is a view 120 of multi-zone coverage fracture-induced deformation, in which the deformations do not extend into each of a plurality of pay zones 16*a*, 16*b*, 16*c*.

FIG. 25 is a view 122 of fracture-induced deformation geometry for a substantially horizontal well 18*h*, in which the deformations extend generally across the pay zone strata 16. FIG. 26 is a view 124 of fracture-induced deformation geometry for a substantially horizontal well 18*h*, in which the deformations are not substantially centered across the pay zone strata 16.

FIG. 27 is a view 128 of fracture-induced deformation, in which the formed perforation region 21 for the well 18 is aligned with and extends across the pay zone strata 16. FIG. 28 is a view 130 of fracture-induced deformation, in which one or more formed perforation regions 21 are misaligned aligned with the pay zone 16.

Figure 29:
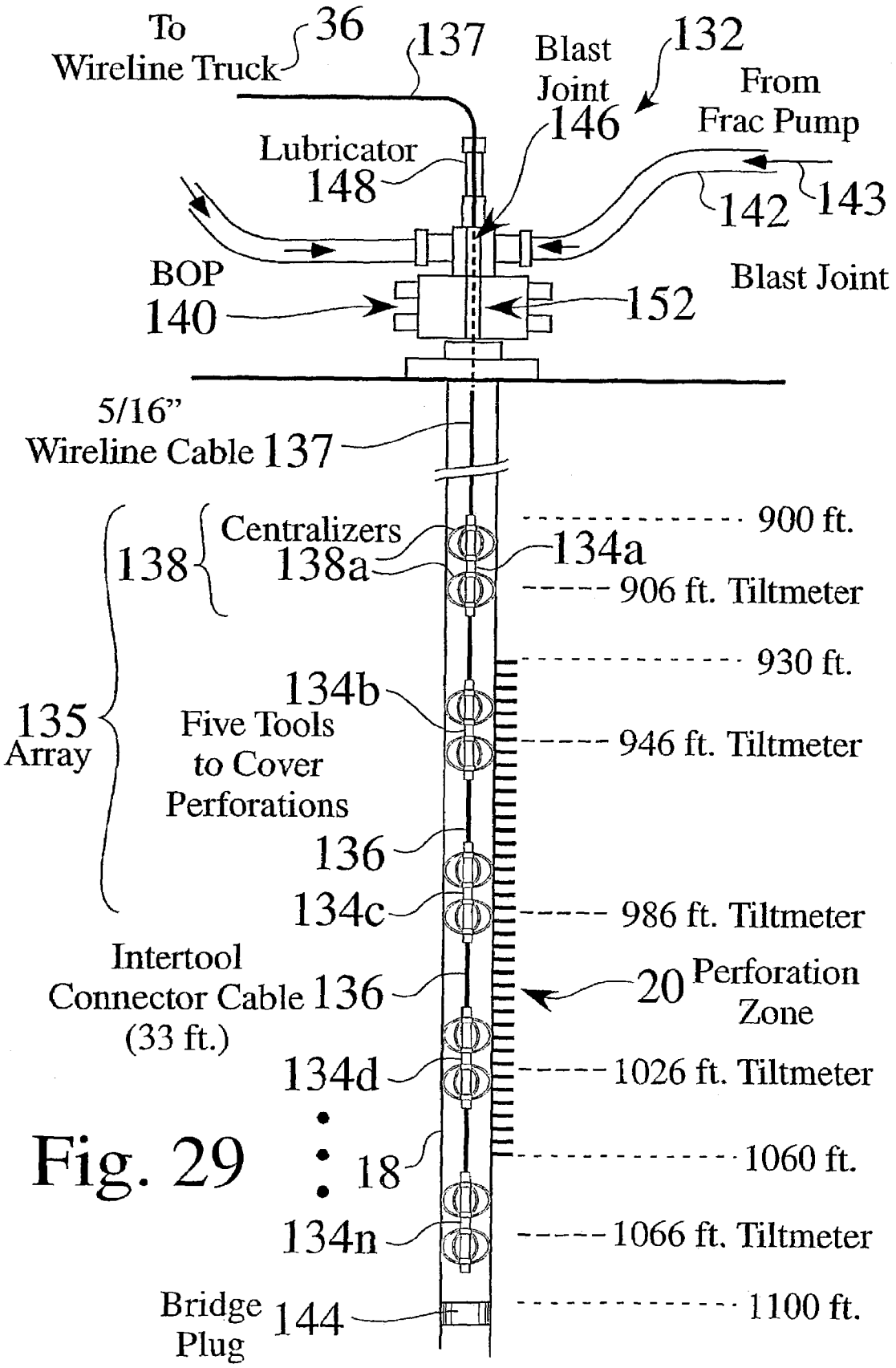
FIG. 29 is a schematic view of a treatment well tiltmeter system.

Treatment Well Tiltmeter System. FIG. 29 is a schematic view of a treatment well tiltmeter system 132. One or more tiltmeters 134*a*–134*n* are located at different depths within a treatment well 18. Interconnection cable lines 136, each typically having a length of approximately 20 to 100 feet, interconnect each of the tiltmeters 134 within a treatment well tiltmeter array 135. A main wireline 137 extends from the tiltmeter system 132 to the surface, and is typically provided by a wireline truck 36. The tiltmeters 134*a*–134*n* are preferably installed over a depth range approximating one or more depths 15 where fluid outflow or inflow is occurring.

Each of the tiltmeters 134*a*–134*n* further comprises means 138 for fixedly positioning the tiltmeter in position, either within the active flowstream, or with in a "quiet" annular region 554 (FIG. 140) between the casing 214*a* and an inner tubing 214*b*. As seen in the tiltmeter embodiment 134 in FIG. 29, one or more centralizers 138*a* are located on each tiltmeter 134, and position the tiltmeters 134*a*–134*n* within the casing 214. In alternate embodiments, the tiltmeters 134*a*–134*n* are attached either permanently or removably to the treatment well structure 18, such as within or external to the casing 214.

The treatment well 18 typically comprises a well head BOP 140. The main wireline passes through a lubricator 148, which allows the tiltmeter array 135 to be removed from an active wellbore 18 under pressure. A bridge plug is typically located in the treatment well 18, below the tiltmeter system, and below the estimated pay zone 16.

The tiltmeters 134*a*–134*n* are preferably placed such that one or more tiltmeters 134 are located above, below, and/or within an estimated pay zone region 16, in which a perforation zone 20 is formed. For example, in FIG. 29, tiltmeter 134*a* is located above a perforation zone 20, tiltmeters 134*b*,134*c*, and 134*d* are located within the perforation zone region 20, and tiltmeter 134*n* is located below the perforation zone region 20.

A frac pump supply line 142 is connected to the well head 140 for a fracturing operation, whereby a fracturing fluid 143 is controllably applied to the treatment well. The treatment may also comprise a blast joint 146 and blast joint fluid diversion 152.

The tiltmeter array 135 collects continuous data 213 of the induced earth deformation versus time, and transmits this data 213 back to the surface via wireline 136,137, via permanent cabling, or via memory storage, if or when the tiltmeters 134 are returned to the surface. The time-series deformation (tilt) data 213 is analyzed over various time intervals, to determine the pattern of subsurface deformation. The geophysical inverse process is then solved, to estimate the nature of the subsurface fluid flow and fracture growth which is responsible for the observed deformation.

The treatment well tiltmeter system 132 provides mapping for subsurface injection processes, such as for hydraulic fracture stimulation, subsurface waste disposal, produced water re-injection, or for other processes where fluid injection is occurring below fracturing pressure. The processing of tilt data also provides monitoring for fluid production related phenomenon, such as for formation compaction, poroelastic swelling, and thermoelastic deformation, which can be used to determine inflow and outflow rates or patterns from various subsurface strata for long-term reservoir monitoring.

The treatment well tiltmeter system 132 preferably provides data acquisition and analysis systems, to map the fracture height growth in real-time on mini-frac pumping treatments, i.e. pumping jobs run without proppant. Additionally, possible results of analysis of the data include interpretation of fracture width and length, as well as enhanced resolution of fracture closure stress, net fracture pressure and fracture fluid efficiency.

The treatment well tiltmeter system 132 is designed to withstand the hostile treatment well environment, which often comprises high temperatures, in which high pressure fluid is usually applied to the treatment well 18, such as for a fracturing process. Therefore, preferred embodiments of the treatment well tiltmeter assemblies 134*a*–134*n* are designed to withstand these high temperatures and pressures, and are packaged in a small diameter housing, to promote the flow of working fluid 143 and/or proppant within the treatment wellbore 18. While tiltmeter assemblies 134 can be coupled to the wellbore in a manner similar to that of an offset wellbore tiltmeter system, the treatment well tiltmeter assemblies 134*a*–134*n* are preferably coupled to the treatment well bore 18 to minimize the flow resistance from working fluids 143 and proppants.

Figure 30:
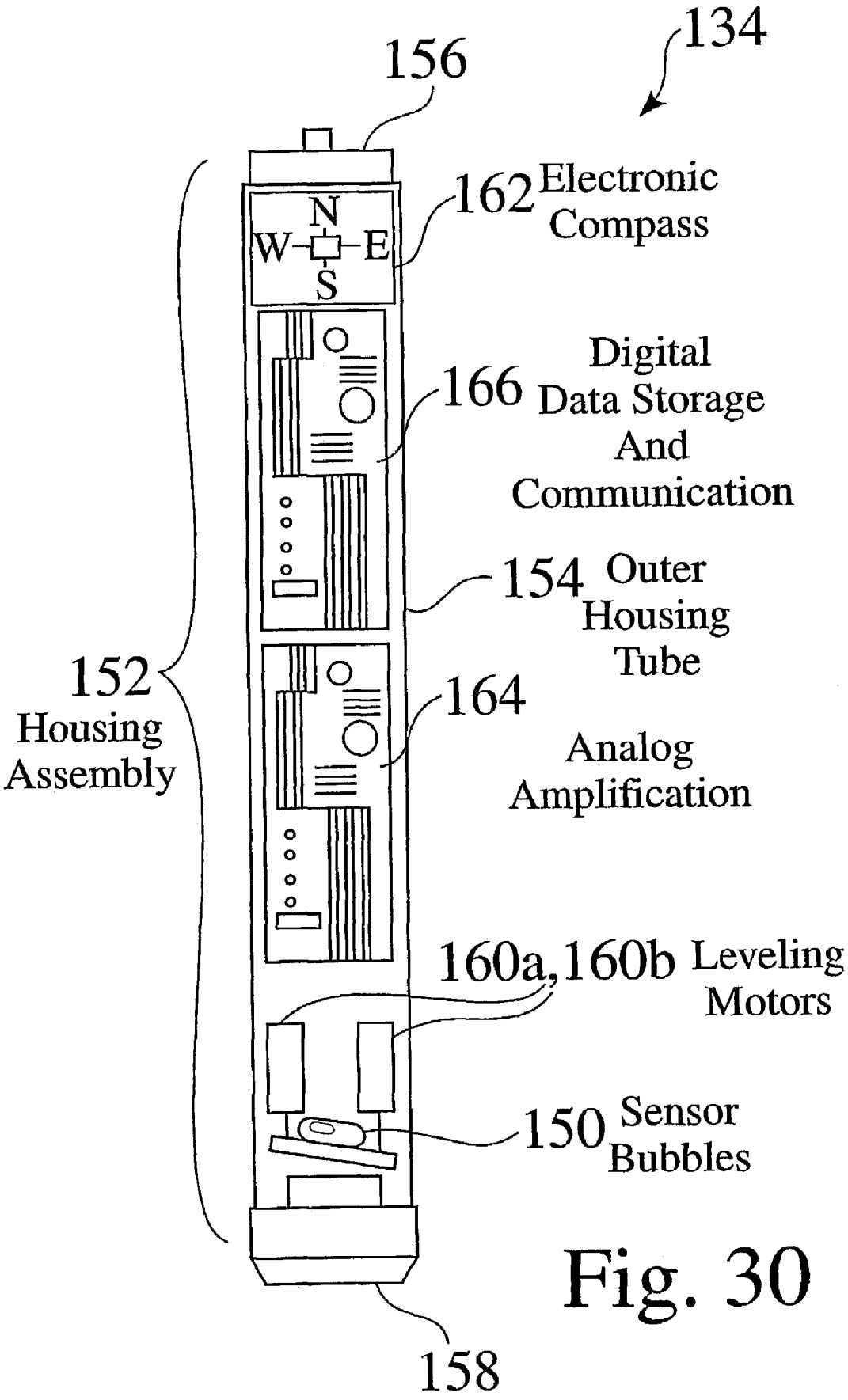
FIG. 30 is a simplified schematic view of a self-leveling tiltmeter assembly.

Treatment Well Tiltmeter Assembly. FIG. 30 is a simplified schematic view of a self-leveling tiltmeter assembly 134, such as a Series 5000 Tiltmeter, by Pinnacle Technologies, Inc., of San Francisco, Calif. The tiltmeter housing assembly 152 comprises an outer housing tube 154, and upper housing end cap 156, and a lower housing end cap 158. In one embodiment of the tiltmeter assembly 134, the exterior housing is an aluminum cylinder roughly 107 cm (42 in.) long and 7 cm (2.5 in.) in diameter. O-ring seals protect the internal components from splash and dust intrusion. Other casing materials, such as stainless steel, titanium, or INCONEL™, are preferably used in corrosive environments.

The tiltmeter assembly 134 comprises a plurality of tilt sensors 150, which preferably comprise orthogonally deposed sensor bubbles 150. Tilt sensors 150 operate on the same principle as a carpenter's level. The orthogonal bubble levels 150 have a precise curvature. Electrodes detect minute movements of the gas bubble within a conductive liquid, as the liquid seeks the lowest spot in the sensor 150. In one embodiment of the tiltmeter assembly 134, the tilt sensors 150 can resolve tilt as little as one billionth of a radian (0.00000005 degrees).

The tiltmeter assembly 134 preferably comprises a tilt sensor leveling assembly 160, by which the tilt sensors 150 are leveled before a fracture operation in the treatment well 18. The tilt sensor leveling assembly 160 provides a simple installation for deep, narrow boreholes. Once the tiltmeter 134 is in place, motors 160 automatically bring the two sensors 150 very close to level, and continue to keep the sensors 150 in their operating range, even if large disturbances move the tiltmeter 134.

Besides tilt, the tiltmeter 134 internally records relevant information such as location, orientation, supply voltage, and sensor temperature. In some embodiments of the treatment well tiltmeter 134, a solid state magnetic compass or gyroscope 162 provides tool orientation, so tilt direction can be accurately determined. On-board looped memory provides up to 8 months of data storage which is easily uploaded via a serial port connection at the surface, typically through a direct cable connection to another computer 210. Communication protocols support communication through up to 8,000 m (25,000 ft) of wireline cable 136,137. Alternate communication protocols support wireless communication through a transceiver and radio links, or through a cell phone interface.

For some tiltmeter applications, the tiltmeter assemblies 134*a*–134*n* are programmable, to periodically transmit data signals 213 to the external computer 210, or alternately to a radio or cell phone device, such as to conserve internal battery power. Memory is preferably retained within each of the tiltmeter assemblies 134*a*–134*n*, in the event power to the tiltmeter assemblies 134*a*–134*n* is lost.

For some tiltmeter applications, such as for surface tilt measurement, the tiltmeter 134 is powered by a small battery and solar panel combination at the surface. In a preferred embodiment of the treatment well tiltmeter system, power is supplied to each of the tiltmeters 134*a*–134*n*, from an external power supply 208 (FIG. 33), through wirelines 136,137. The wirelines 136,137 are typically comprised of a braided steel cable, which further comprises an electrically insulated power and signal conductor. Power is typically provided to each to the tiltmeters 134*a*–134*n* through the wirelines 136,137, and is preferably routed through successive tiltmeter assemblies 134 in a daisy-chain configuration.

Within each tiltmeter assembly 134, sensor signals are processed through the analog board 164, which measures and amplifies the tilt signal from the two sensors 150. The analog electronics 164 provide low noise levels and low power consumption, and have 4 gain levels, which can be changed remotely for mapping tilt signals for a wide range of magnitudes. The operating range of one embodiment of the tiltmeter electronics is from −40° C. to 85° C. (−40° F. to 185° F.). In an alternate embodiment of the tiltmeter assembly, the upper temperature limit is approximately 125° C. (260° F.). In another alternate embodiment of the tiltmeter assembly, the upper temperature limit is approximately 150° C. (300° F.).

Figure 33:
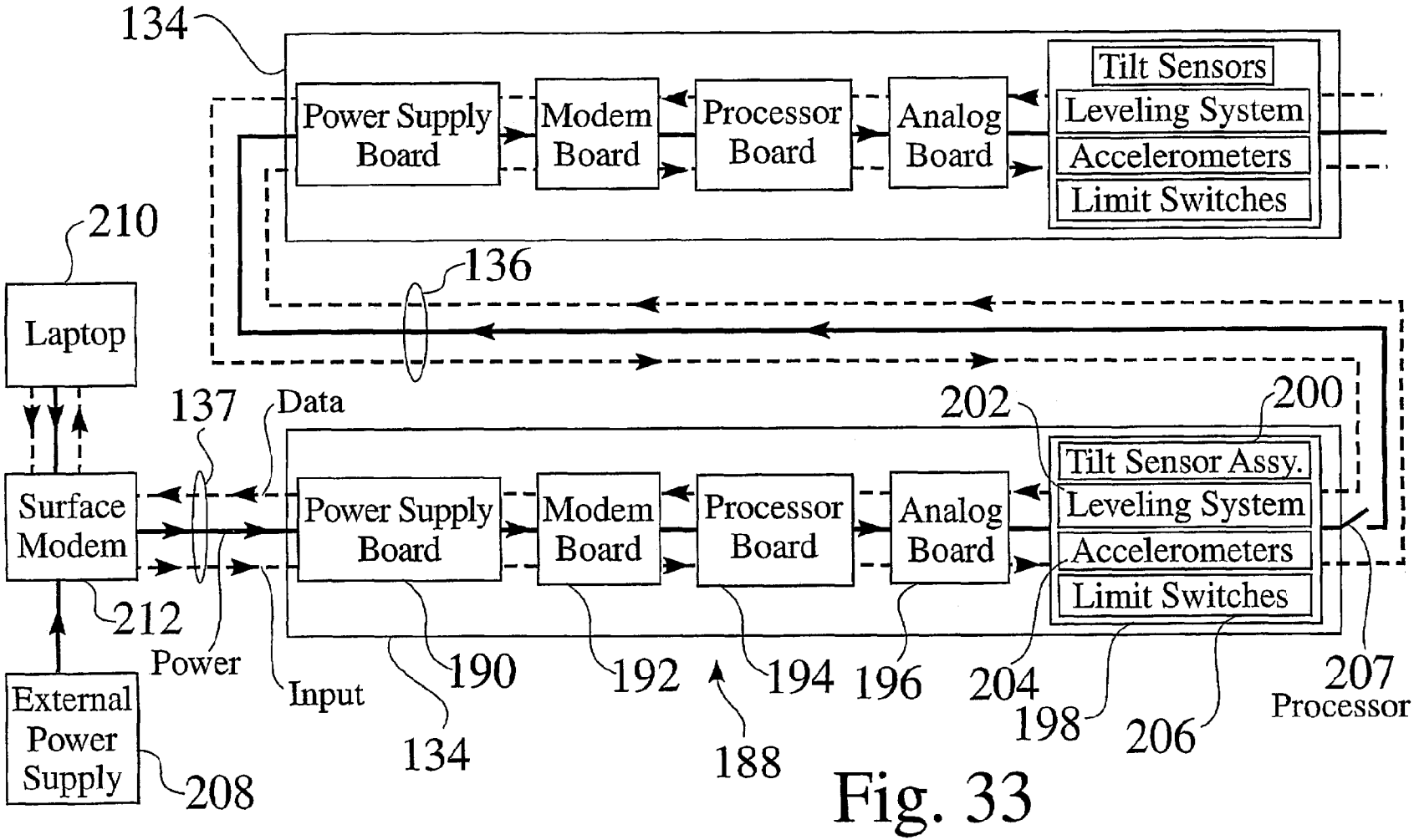
FIG. 33 is a schematic block diagram of tiltmeter electronics for one or more tiltmeters in a daisy-chain tiltmeter system.

The tiltmeter assembly 134 also comprises a digital storage and communication module 166. The digital storage and communication module 166 comprises high precision 16 bit or 24 bit A/D converters which are connected to the output of the analog amplifiers 164. Digital communication prevents signal noise during the data transmission 213 to the surface 17. In some embodiments of the treatment well tiltmeter system 132, data is stored within the tiltmeters 134. In a basic embodiment of the treatment well tiltmeter system 132, analog signals are sent up the wireline cable 137 to the recording device 210 (FIG. 33). For applications in which analog signal loss and/or noise occur, the tiltmeter provides digital signal communication. In alternate embodiments of the treatment well tiltmeter system 132, a data signal 213 (FIG. 33) is transferred from each of the tiltmeters 134*a*–134*n*, through wire lines 136,137.

Figure 31:
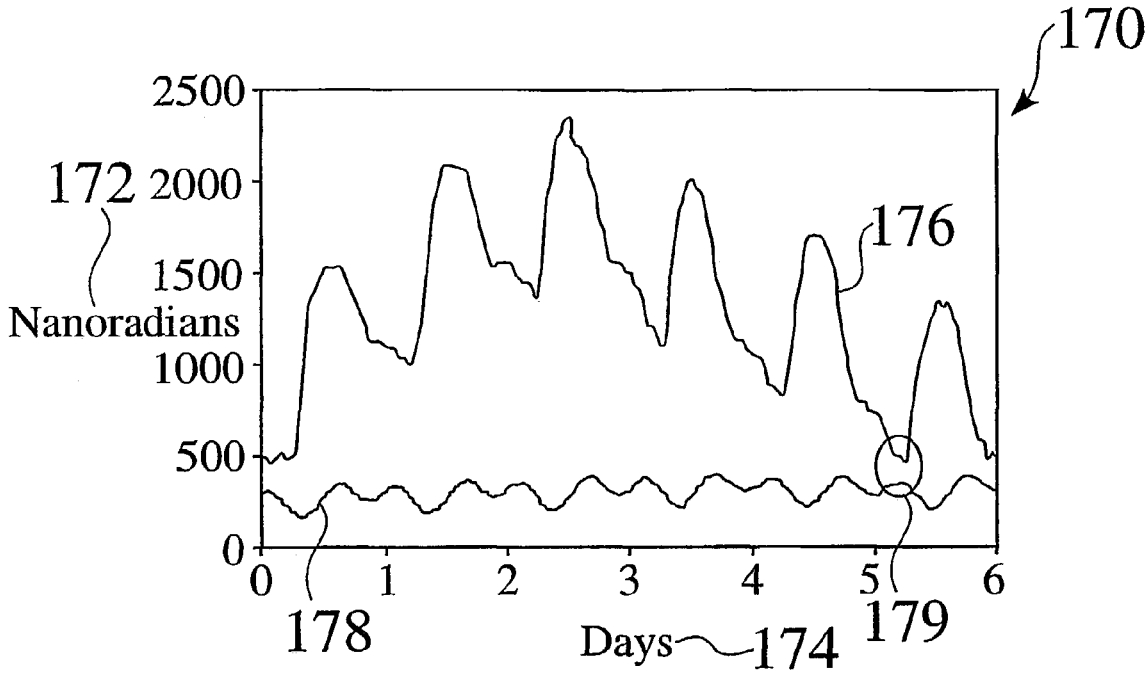
FIG. 31 is a graph which compares tilt data between non-leveling and self-leveling tiltmeter assemblies.
Figure 32:
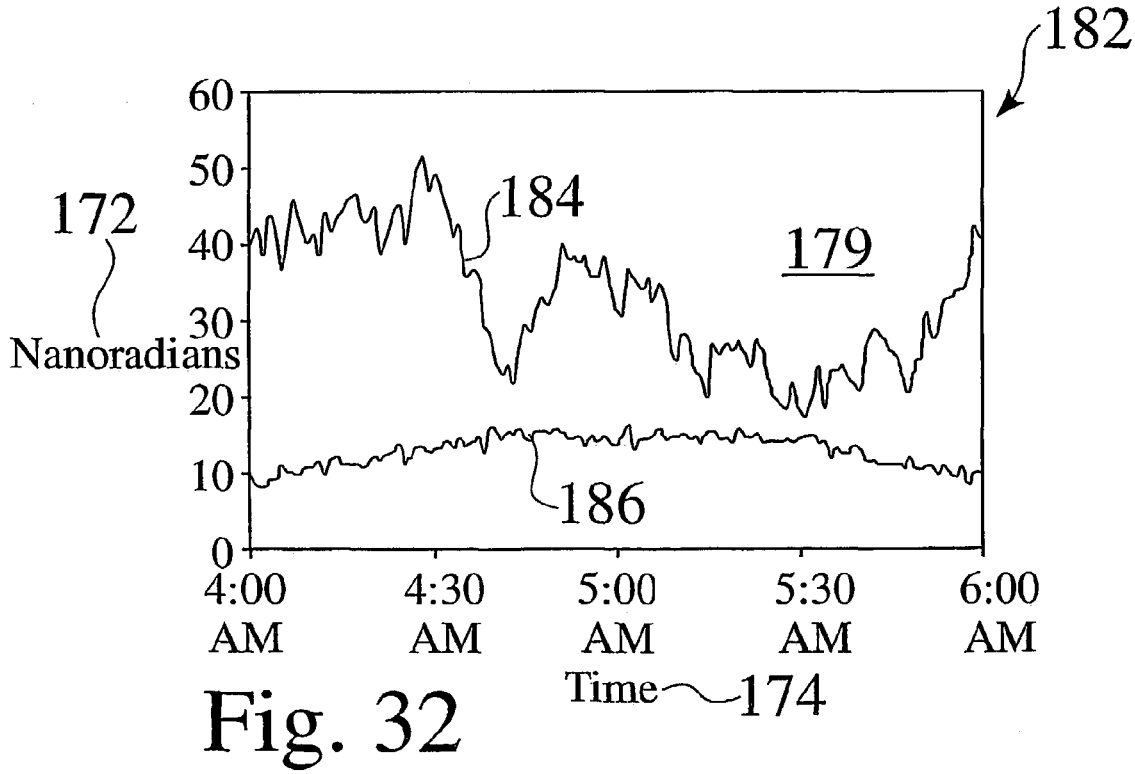
FIG. 32 is a graph which compares tilt data output between different tiltmeter sensor electronics.

FIG. 31 is a graph 170 which shows raw tilt data 176, 178 between non-leveling and self-leveling tiltmeter assemblies, respectively, for a period of six days. FIG. 32 is a graph 182 which shows tilt data 184, 184 between non-leveling and self-leveling tiltmeter assemblies, respectively, for the two hour period 179 shown in FIG. 31. The data is plotted in tilt 172 as a function of time 174. The non-leveling tilt meter data 176 shows large (about 1000 nanoradian) daily swings, resulting from near-surface thermal strains.

The Raw data 176 rises sharply when the sun rises in the morning, and declines rapidly at sunset. This level of background motion is insignificant when mapping a shallow fracture treatment, but can be significant when fracture-induced surface tilts are only a few nanqradians. The raw data 178 from the self-leveling tiltmeter 134 over the same six-day period shows only the very smooth (and predictable) background of earth tides that swing roughly 100 nanoradians twice per 24-hour period.

FIG. 33 is a schematic block diagram of tiltmeter electronics 188 for one or more tiltmeters in a tiltmeter system 132. Each tiltmeter assembly 134 shown in FIG. 33 comprises a power supply board 190, and modem board 192, a processor board 194, an analog board 196, and a sensor subsystem 198. The sensor subsystem 198 comprises a tilt sensor assembly 200, a leveling system assembly 202, an accelerometer or geophone assembly 204, and a limit switch assembly 206. The tilt sensor assembly comprises single axis sensors 150, which provide tilt resolution of better than 1 uR, range of +/−15 degrees at the sensor 150. The leveling re-zero system 202 provides pre-fracture event alignment of tilt sensors 150. For example, in a deviated well 18, the leveling system 202 typically aligns one sensor 150, e.g. 150*a*, with the wellbore 18, and aligns a second tilt sensor 150, e.g. 150*b*, at a right orthogonal angle to the well bore 18. The leveling system 202 typically provides tool orientation data 213, which is either stored or is sent uphole to the external data acquisition device 210. The accelerometer system 204 preferably comprises an integrated tri-axial accelerometer or geophone 256, which provides information needed for re-zeroing, and provides back-up sensor function, with 300 uR sensitivity. The tiltmeter electronics 188 are highly modularized, and each of the electronics boards 190, 192, 194, 164, as well as the sensor assembly 198, fit within the small inner diameter of treatment well tiltmeter housing 154.

As described above, a main wireline 137 extends to the array 135 of one or more tiltmeter assemblies 134*a*–134*n*, and a similar wireline connector cable 136 is located between tiltmeter assemblies 134*a*–134*n*. An external power supply 208 provides power 209 to the tiltmeters 134*a*–134*n*, through the wirelines 137,136. A computer 210, such as a portable laptop computer 210, provides input signals 211 to and receives output signals 213 from the tiltmeter assemblies 134*a*–134*n*, through a surface modem connection 212.

The processor board 194 provides A/D conversion, data storage and all command functions for the tiltmeter assembly 134. Each tiltmeter 134 preferably includes a unique tool ID, which is hardwired into the processor board 194, and is read at power up. The processor board 194 has flash RAM memory, with a static RAM buffer, which allows permanent data storage with no battery, and code memory, which allows software upgrades without opening the tiltmeter assembly 134. The processor board 194 also includes one or more 1 F capacitors, which provide approximately two weeks of clock function for a tiltmeter assembly 134 which has no external connection. Leveling circuitry, associated with the leveling system 202, includes 16 bit A/D conversion, which provides continuous level calibration. Accelerometer circuitry, associated with the accelerometer system 204, includes 10-bit A/D conversion, while system voltage and temperature circuitry includes 8-bit system monitor A/D conversion. A motor control circuit levels sensors, using the accelerometers and limit switches for guidance.

System software, which operates between an external computer 210 and each of the tiltmeter assemblies 134*a*–134*n*, comprises a communication protocol which provides fast and reliable communications 211, 213, as well as error detection. The external computer 210 automatically determines the order of tiltmeters 134, which are installed as a treatment tiltmeter array 135, within a treatment well 18.

A flexible data format allows easy modification of data from each of the tiltmeters 134*a*–134*n*. For example, pressure and/or temperature data 213 from each tiltmeter 134, e.g. such as from tiltmeter 134*a*, preferably has a unique coding or format, whereby data 213 that is sent to the external computer 210 through wireline 136,137 is associated with the correct tiltmeter assembly 134.

During the startup process, each treatment tiltmeter 134*a*–134*n* preferably goes through an internal start up and self-diagnosis procedure, and then performs a handshaking operation with the external computer 210. During the handshaking procedure, each of the treatment well tiltmeters 134*a*–134*n* automatically detects the system baud rate for input signals 21 land for output signals 213.

Treatment Well Tiltmeter System Configurations. FIG. 34 is a partial cutaway view 210 of a treatment well tiltmeter system 132*a*, in which the tiltmeters 134*a*–134*n* are permanently attached to the outside of the well casing 214. FIG. 35 is a detailed cutaway view 220 of a tiltmeter 134 which is permanently attached to the outside of the well casing 214, in the casing region 214 of a treatment wellbore 18. FIG. 36 is an end view 222 of a tiltmeter 134 which is permanently attached to the outside of the well casing 214. FIG. 37 is a partial cutaway view 224 of a treatment well tiltmeter system 132*a* for a generally horizontal well 18*h*, in which the tiltmeters 134*a*–134*n* are permanently attached to the outside of the well casing 214. In the treatment well tiltmeter system 132*a*, each tiltmeter 134 is attached to the casing 214, with one or more strap connectors 216. The treatment well tiltmeter system 132*a* shown in FIG. 34 further comprises a secondary sensor device 218, which is also fixedly attached to the casing 214 with one or more strap connectors 216. The secondary sensor device 218 can be used to provide general sensor information for the array, such as pressure and temperature data. The treatment well tiltmeter system 132*a* can be used for data acquisition before, during, and after a fracture operation, and does not interfere with a working fluid 143 or proppant.

Figure 38:
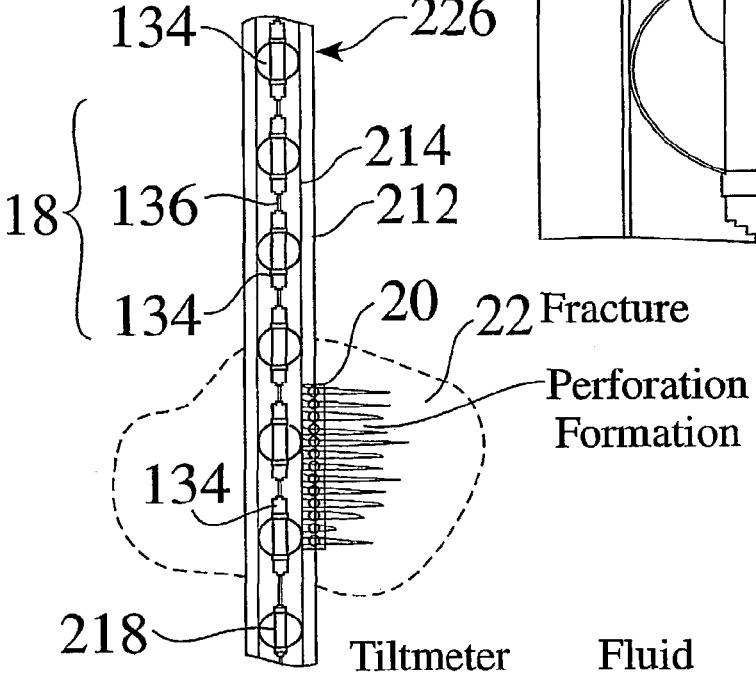
FIG. 38 is a partial cutaway view of a treatment well tiltmeter system, in which the tiltmeters are mechanically stabilized within a well casing.
Figure 39:
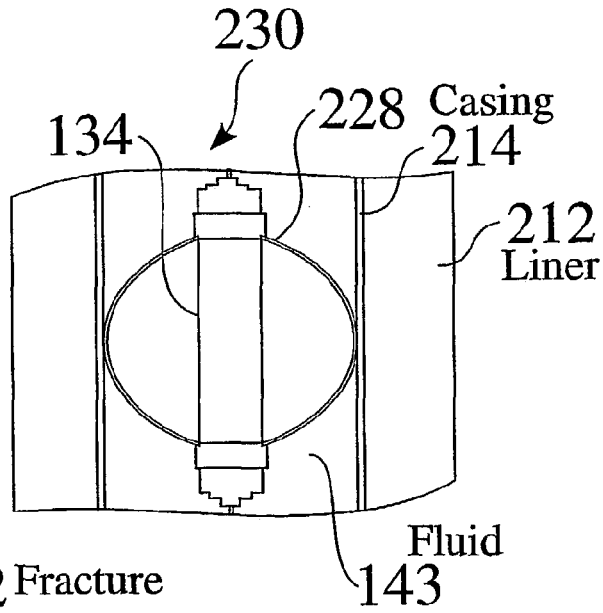
FIG. 39 is a detailed cutaway view of a tiltmeter which is mechanically stabilized within the outside of a well casing.
Figure 40:
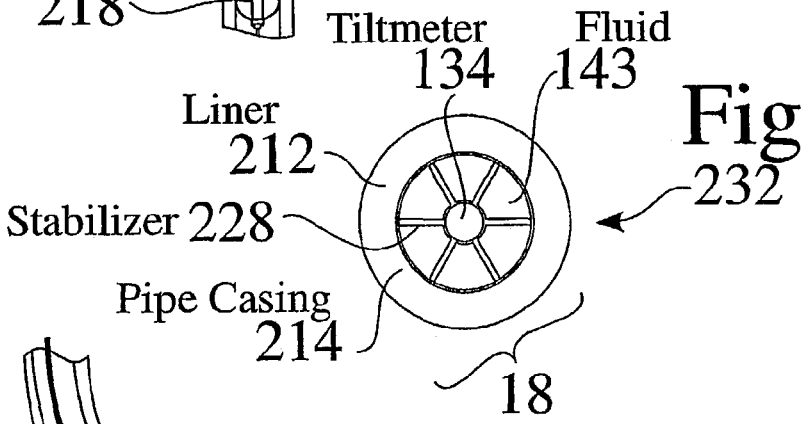
FIG. 40 is an end view of a tiltmeter which is mechanically stabilized within a well casing.
Figure 41:
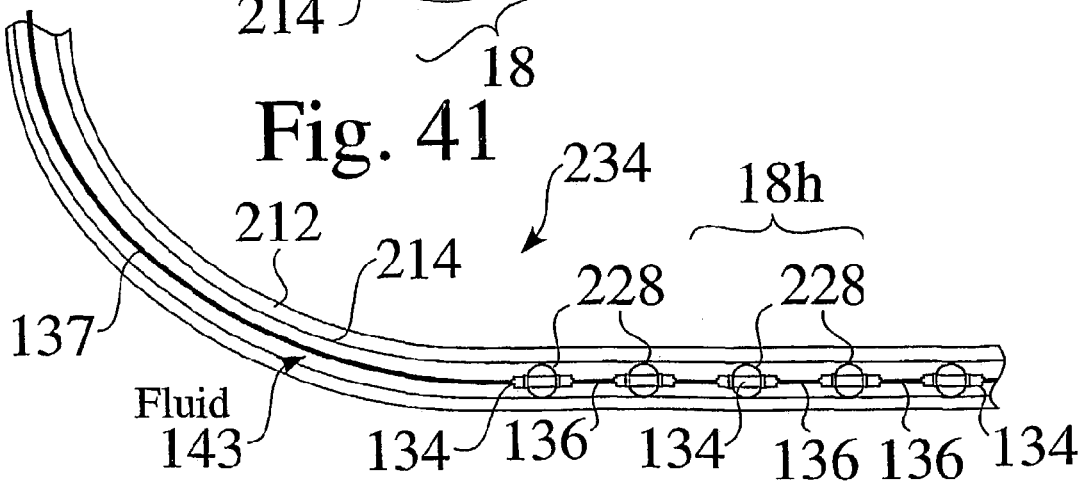
FIG. 41 is a partial cutaway view of a horizontal treatment well tiltmeter system, in which the tiltmeters are mechanically stabilized within a well casing.

FIG. 38 is a partial cutaway view 226 of a treatment well tiltmeter system 132*b*, in which the tiltmeters 134*a*–134*n* are mechanically stabilized within the well casing 214. FIG. 39 is a detailed cutaway view 230 of a tiltmeter 134 which is mechanically stabilized, i.e. centralized, within the well casing 214, with one or more bowspring stabilizers 228. FIG. 40 is an end view 232 of a tiltmeter 134 which is mechanically stabilized within the well casing 214. FIG. 41 is a partial cutaway view 234 of a treatment well tiltmeter system 132*b* for a generally horizontal well 18*h*, in which the tiltmeters are mechanically centralized within the well casing. In the treatment well tiltmeter system 132*b*, each tiltmeter 134 and/or secondary device 218 is attached within the casing 214, with one or more bowspring stabilizers 228. In the centralized treatment well tiltmeter system 132*b*, fluid 143 is diverted around the periphery of the tiltmeters 134*a*–134*n*. The centralized treatment well tiltmeter system 132*b* is readily used in embodiments having relatively large wellbore sizes and/or relatively low injection rates of fluid 143.

The mechanically stabilized treatment well tiltmeter system 132*b* is often used as a retrievable tiltmeter system 132, wherein an array 135 of treatment well tiltmeters 134*a*–134*n*, interconnected with wirelines 136, is attached through the top-most tiltmeter 134, e.g. 134*a*, to a large spool of wireline 137, provided by wireline truck 36. The array 135 is then controllably lowered into the treatment well 18. As the array 135 is lowered, the bow springs 228 contact the pipe casing 214, and the weight of the array 135 and main wireline 137 provides the force necessary to lower the system into place. Once the system is properly installed within the wellbore 18, which includes signal handshaking with the surface computer 210 and rezeroing tilt sensors 150, as necessary, the treatment well 18 is pumped to produce or expand a fracture 22. The tiltmeter data 213 from the tiltmeters 134*a*–134*n* is processed (which preferably includes isolating the signal data 213 from ambient conditions, such as working fluid noise), and the tilt map data is acquired. When the mapping is completed, the array 135 is usually removed from the treatment wellbore 18, by rewinding the main wireline. The treatment well tiltmeter system 12 is then ready to be reused.

Figure 43:
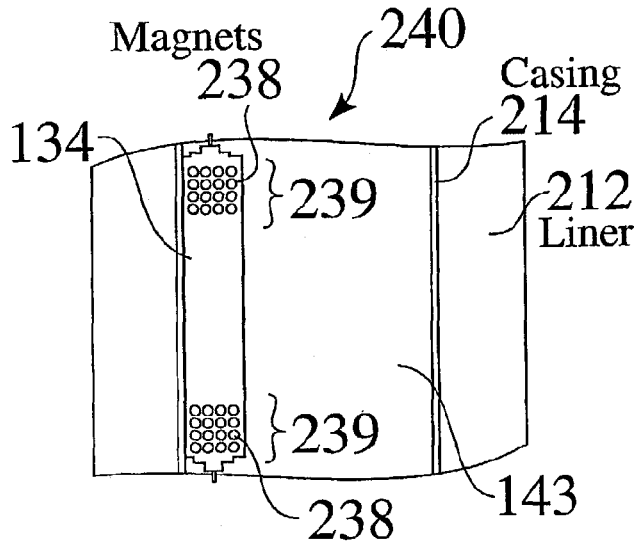
FIG. 43 is a detailed cutaway view of a tiltmeter which is magnetically attached to a well casing.
Figure 42:
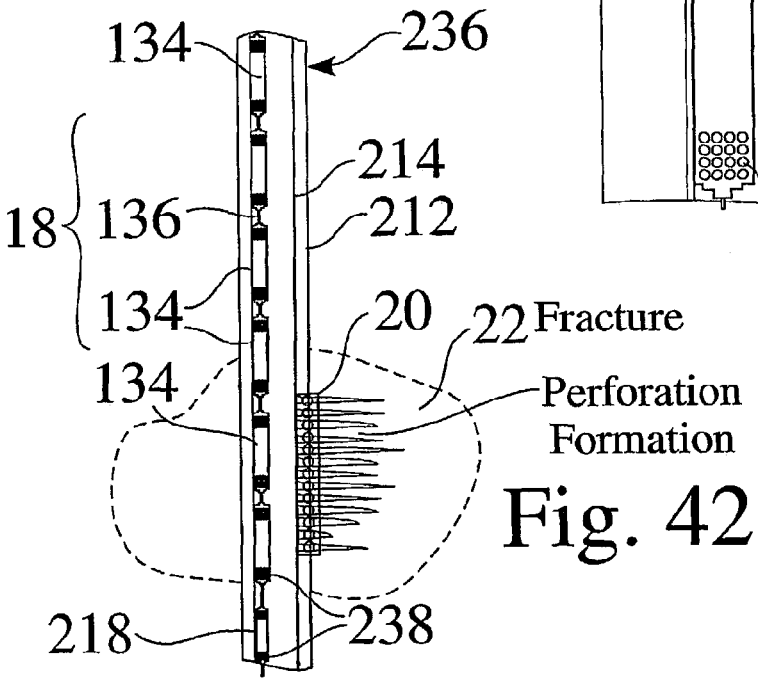
FIG. 42 is a partial cutaway view of a treatment well tiltmeter system, in which the tiltmeters are magnetically attached to a well casing.
Figure 44:
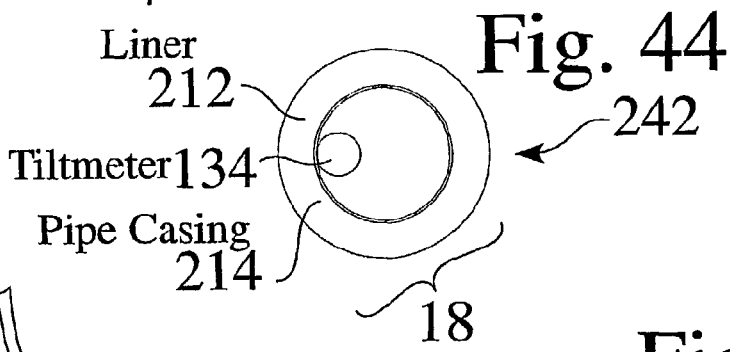
FIG. 44 is an end view of a tiltmeter which is magnetically attached within the well casing.
Figure 45:
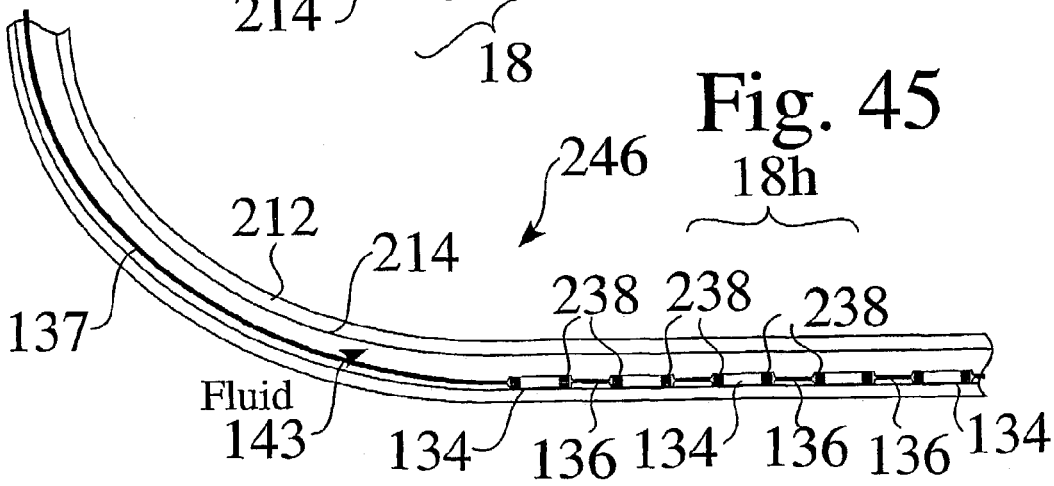
FIG. 45 is a partial cutaway view of a horizontal treatment well tiltmeter system, in which the tiltmeters are magnetically attached to the well casing.

FIG. 42 is a partial cutaway view 236 of a treatment well tiltmeter system 132*c*, in which the tiltmeters 134*a*–134*n* are magnetically attached 238 to the inner wall of the well casing 214. FIG. 43 is a detailed cutaway view 240 of a tiltmeter 134, which is magnetically attached 238 to the well casing 214. FIG. 44 is an end view 242 of a tiltmeter 134, which is magnetically attached within the well casing 214. FIG. 45 is a partial cutaway view 246 of a treatment well tiltmeter system 132*c* for a generally horizontal well 18*h*, in which the tiltmeters are magnetically attached 238 to the well casing. In the treatment well tiltmeter system 132*c*, each tiltmeter 134 and/or secondary device 218 is attached within the casing 214, with one or more magnets 238. In the magnetically attached treatment well tiltmeter system 132*c*, magnets 238 provide a decentralized attachment within the borehole 18, which allows a high injection rate of fluids 143 which are often used in hydraulic fracturing, and reduces flow-induced noise on the collected tilt data. The tiltmeter assembly shown in FIG. 43 has permanent magnet assemblies 239 located at both the top and bottom of the tiltmeter housing 152, wherein each permanent magnet assembly 239 comprises one or more magnets 238.

Figure 46:
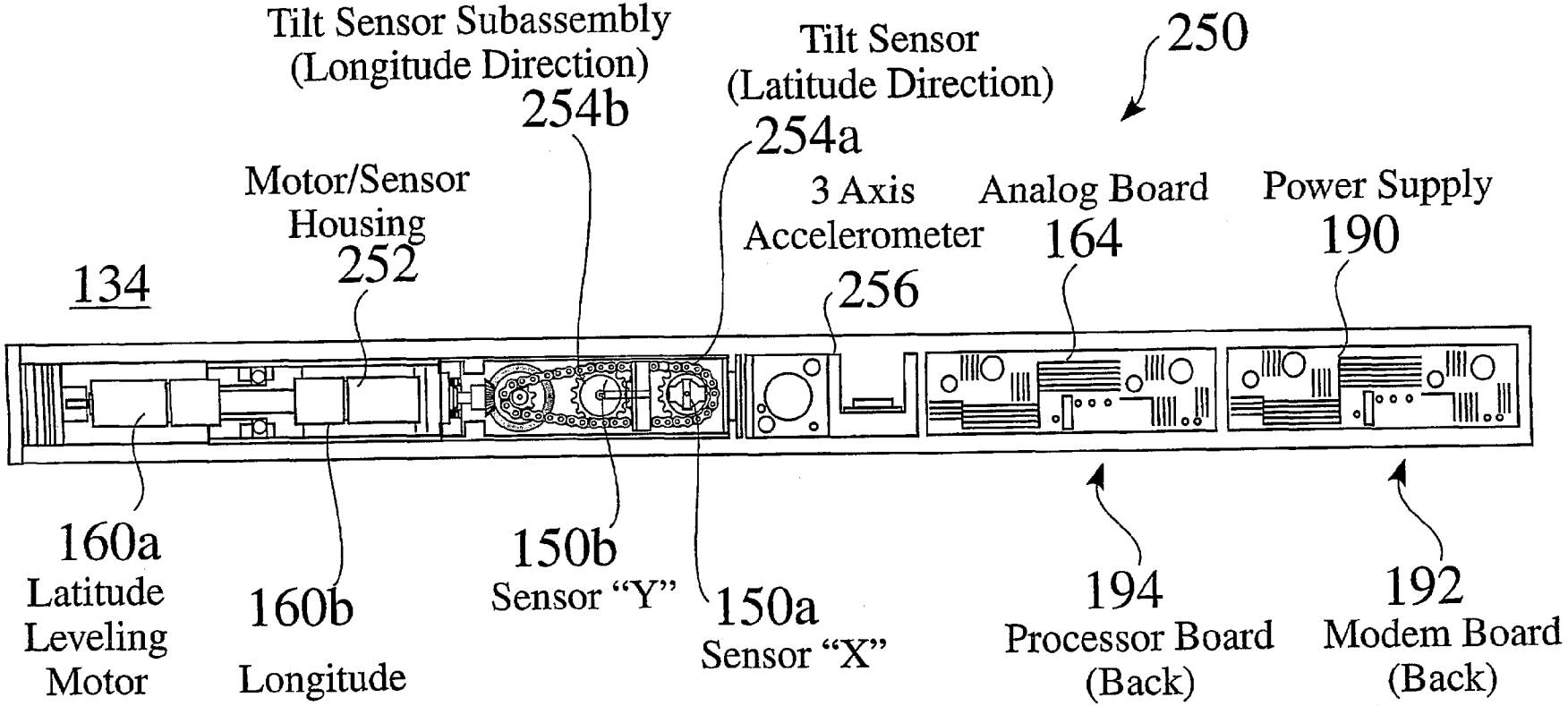
FIG. 46 is a partial cutaway view of a self-leveling tiltmeter assembly.

Tiltmeter Assembly Details. FIG. 46 is a partial cutaway view 250 of a self-leveling tiltmeter housing assembly 134, which comprises an X direction tilt sensor 150*a* within a latitude directional sensor assembly 254*a*, and a Y direction tilt sensor 150*b* within a longitude directional sensor assembly 254*b*. The level adjustment of the X direction tilt sensor 150*a* is controlled by a latitude leveling motor 160*a*. The level adjustment of the Y direction tilt sensor 150*b* is controlled by a longitude leveling motor 160*b*.

The self-leveling tiltmeter housing assembly 134 shown in FIG. 46 also comprises a three-axis accelerometer assembly 256, which provides orientation data for the tiltmeter assembly within a wellbore 18. As well, the accelerometer assembly 256 can provide supplementary tilt data for the tiltmeter housing assembly 134.

As seen in FIG. 33 and FIG. 46 the treatment well tiltmeter assembly comprises four electronics modules, comprising the power supply board 190, the modem board 192, the processor board 194, and the analog conditioning board 164. The electronics modules are typically rated to 300 F, or run at reduced power and tested to 300 F. In a preferred embodiment of the treatment well tiltmeter assembly 134, the electrical boards 190,192,194,164 are laid back to back, to reduce the overall tool length.

Figure 47:
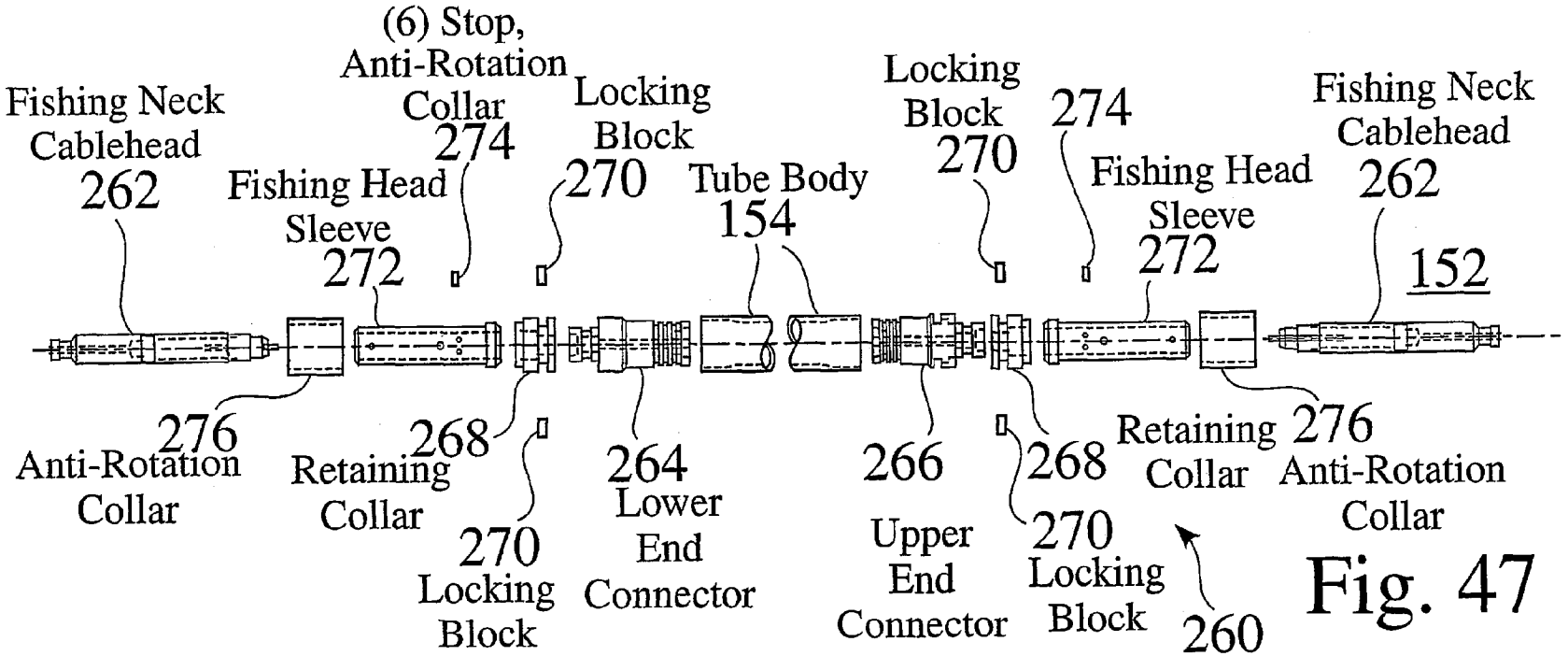
FIG. 47 is a simplified expanded view of a self-leveling tiltmeter housing assembly.
Figure 48:
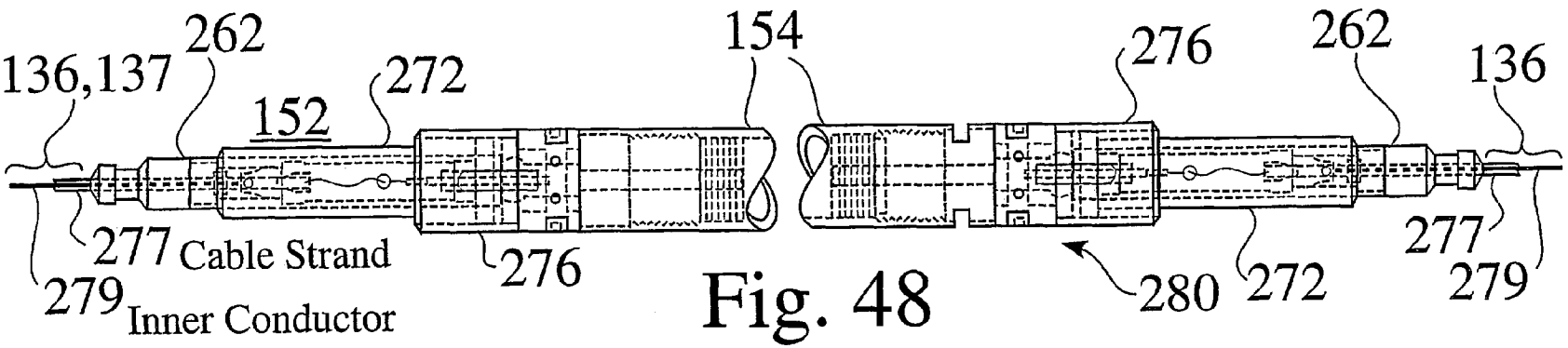
FIG. 48 is a simplified assembly view of a self-leveling treatment well tiltmeter housing having cablehead wireline attachments.

FIG. 47 is a simplified expanded view 260 of a self-leveling tiltmeter housing assembly 152. FIG. 48 is a simplified assembly view 280 of a self-leveling tiltmeter housing assembly 152. A tube body 154 is connected to both an upper end connector 266 and a lower end connector 264, which are each respectively connected to housing end assemblies, comprising a retaining collar 268, a fishing head sleeve 272, an anti-rotation collar 276, and a fishing head cablehead 262. Locking blocks 270 are attached to the retaining collars 268, and collar stops 274 are used to position the anti-rotation collars 276.

Figure 49:
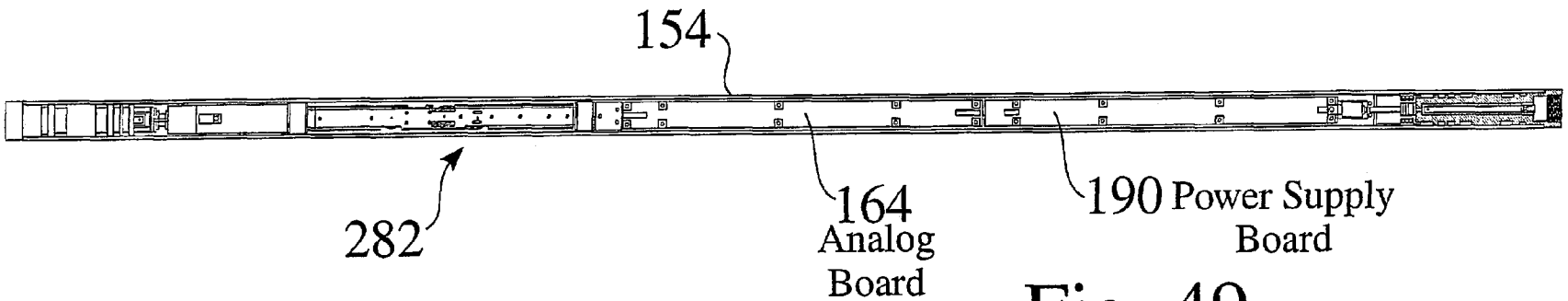
FIG. 49 is a partial cutaway assembly view of a treatment well tiltmeter tool.
Figure 50:
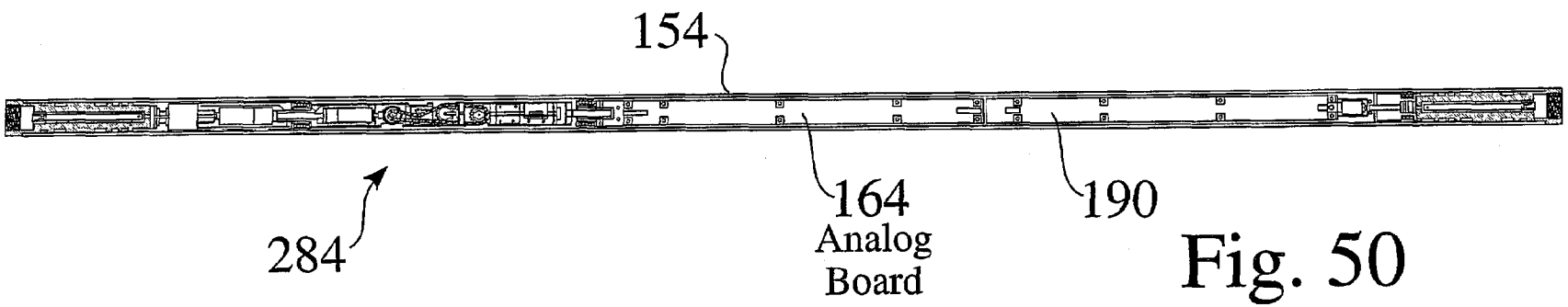
FIG. 50 is a detailed partial cutaway assembly view of a treatment well tiltmeter tool.

FIG. 49 is a partial cutaway assembly view 282 of a self-leveling treatment well tiltmeter assembly 134. FIG. 50 is a detailed partial cutaway assembly view 284 of a self-leveling treatment well tiltmeter assembly 134. The self-leveling treatment well tiltmeter assembly 134 shown in FIG. 49 and FIG. 50 preferably has a relatively small diameter, e.g. such as a 1.563 inch outer diameter, whereby the tiltmeters 134*a*–134*n* are readily mounted within the treatment well bore 18, while minimizing the effect on the flow of working fluid. The modular electronics within the treatment well tiltmeter assembly 134 shown in FIG. 49 and FIG. 50 are functional to 150° C. (300° F.). Each treatment well tiltmeter assembly 134 preferably comprises a daisy-chain architecture for power 211, for control input signals 211, and for data output signals 213. Therefore, each treatment well tiltmeter assembly 134 can be placed anywhere within a tiltmeter array 132, i.e. the tiltmeter assemblies 134 are interchangeable. As well, each treatment well tiltmeter assembly 134 preferably includes self-diagnostic software and associated fault-tolerant hardware, whereby problems are quickly isolated.

The external housing 154 for the treatment well tiltmeter assembly 134 is preferably comprised of a corrosion-resistant material, such as stainless steel or INCONEL™. In one embodiment, the external housing 154 is gun drilled and centerless ground. In other production embodiments, the external housings are cast to size and ground. Both ends of the treatment well tiltmeter assembly 134 are sealed with an endcap 320 (FIG. 55, FIG. 56, FIG. 57), which are comprised of titanium in on embodiment of the tiltmeter assembly 134. The external housing 154 shown in FIG. 49 and FIG. 50 has no external threads, to increase strength, and to minimize assembly problems. The treatment well tiltmeter assembly 134 incorporates a sealed design, which keeps the internal componentry dry, even if the cablehead 262 (FIG. 47, FIG. 48) leaks.

Raw tilt data 213 in an active well 18 often has background "noise" which is induced from the flow of fluid 143 within the same active well bore 18. Such noise is minimized my minimizing the cross-sectional diameter of the external housing 154, whereby the flow drag for the working fluid 143 is minimized. Typical inner diameters for wellbores 18 that are used for hydraulic fracture stimulation and oil & gas production are anywhere from 2.5" to 6" in diameter, with 4" to 5" currently being the most common I.D. size. In a preferred embodiment of the treatment well tiltmeter 134, the outer diameter of the tiltmeter is 1⁹⁄₁₆". In another embodiment, the outer diameter of the tiltmeter is 2⅞" diameter.

Figure 51:
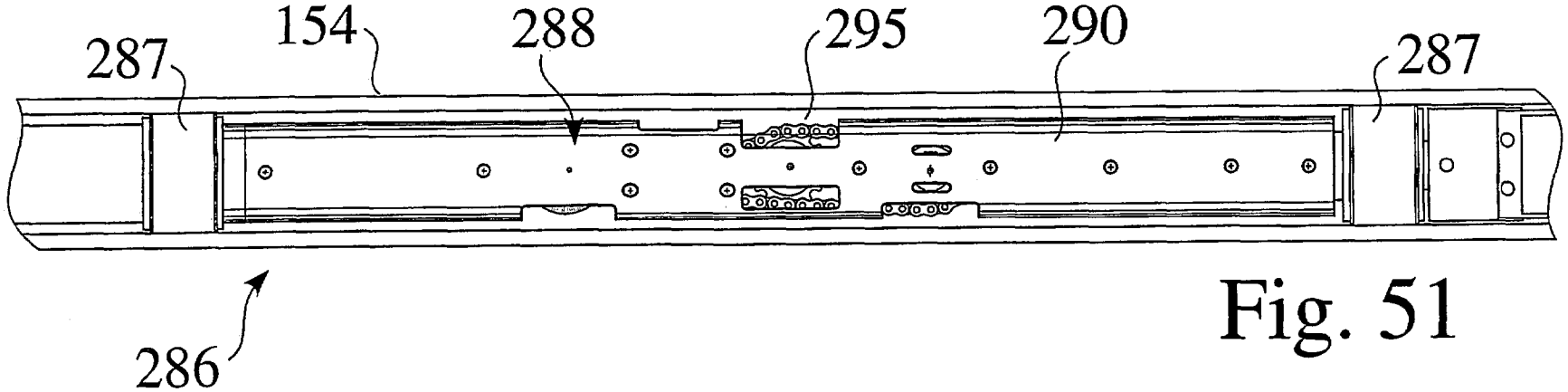
FIG. 51 is a partial cutaway assembly view of a re-zero mechanism within a treatment well tiltmeter tool.

Re-Zero Mechanism Assembly Details. FIG. 51 is a partial cutaway assembly view 286 of a re-zero mechanism 288 within a self-leveling treatment well tiltmeter assembly 134. The re-zero mechanism 288 comprises one or more internal motors and associated pivot mechanisms, which allow the internal tilt sensors 150 to rotate, so that they are on-scale and are able to measure minute tilts in any possible borehole orientation. The treatment well tiltmeters 134*a*–134*n* can therefore be used in vertical wells, deviated wells, or even in horizontal wells. The re-zero mechanism 288 can alternately be used in other tiltmeter assemblies, such as for offset or surface tiltmeters, or in a wide variety of other instrumentation and data acquisition systems.

Figure 52:
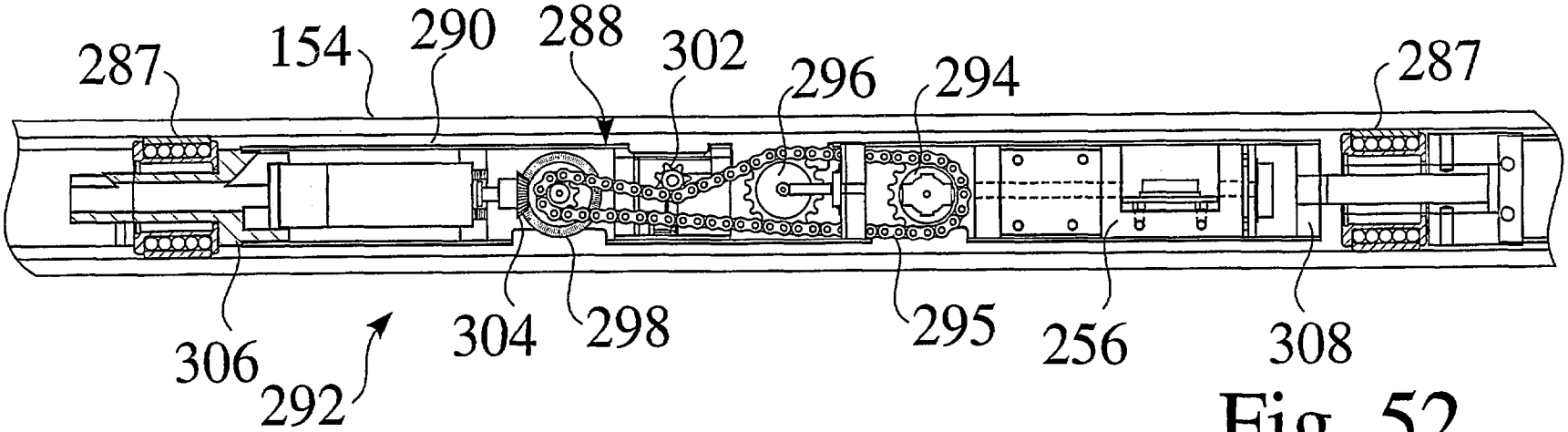
FIG. 52 is a detailed partial cutaway assembly view of a re-zero mechanism within a treatment well tiltmeter tool.
Figure 53:
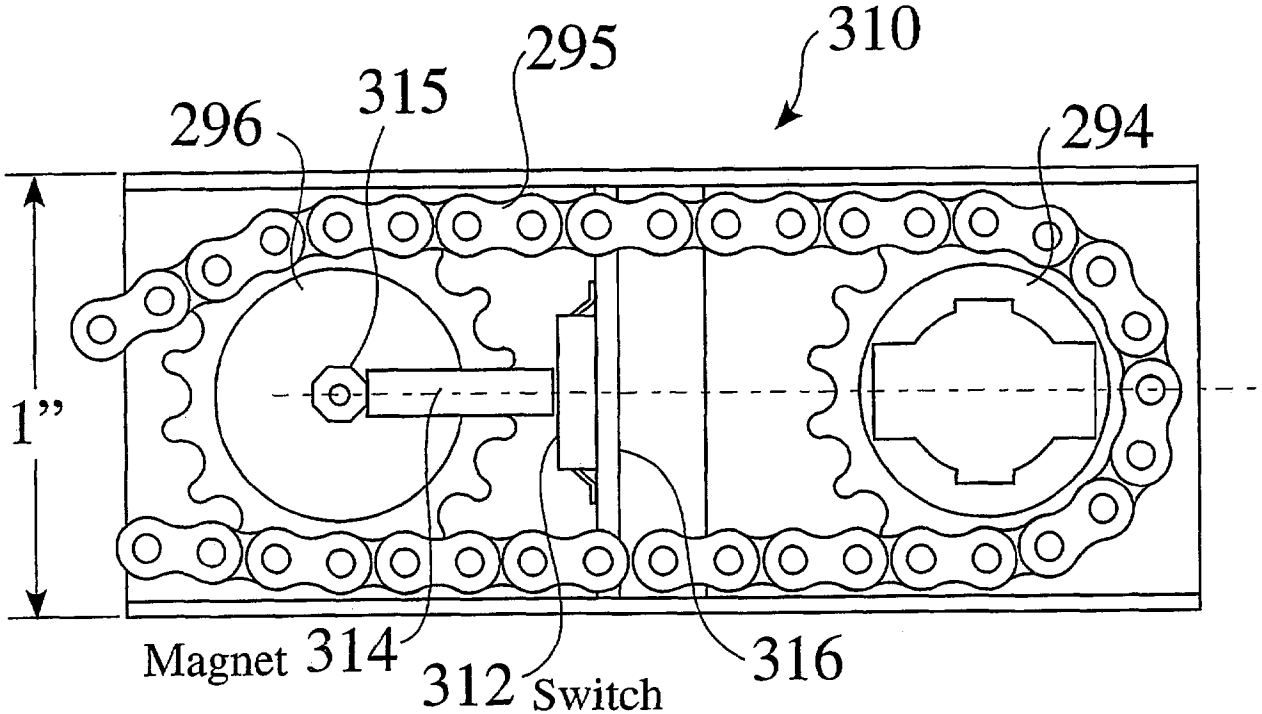
FIG. 53 is a detailed partial cutaway assembly view of a reed switch within a treatment well tiltmeter tool.
Figure 54:
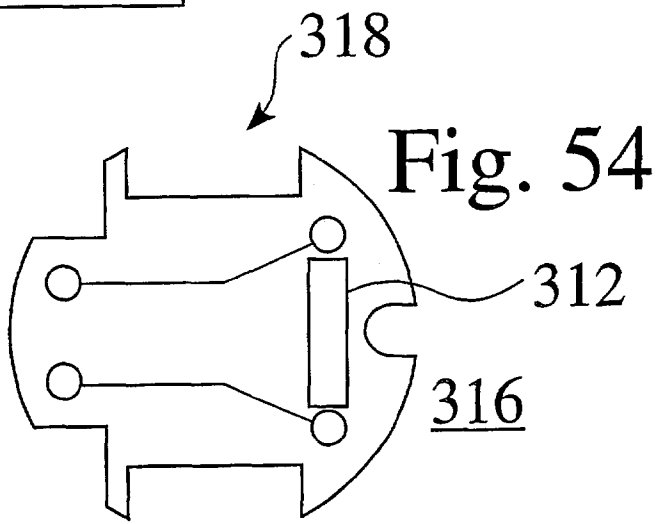
FIG. 54 is a top view of a tiltmeter reed switch assembly.

The re-zero mechanism 288 is mounted to a bottom bearing shaft 306 and a top bearing shaft 308, between bearings 287. FIG. 52 is a detailed partial cutaway assembly view 292 of a re-zero mechanism 288 within a self-leveling treatment well tiltmeter assembly 134. The re-zero mechanism 288 comprises a rezero-mechanism body 290, with which tiltmeter subassemblies 254*a*,254*b* are housed. The X sensor 150*a* is mounted in relation to an X channel gear 296, and the Y sensor 150*b* is mounted in relation to an y channel gear 294. The rezero-mechanism assembly also comprises a drive mechanism, having a drive chain 295, which is engageable contact, with drive cog 300. The drive cog 300 is affixed to drive ring gear 290, which is driven by motor pinion gear 304. An idler cog 302 is preferably used to adjust the tension in the drive chain 295. The re-zero mechanism allows a treatment well tiltmeter assembly to be functional at any angle and/or orientation FIG. 53 is a detailed partial cutaway assembly view 310 of a reed switch 312 within a rezero-mechanism assembly 288. As seen in FIG. 53, a cam means 315 is axially fixed to the X channel gear 296. A magnet 315 is moved by the cam means 315, when the X channel gear 296 is moved. When the magnet 314 moves a specified distance in relation to the reed switch 312, the reed switch 312 is activated, such that leveling motion of the X channel sensor 150*a* may be controllably limited. The leveling motion of the Y channel sensor 150*a* is similarly limited. FIG. 54 is a top view 318 of a tiltmeter reed switch 312 and reed switch board 316.

FIG. 55 is a side view of a tiltmeter bottom end cap 320. FIG. 56 is a first end view 321 of a tiltmeter bottom end cap 320. FIG. 57 is a partial cross-sectional side view 322 of a tiltmeter bottom end cap 320. A cable connector shaft 324 is located within the tiltmeter bottom end cap 320. The cable connector shaft 324 is electrically connected to wirelines 136,137, such as between tiltmeter assemblies 134, or between the topmost tiltmeter 134*a* and the surface wireline truck 36 (FIGS. 1, 29). The cable connector shaft 324 is supported by shaft seals 326,328. The shaft seals also provide power and signal insulation between the cable connector shaft 324 and the tiltmeter bottom end cap 320.

Figure 58:
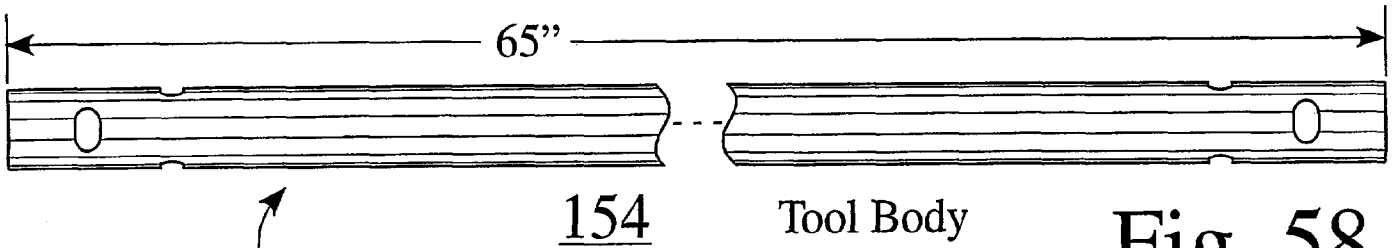
FIG. 58 is a side view of a tiltmeter tool body.
Figure 59:
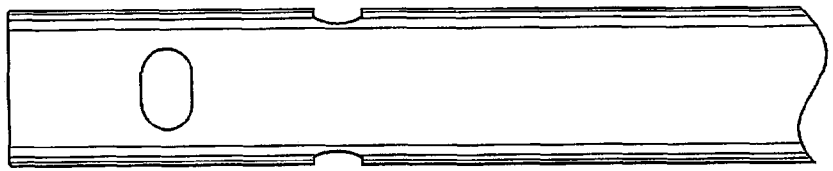
FIG. 59 is a detailed side view of the end of a tiltmeter tool body.
Figure 60:
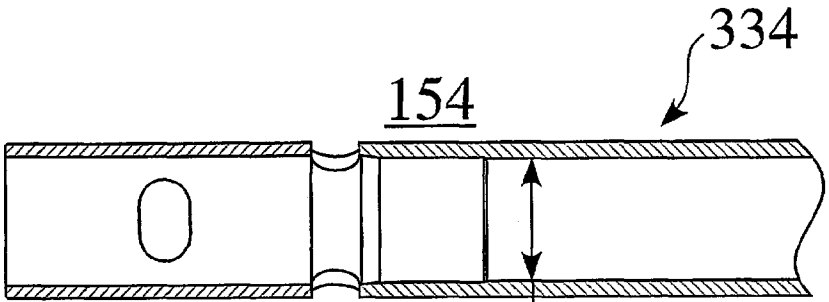
FIG. 60 is a partial cross-sectional detailed side view of the end of a tiltmeter tool body.

FIG. 58 is a side view 330 of a tiltmeter tool body 154. FIG. 59 is a detailed side view 332 of the end of a tiltmeter tool body 154. FIG. 60 is a partial cross-sectional detailed side view 334 of the end of a tiltmeter tool body 154.

Figure 61:
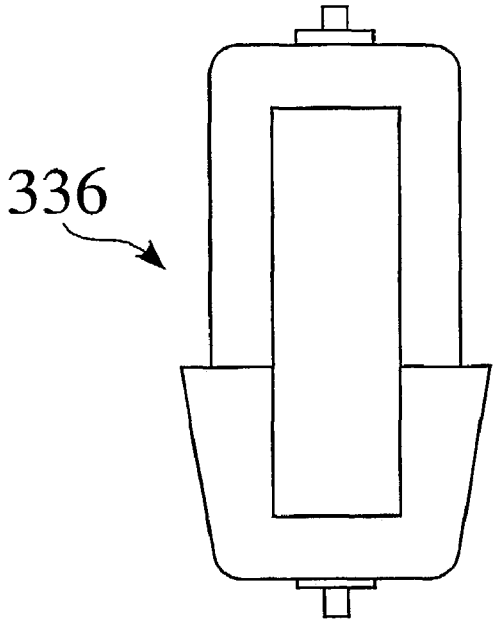
FIG. 61 is a front view of a tiltmeter Y-channel sensor holder.
Figure 62:
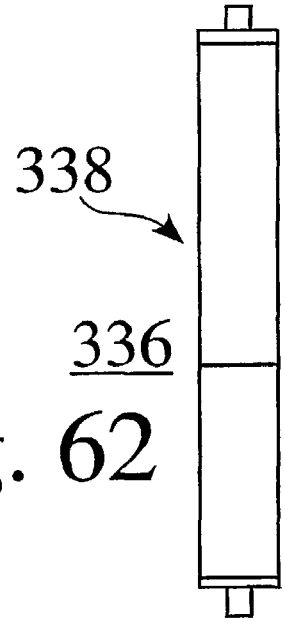
FIG. 62 is a side view of a tiltmeter Y-channel sensor holder.
Figure 63:
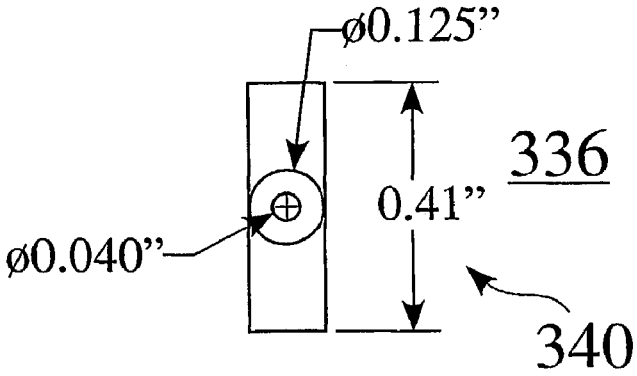
FIG. 63 is an end view of a tiltmeter Y-channel sensor holder.
Figure 64:
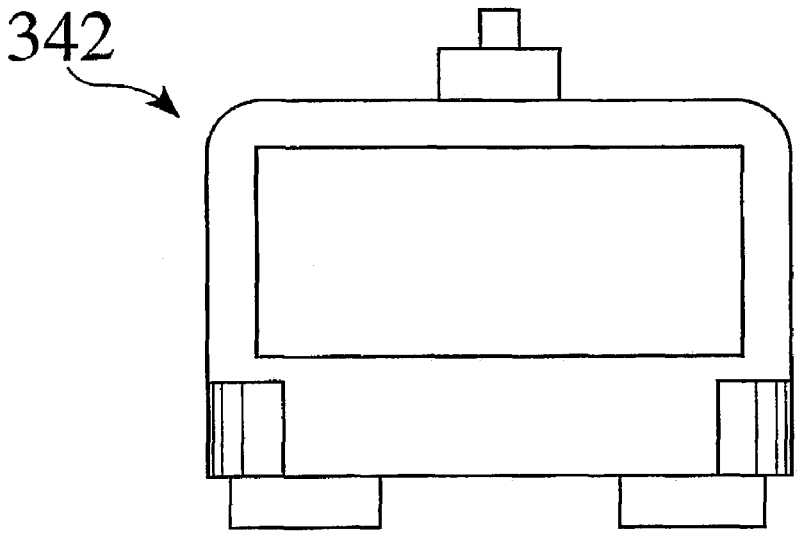
FIG. 64 is a front view of a tiltmeter X-channel sensor holder.
Figure 65:
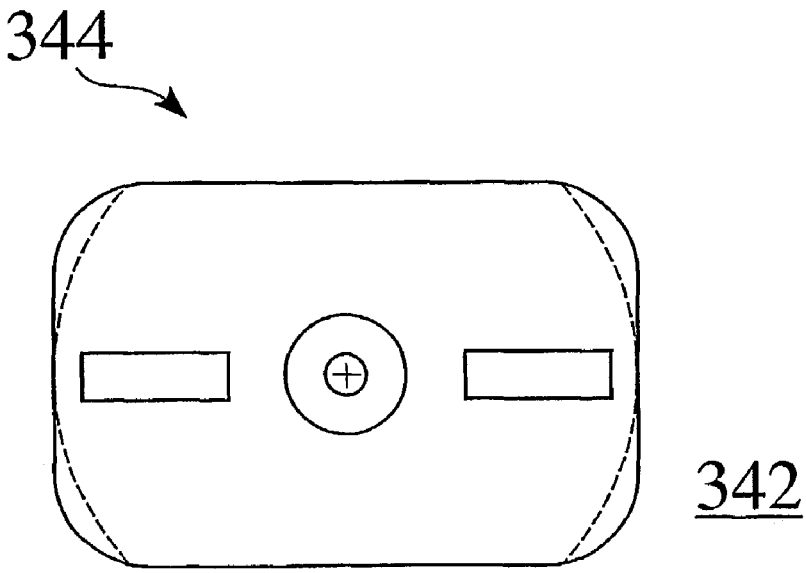
FIG. 65 is a side view of a tiltmeter X-channel sensor holder.
Figure 66:
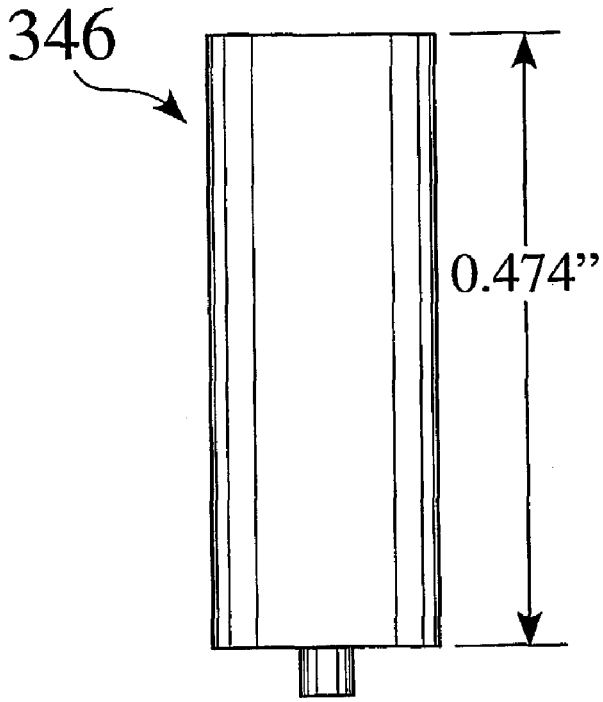
FIG. 66 is a side view of a tiltmeter X-channel shaft.
Figure 67:
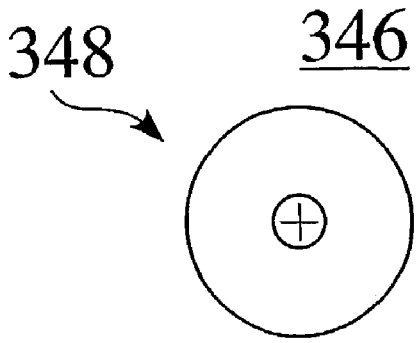
FIG. 67 is an end view of a tiltmeter X-channel shaft.
Figure 68:
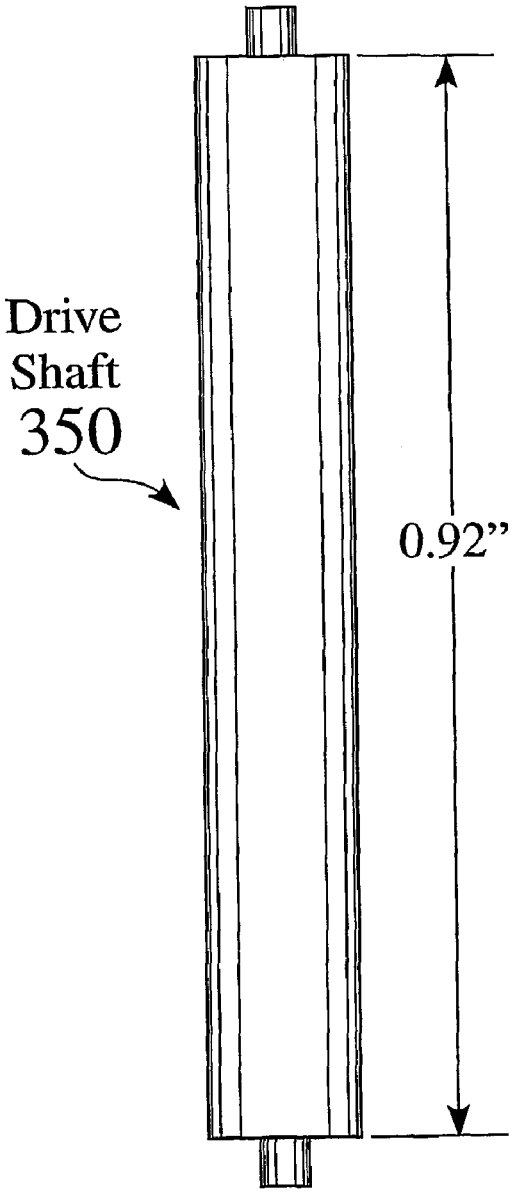
FIG. 68 is a side view of a tiltmeter drive shaft.
Figure 69:
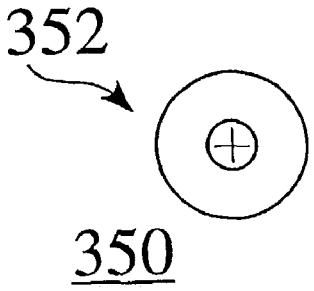
FIG. 69 is an end view of a tiltmeter drive shaft.
Figure 71:
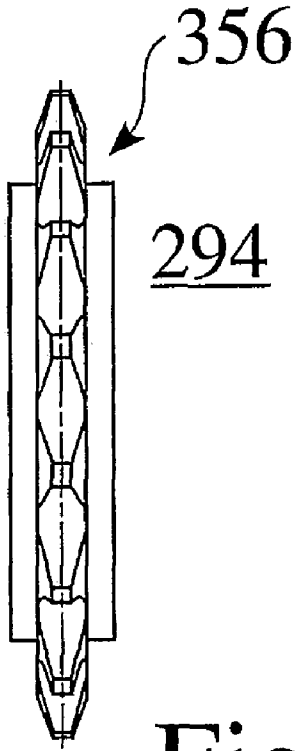
FIG. 71 is a side view of a tiltmeter Y-channel gear.
Figure 70:
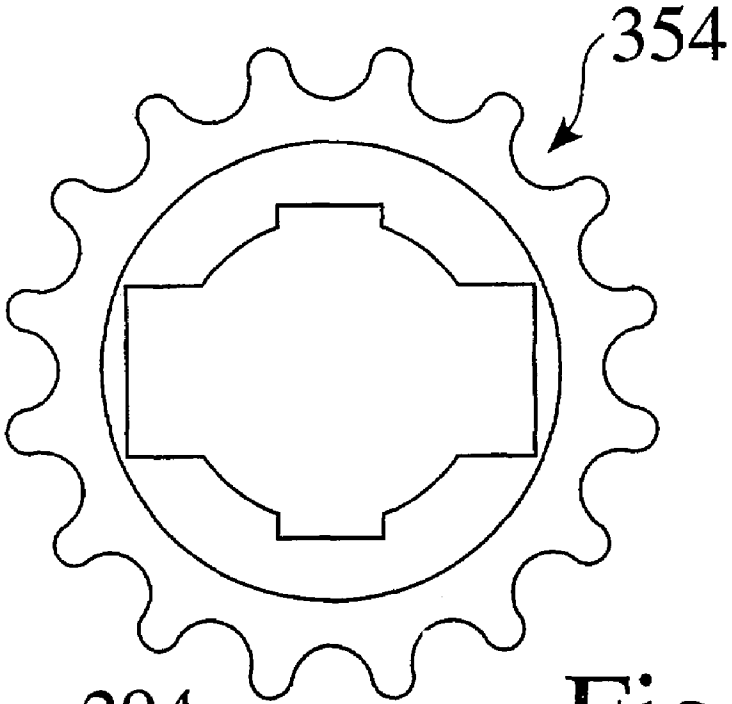
FIG. 70 is a front view of a tiltmeter Y-channel gear.
Figure 73:
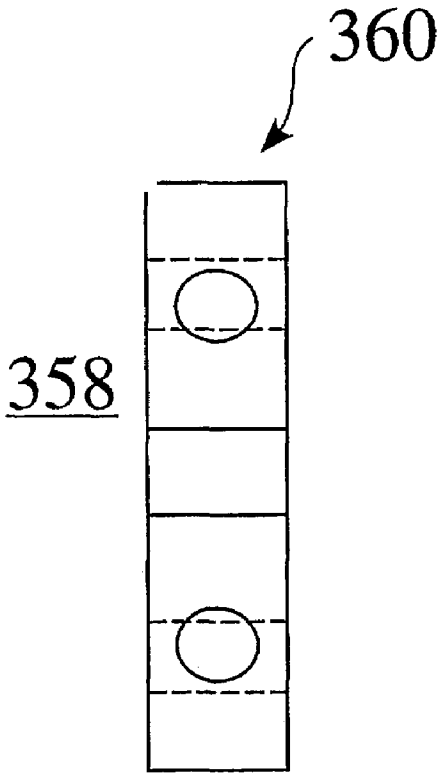
FIG. 73 is a side view of a tiltmeter reed switch holder.
Figure 72:
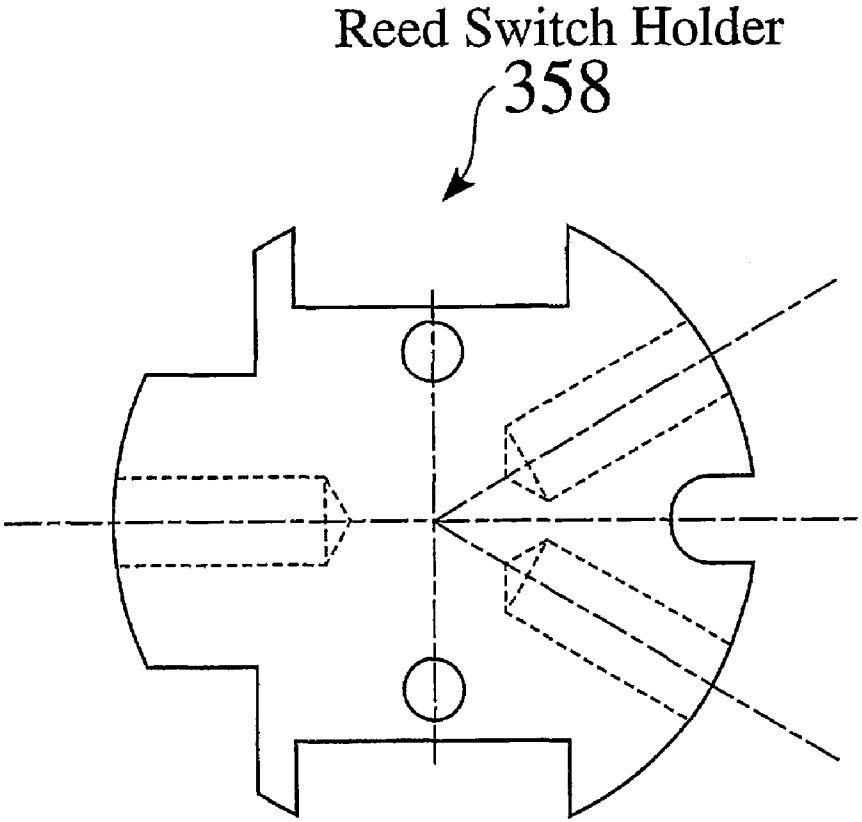
FIG. 72 is a front view of a tiltmeter reed switch holder.

FIG. 61 is a front view of a tiltmeter Y-channel sensor holder 336. FIG. 62 is a side view 338 of a tiltmeter Y-channel sensor holder 336. FIG. 63 is an end view 340 of a tiltmeter Y-channel sensor holder 336. FIG. 64 is a front view of a tiltmeter X-channel sensor holder 342. FIG. 65 is a side view 344 of a tiltmeter X-channel sensor holder 342. FIG. 66 is a front view of a tiltmeter X-channel shaft 346. FIG. 67 is a side view 348 of a tiltmeter X-channel shaft 346. FIG. 68 is a front view of a tiltmeter drive shaft 350. FIG. 69 is a side view 352 of a tiltmeter drive shaft 350. FIG. 70 is a front view 354 of a tiltmeter Y-channel gear 294. FIG. 71 is a side view 356 of a tiltmeter Y-channel gear 294. FIG. 72 is a front view of a tiltmeter reed switch holder 358. FIG. 73 is a side view 360 of a tiltmeter reed switch holder 358.

Figures 74, 75, 76, 77, 78, 79, 80, 81, 82:
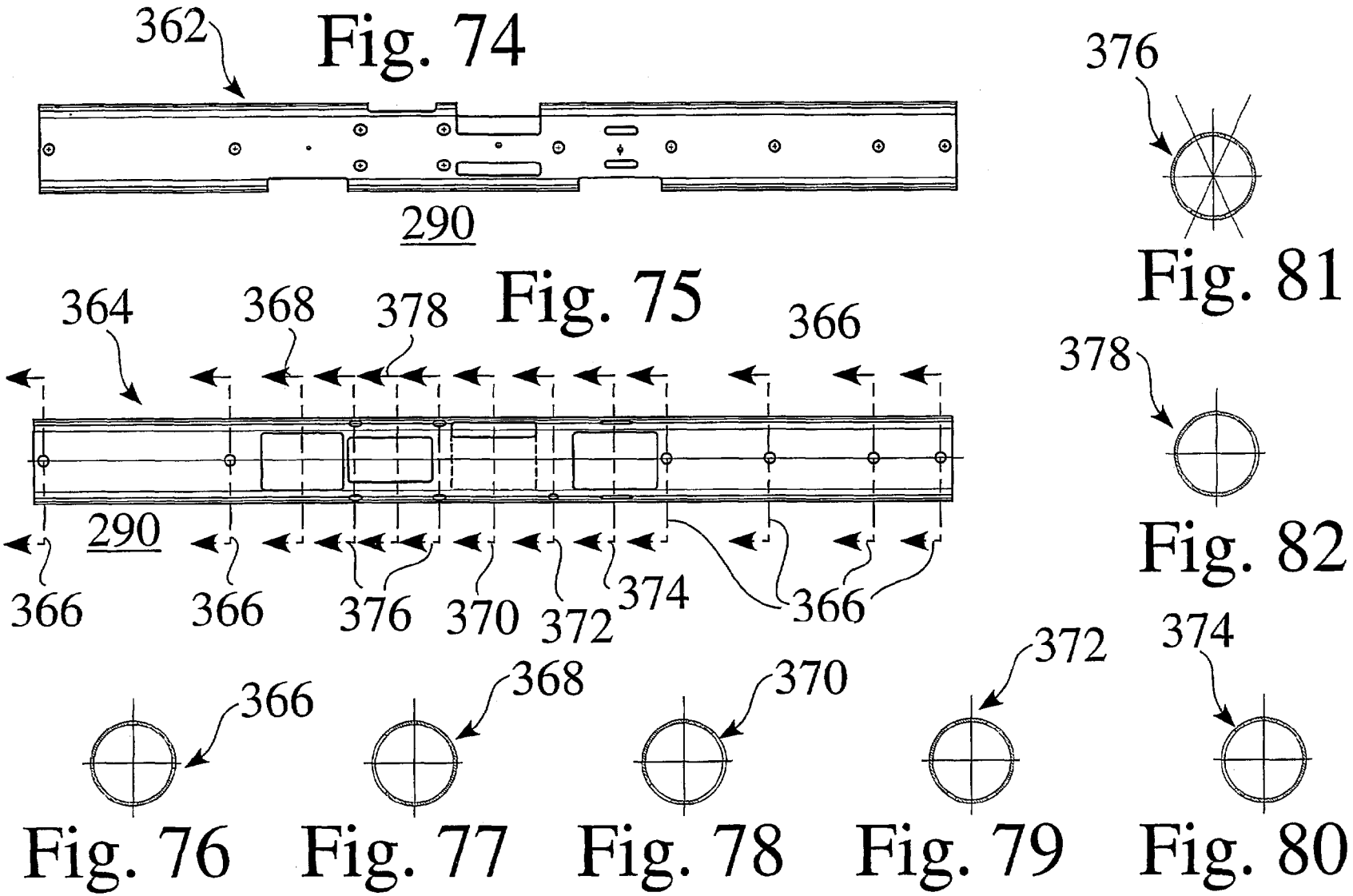
FIG. 74 is a side view of a tiltmeter re-zero mechanism body.
FIG. 75 is a bottom view of a tiltmeter re-zero mechanism body.
FIG. 76 is a first cross-sectional view of a tiltmeter re-zero mechanism body.
FIG. 77 is a second cross-sectional view of a tiltmeter re-zero mechanism body.
FIG. 78 is a third cross-sectional view of a tiltmeter re-zero mechanism body.
FIG. 79 is a fourth cross-sectional view of a tiltmeter re-zero mechanism body.
FIG. 80 is a fifth cross-sectional view of a tiltmeter re-zero mechanism body.
FIG. 81 is a sixth cross-sectional view of a tiltmeter re-zero mechanism body.
FIG. 82 is a seventh cross-sectional view of a tiltmeter re-zero mechanism body.

FIG. 74 is a side view 362 of a tiltmeter re-zero mechanism body 290. FIG. 75 is a bottom view 364 of a tiltmeter re-zero mechanism body 290. FIG. 76 is a first cross-sectional view 366 of a tiltmeter re-zero mechanism body 290. FIG. 77 is a second cross-sectional view 368 of a tiltmeter re-zero mechanism body 290. FIG. 78 is a third cross-sectional view 370 of a tiltmeter re-zero mechanism body 290. FIG. 79 is a fourth cross-sectional view 372 of a tiltmeter re-zero mechanism body 290. FIG. 80 is a fifth cross-sectional view 374 of a tiltmeter re-zero mechanism body 290. FIG. 81 is a sixth cross-sectional view 376 of a tiltmeter re-zero mechanism body 290. FIG. 82 is a seventh cross-sectional view 378 of a tiltmeter re-zero mechanism body 290.

Figure 85:
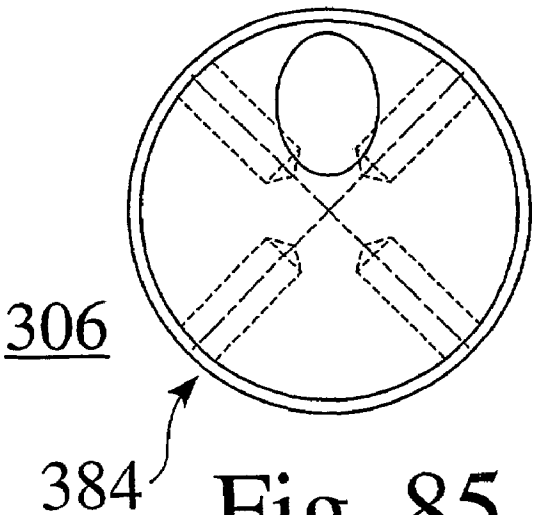
FIG. 85 is an end view of a tiltmeter re-zero mechanism top bearing shaft.
Figure 83:
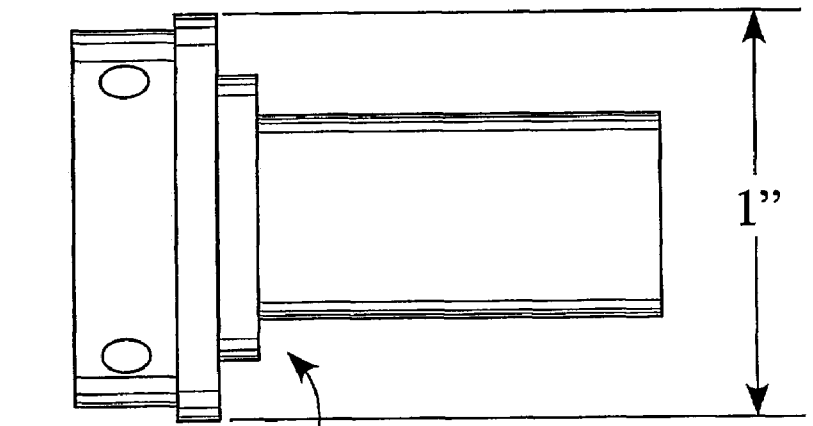
FIG. 83 is a side view of a tiltmeter re-zero mechanism top bearing shaft.
Figure 84:
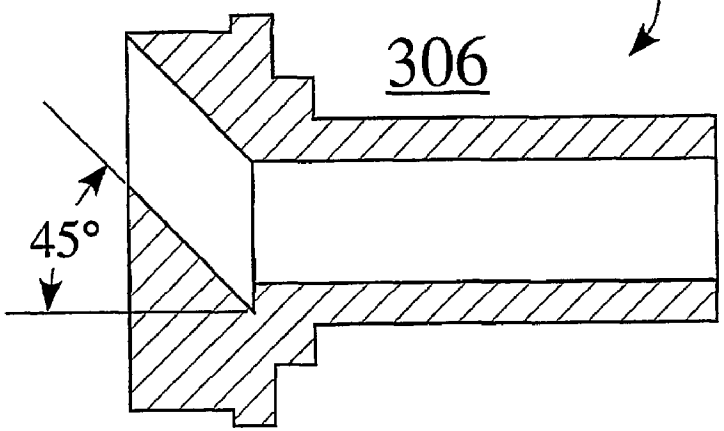
FIG. 84 is a side cross-sectional view of a tiltmeter re-zero mechanism top bearing shaft.

FIG. 83 is a side view 380 of a tiltmeter re-zero mechanism top bearing shaft 306. FIG. 85 is an end view 306 of a tiltmeter re-zero mechanism top bearing shaft 306. FIG. 84 is a side cross-sectional view 382 of a tiltmeter re-zero mechanism top bearing shaft 306.

Figure 86:
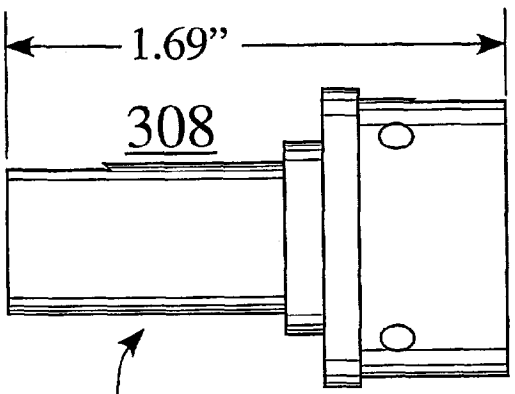
FIG. 86 is a side view of a tiltmeter re-zero mechanism bottom bearing shaft.

FIG. 86 is a side view 386 of a tiltmeter re-zero mechanism bottom bearing shaft 308.

Figure 87:
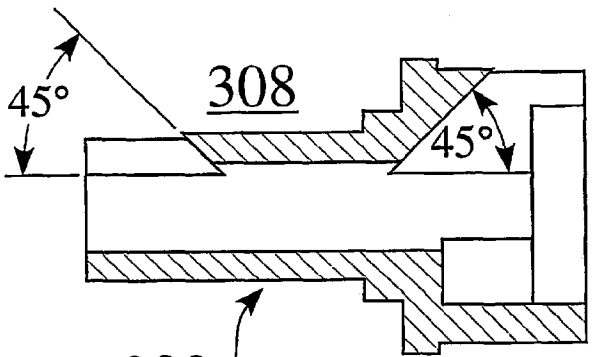
FIG. 87 is a side cross-sectional view of a tiltmeter re-zero mechanism bottom bearing shaft.
Figure 88:
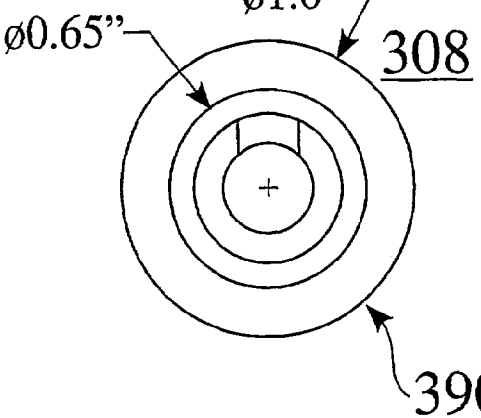
FIG. 88 is a first view of a first end of a tiltmeter re-zero mechanism bottom bearing shaft.
Figure 89:
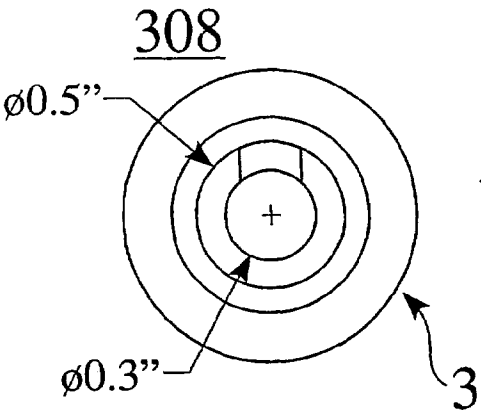
FIG. 89 is a second view of a first end of a tiltmeter re-zero mechanism bottom bearing shaft.
Figure 90:
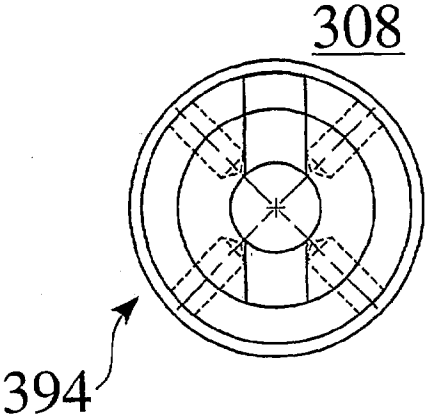
FIG. 90 is a first view of a second end of a tiltmeter re-zero mechanism bottom bearing shaft.
Figure 91:
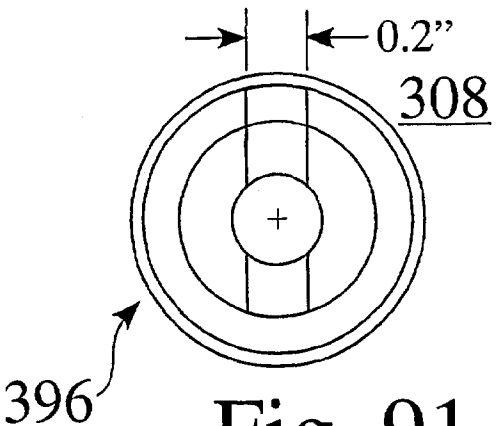
FIG. 91 is a second view of a second end of a tiltmeter re-zero mechanism bottom bearing shaft.

FIG. 87 is a side cross-sectional view 388 of a tiltmeter re-zero mechanism bottom bearing shaft 308. FIG. 88 is a first view 390 of a first end of a tiltmeter re-zero mechanism bottom bearing shaft 308. FIG. 89 is a second view 392 of a first end of a tiltmeter re-zero mechanism bottom bearing shaft 308. FIG. 90 is a first view 394 of a second end of a tiltmeter re-zero mechanism bottom bearing shaft 308. FIG. 91 is a second view 396 of a second end of a tiltmeter re-zero mechanism bottom bearing shaft 308.

Figure 92:
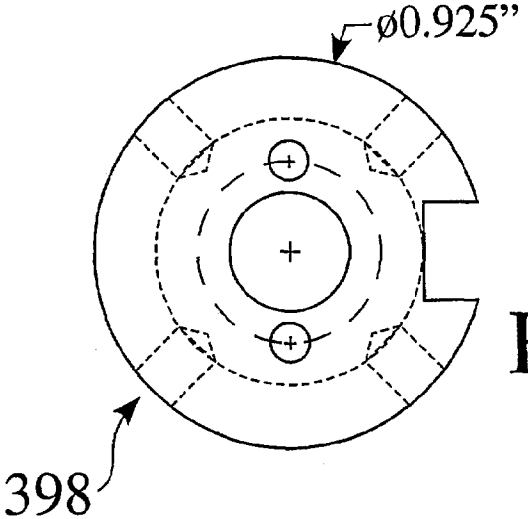
FIG. 92 is a first front view of a tiltmeter motor mounting disk.
Figure 95:
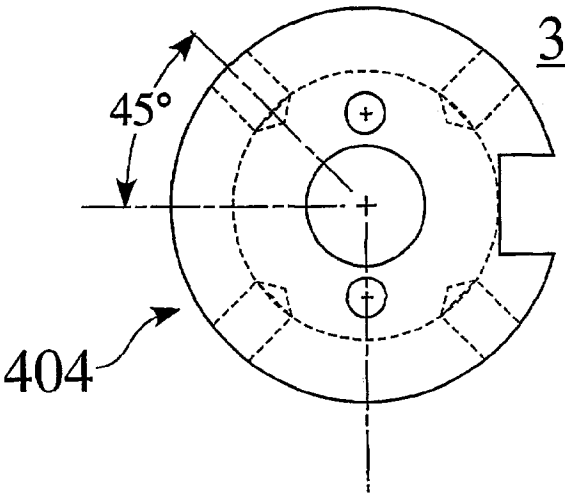
FIG. 95 is a second front view of a tiltmeter motor mounting disk.
Figure 93:
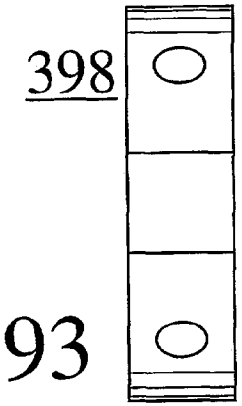
FIG. 93 is a side view of a tiltmeter motor mounting disk.
Figure 94:
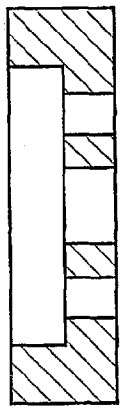
FIG. 94 is a side cross sectional view of a tiltmeter motor mounting disk.

FIG. 92 is a front view of a tiltmeter motor mounting disk 398. FIG. 93 is a side view 400 of a tiltmeter motor mounting disk 398. FIG. 94 is a side cross sectional view 402 of a tiltmeter motor mounting disk 398. FIG. 95 is an alternate front view 402 of a tiltmeter motor mounting disk 398.

Figure 100:
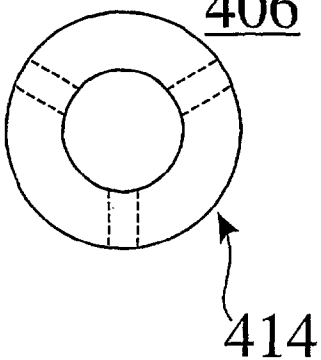
FIG. 100 shows the second end of a tiltmeter motor holder.
Figure 96:
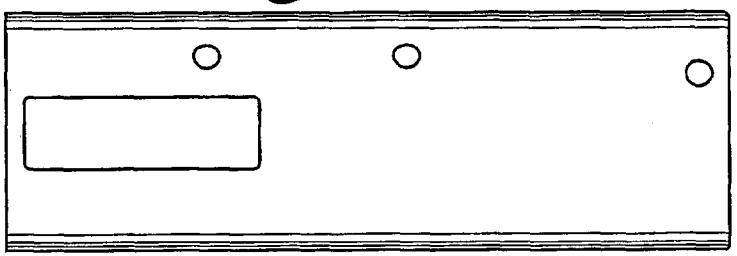
FIG. 96 is a side view of a tiltmeter motor holder.
Figure 97:
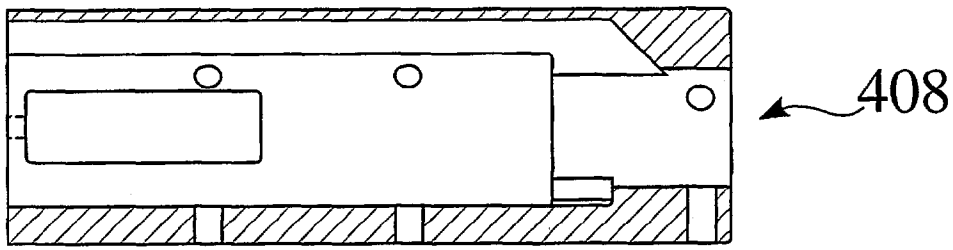
FIG. 97 is a side cross-sectional view of a tiltmeter motor holder.
Figure 98:
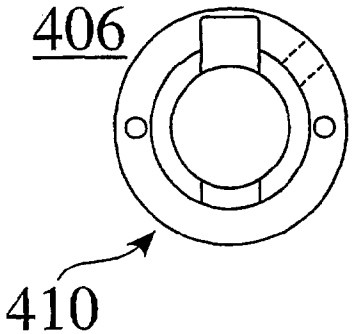
FIG. 98 is a first view of a first end of a tiltmeter motor holder.
Figure 99:
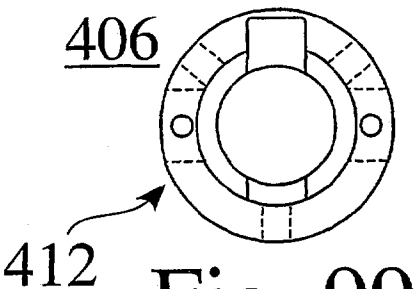
FIG. 99 is a second view of a first end of a tiltmeter motor holder.

FIG. 96 is a side view of a tiltmeter motor holder 406. FIG. 97 is a side cross-sectional view 408 of a tiltmeter motor holder 406. FIG. 98 is a first view 410 of a first end of a tiltmeter motor holder 406. FIG. 99 is a second view 412 of a first end of a tiltmeter motor holder 406. FIG. 100 shows the second end 414 of a tiltmeter motor holder 406.

Figure 101:
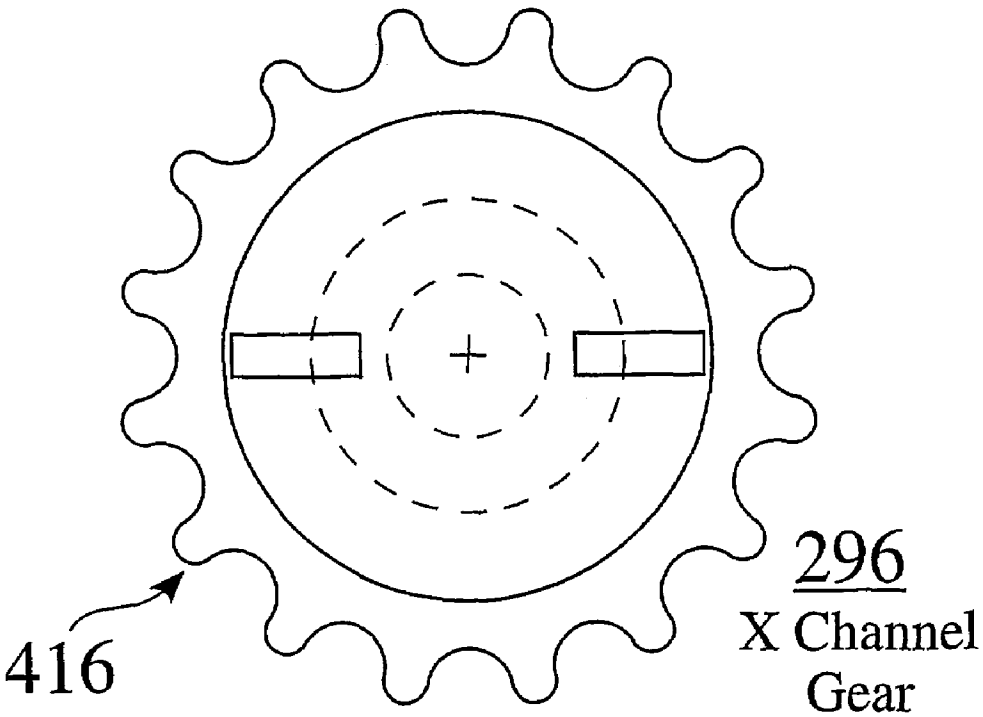
FIG. 101 is a front view of a tiltmeter X-channel gear.
Figure 102:
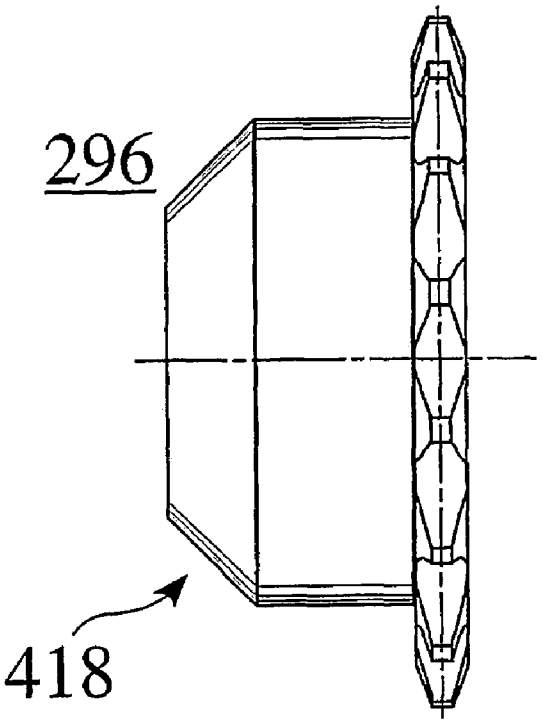
FIG. 102 is a side view of a tiltmeter X-channel gear.

FIG. 101 is a front view 416 of a tiltmeter X-channel gear 296. FIG. 102 is a side view 418 of a tiltmeter X-channel gear 296.

FIG. 103 is a front view of a tiltmeter bearing holder 420. FIG. 104 is a side cross-sectional view 422 of a tiltmeter bearing holder 420.

FIG. 105 is a front view of a tiltmeter bearing fluoropolymer ring 424. FIG. 106 is a side view 426 of a tiltmeter bearing fluoropolymer ring 424. FIG. 107 is a side cross-sectional view 428 of a tiltmeter bearing fluoropolymer ring 424.

Figure 110:
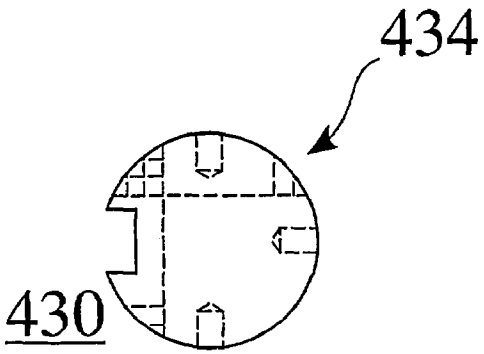
FIG. 110 is a side view of a first end of a tiltmeter accelerometer mount.
Figure 111:
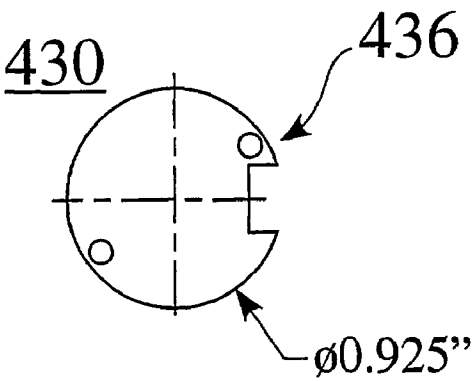
FIG. 111 is a side view of a second end of a tiltmeter accelerometer mount.
Figure 108:
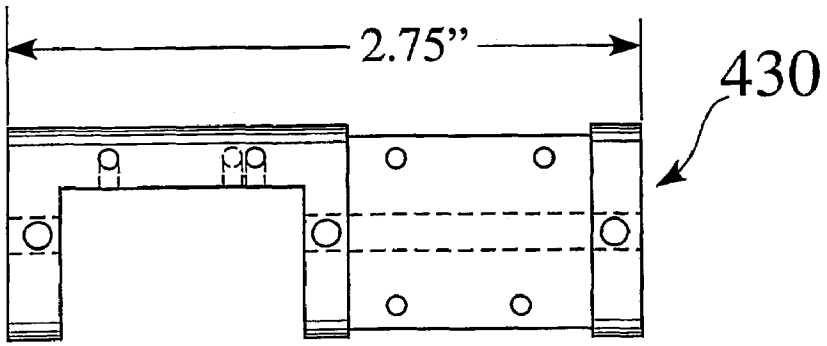
FIG. 108 is a top view of a tiltmeter accelerometer mount.
Figure 109:
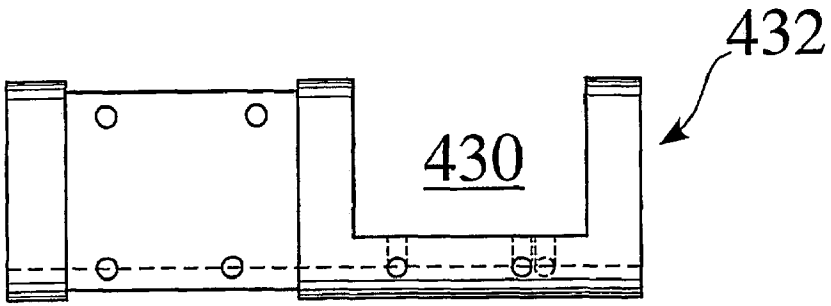
FIG. 109 is a front view of a tiltmeter accelerometer mount.

FIG. 108 is a top view of a tiltmeter accelerometer mount 430. FIG. 109 is a front view 432 of a tiltmeter accelerometer mount 430. FIG. 110 is a side view 434 of a first end of a tiltmeter accelerometer mount 430. FIG. 111 is a side view 436 of a second end of a tiltmeter accelerometer mount 430.

Figure 112:
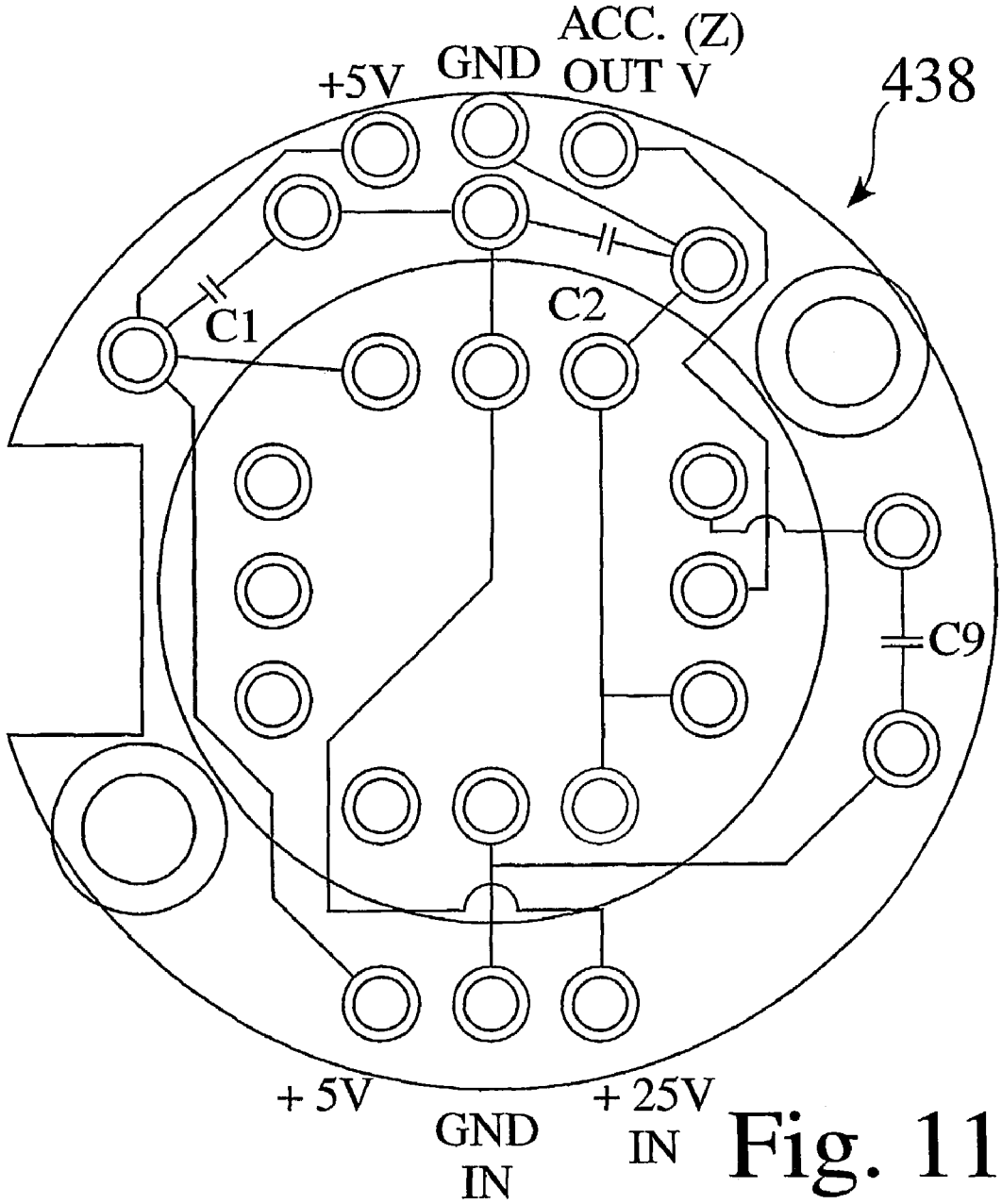
FIG. 112 is a top view of a tiltmeter Z-axis accelerometer board.
Figure 113:
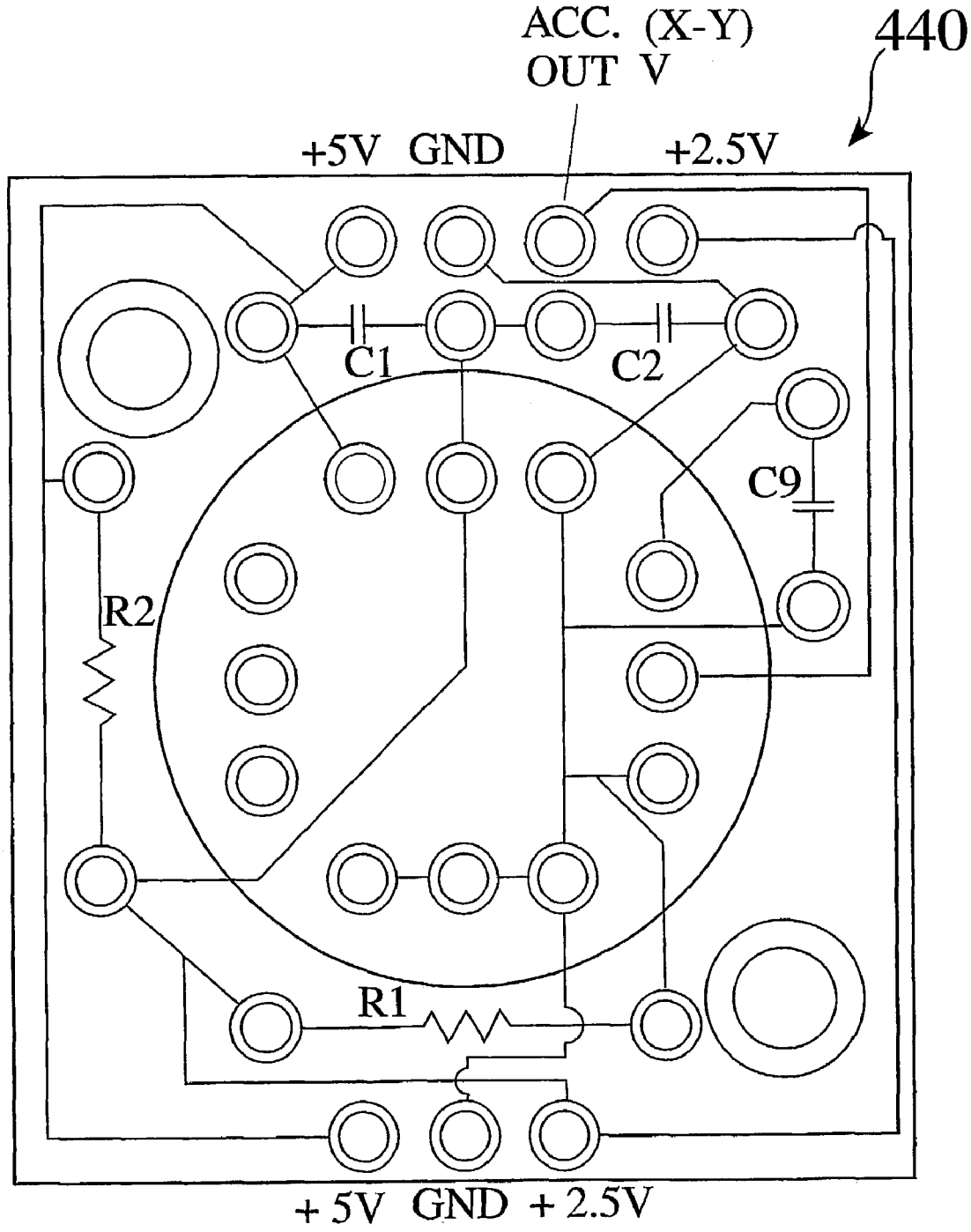
FIG. 113 is a top view of a tiltmeter X and Y axis accelerometer board.

FIG. 112 is a top view of a tiltmeter Z-axis accelerometer board 438. FIG. 113 is a top view of a tiltmeter X and Y axis accelerometer board 440.

Figure 114:
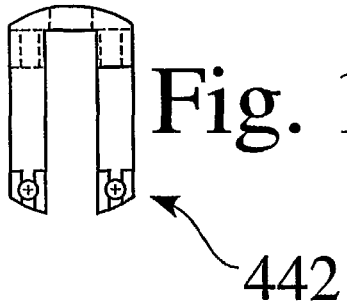
FIG. 114 is a front view of a tiltmeter tensioner.
Figure 115:
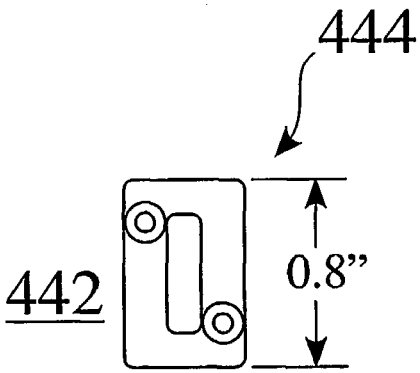
FIG. 115 is a top view of a tiltmeter tensioner.
Figure 116:
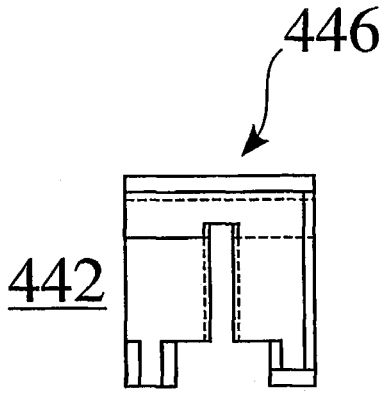
FIG. 116 is a first side view of a tiltmeter tensioner.
Figure 117:
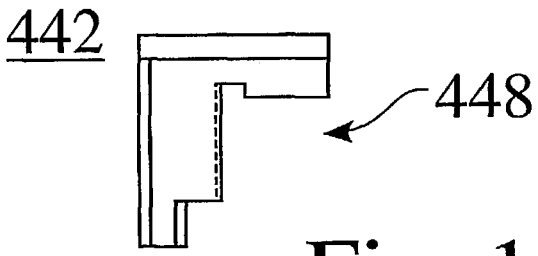
FIG. 117 is a second side-view of a tiltmeter tensioner.
Figure 118:
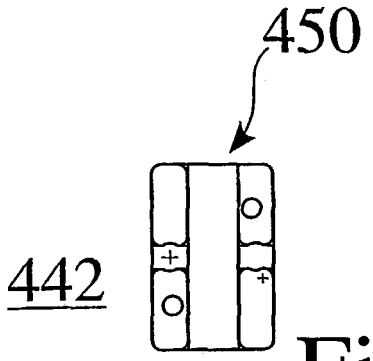
FIG. 118 is a bottom view of a tiltmeter tensioner.

FIG. 114 is a front view of a tiltmeter tensioner 442. FIG. 115 is a top view 444 of a tiltmeter tensioner 442. FIG. 116 is a first side view 446 of a tiltmeter tensioner 442. FIG. 117 is a second side view 448 of a tiltmeter tensioner 442. FIG. 118 is a bottom view 450 of a tiltmeter tensioner 442.

Figure 126:
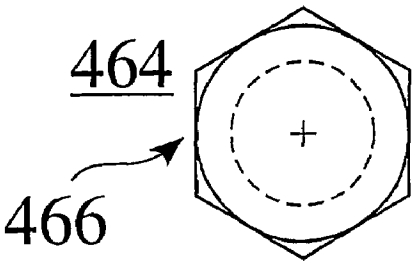
Figure 125:
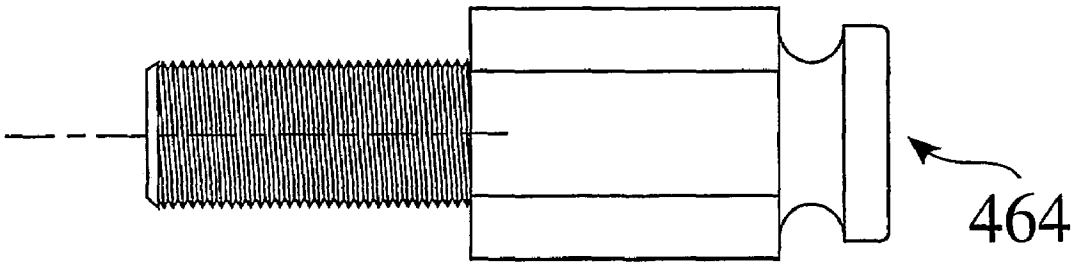
Figure 127:
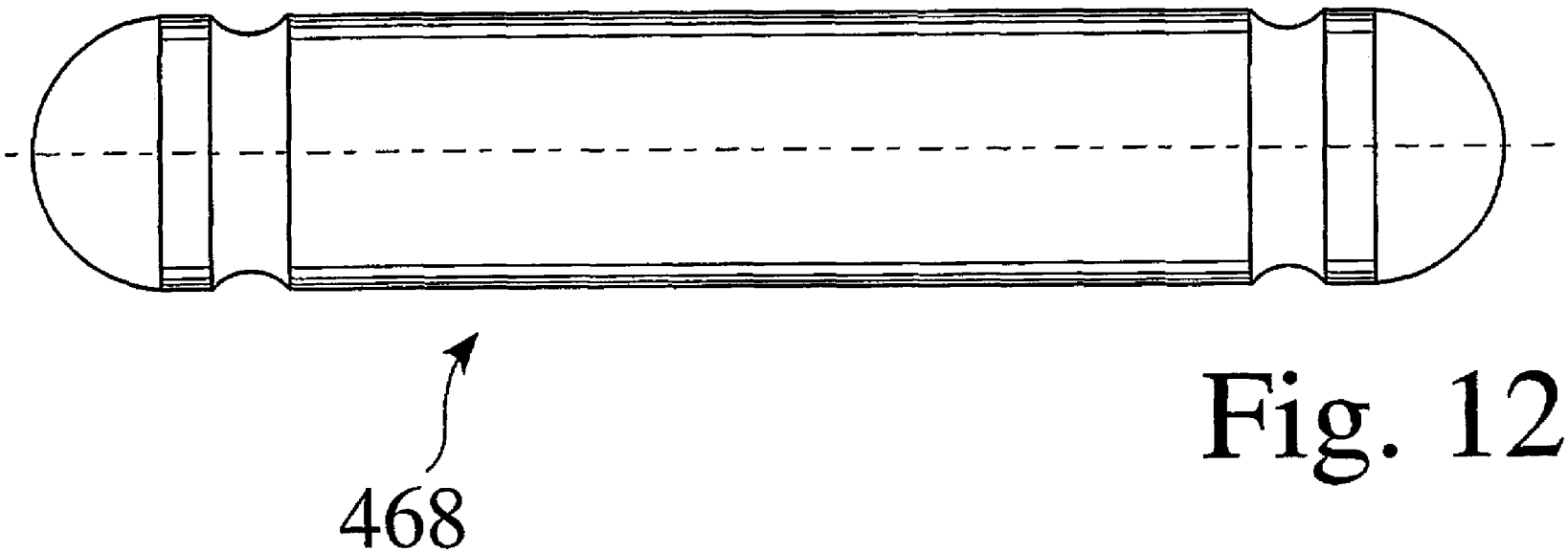

FIG. 119 is a front view of a tensioner 452. FIG. 120 is a top view 454 of a tensioner 452. FIG. 121 is a first cross-sectional view 456 of a tensioner 452. FIG. 122 is a side view 458 of a tensioner 452. FIG. 123 is a second cross-sectional view 460 of a tiltmeter 452. FIG. 124 is a bottom view 462 of a tensioner 452. FIG. 125 is a side view of a tiltmeter spring pole 464. FIG. 126 is an end view 466 of a tiltmeter spring pole 464. FIG. 127 is a side view of a tiltmeter tensioner shaft 468.

Figure 129:
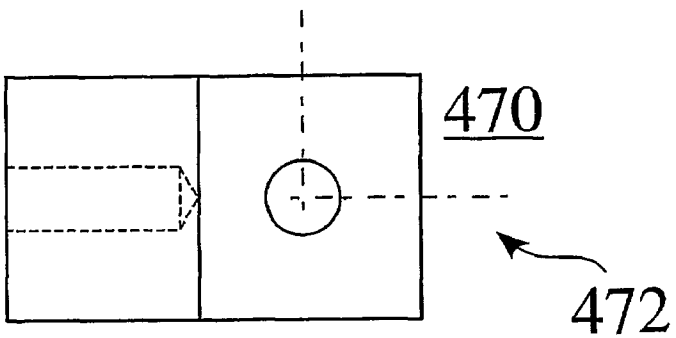
Figure 128:
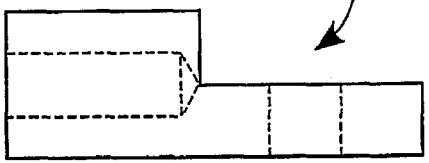
Figure 130:
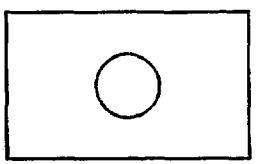
Figure 131:
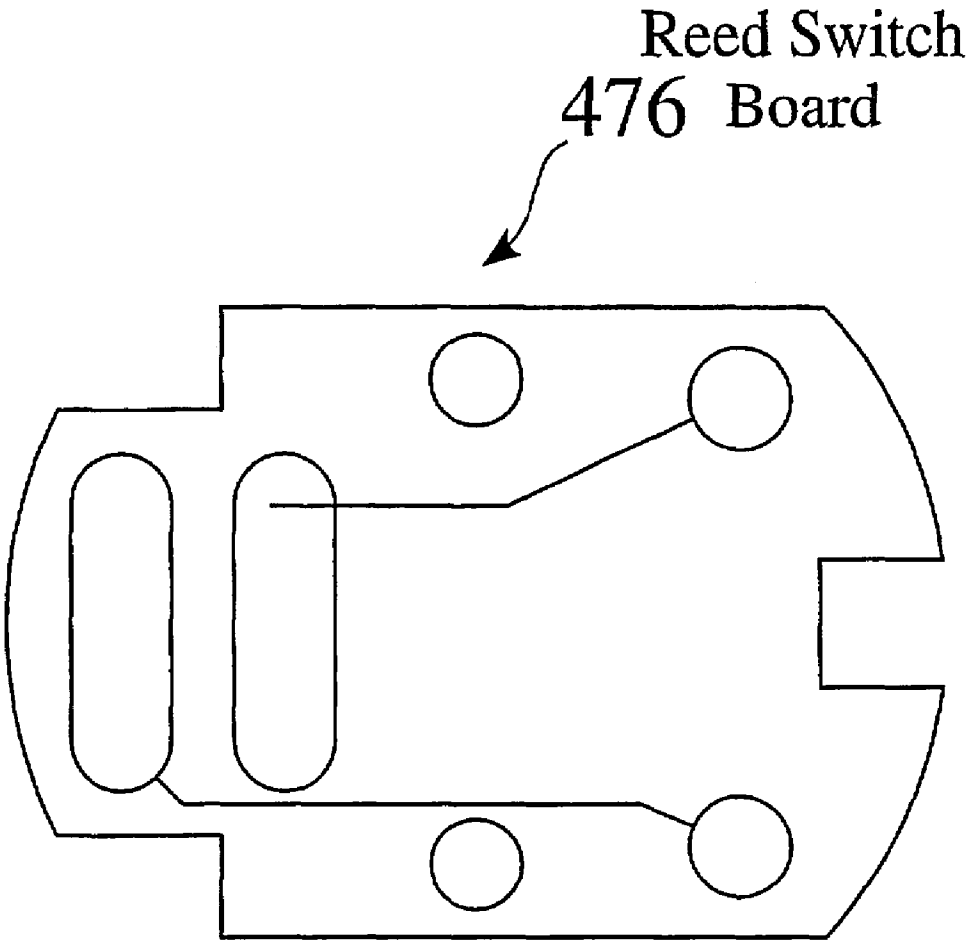

FIG. 128 is a side view of a tiltmeter power supply board solenoid mount 470. FIG. 129 is a top view 472 of a tiltmeter power supply board solenoid mount 470. FIG. 130 is an end view 474 of a tiltmeter power supply board solenoid mount. FIG. 131 is a top view of a tiltmeter reed switch board 476.

FIG. 132 is a detailed plan view 478 of a tiltmeter power supply board 194. The power supply board 194 provides power to all electronics within a treatment well tiltmeter assembly 134, and has a plurality of DC voltage outputs, comprising 3.3 volts, 5 volts, 12 volts, and −5 volts power. As well, the power supply board 194 provides switchable 5 volt "high current" supply for motors (100 mA). The total current draw for a treatment well tiltmeter assembly 134 is approximately 50 mA, without motor operation. The tiltmeter power supply board 194 is presently designed for an input voltage of 13–35 volts. A solid state relay provides power to next treatment well tiltmeter assembly 134 in a daisy-chain array 132, which allows diagnosis of shorts and opens in the wireline array, and provides fault tolerant operation. The power supply board 194 comprises one or more switching power supplies, which are used for efficiency, and to reduce heat generation. The power supply board 194 has less than 1% ripple noise on all voltage supplies.

FIG. 133 is a perspective view 480 of a tiltmeter accelerometer assembly 252. FIG. 134 is a detailed plan view 482 of a tiltmeter analog board 164, which provides fixed gain signal amplification, since treatment well signals are of predictable, consistent magnitude. In alternate embodiments of the tiltmeter analog board 164, the gain settings are variable. FIG. 135 is a detailed plan view 490 of a tiltmeter modem board 192. The tiltmeter modem board 192 provides communication for each of the treatment well tiltmeters 134*a*–134*n*. The modem board 192 receives input signals 211 and sends output signals 213, through the connected wireline 136,137, which typically comprises an insulated conductor within a stranded steel cable. The input signals 211 and the output signals 213 are typically sent along the same conductive path as the supply power 209. The modem board 192 plugs onto the back of power supply board 190. If an external surface modem 212 is not present, the tiltmeter assembly 134 expects input and output communication through an RS-232 cable and port.

FIG. 136 is a simplified flow chart 500 of treatment well tiltmeter data acquisition, data analysis, and real-time data display. At step 502, downhole tilt data is recorded by one or more treatment well tiltmeters 134*a*–134*n*, wherein the tiltmeters are typically located at different depths within a treatment well 18. At step 504, the data is transmitted uphole from the tiltmeter assemblies 134*a*–134*n*.

At step 506, the flow induced deformation is extracted from the raw data 213. Raw tilt data 213 in an active well 18 often has background "noise" which is induced from the flow of fluid 143 within the same active well bore 18. Therefore, the raw data is processed, to isolate the deformation "signals" from distinguished flow noise, as well as from transient events that correlate with changes in the injection flow rate. "Signals" from the deformation of the rock strata are not high frequency and they are quasi-static deformations that occur over time, as a function of the volume of injected (or produced) fluid 143.

After isolation of the deformation-induced signals at each treatment well instrument 134 versus time, the next step is to perform a geophysical inversion to yield a "map" or description of the subsurface rock deformation that must be occurring. Surface and offset-well tilt mapping employ either simplified dislocation or more detailed finite element models of various deformation fields in the far-field. Active (treatment) well mapping is not a far-field solution, but instead is a near-interface or internal view of the deformation process. Models designed for this particular view are employed to invert the observed deformation data. This varies from very sophisticated models of particular fracture opening profiles as a function depth within strata, to a very simplified "On-Off" view of the existence of a fracture. For example, a certain tilt "threshold" can be set to demarcate whether there is fracture growth at a specified depth or not. An array 135 of tiltmeters 134*a*–134*n* can then be evaluated, to determine if hydraulic fracture growth is occurring at the depth of that particular tool 134 or not. This simplified analysis allows an "alarm system" for monitoring upward (or downward) fracture growth for a hydraulic fracture, such as for monitoring waste disposal injections.

At step 508, geomechanical modeling of the strata 12 is performed, and is compared to the observed strata deformation. At step 510, the process determines if the geomechanical model provides a good fit to the observed strata deformation. If the model provides a good fit 514, the results are displayed 516 in real time. If the model fails 512 to provide an acceptable fit to the observed strata deformation, the model is adjusted, and the process returns to comparison step 508.

FIG. 137 is a chart 520 of treatment well tilt response 172 to applied surface pressure 524 for a plurality of tiltmeters 134, as a function of time. The applied pressure 522 is shown before, during and after the pumping/fracture operation. Tilt data 526*a*, 526*e*, 526*j* is shown during the chart interval. The applied pumping interval 528 is separated into three pumping intervals 530*a*, 530, 530*c*. FIG. 138 represents the determined fracture-induced deformation 540 for the treatment well 18, based upon the measured tilt mapping data from a plurality of treatment well tiltmeters 134 shown in FIG. 137. The determined deformation during the first pumping interval 530*a* is shown as region 542*a*. The determined deformation during the second pumping interval 530*b* is shown as region 542*b*. The determined deformation during the third pumping interval 530*c* is shown as region 542*c*. The induced downhole tilt profiles 526*a*, 526*e*, 526*j* are quite different in the treatment well 18, as compared to a tilt mapping profile which is measured in an offset well 26, or at the surface 38, and requires different analysis methods, to map fracture growth and other processes from the measurement of treatment well tilt data, as a function of depth and time. During the processing of raw tilt data 213, motion noise introduced from the flow of a working fluid 143 within the treatment wellbore 18 is isolated from the motion due to earth movement, i.e. the tilt data. FIG. 138 shows a plan view which compares measured and projected tilt for a plurality of surface tiltmeters 134. The treatment well tilt system 132 yields tilt mapping results where the "signal" of rock deformation is clearly distinguishable from the "noise" of active fluid-flow past the downhole tools 134*a*–134*n*.

The treatment well tiltmeter system 132 therefore allows mapping without an offset wellbore or with installed surface tilt arrays. Utilization of the active wellbore allows mapping in a much wider range of environments, and provides an accurate resolution of the fracture width and rock deformation pattern versus depth across the subsurface rock strata.

Alternate Treatment Well Tiltmeter Systems. FIG. 140 is a partial cutaway view 552 of a treatment well tiltmeter system 132*d*, in which the tiltmeters 134 are magnetically attached 238 to a well casing 214*a*, in an annular region 554 formed between the casing 214*a* and an inner tubing 214*b*, wherein a movable fluid 143 or proppant is located within the inner tubing 214*b*. FIG. 141 is a detailed cutaway view 560 of a tiltmeter 134 which is magnetically attached 238 to a well casing 214*a* in an annular region 554 formed between the casing 214*a* and a hollow inner tubing 214*b*. FIG. 142 is an end view 562 of a tiltmeter 134 which is magnetically attached 238 to well casing 214*a* within an annular region 554 formed between the casing 214*a* and an inner tubing 214*b*. FIG. 143 is a partial cutaway view of a horizontal treatment well tiltmeter system 132*b*, in which the tiltmeters 134 are magnetically attached 238 to the well casing 214*a* in an annular region 554 formed between the casing 214*a* and an inner tubing 214*b*. The magnetic attachment 238, typically comprises one or more regions 239 of magnets 238.

The treatment well tiltmeter system 132*d* preferably includes means for mechanical isolation 556 between the tiltmeters 134 and the inner tubing, such as one or more springs or dampeners. The tiltmeters 134 are therefore linked to the strata 12, and are mechanically isolated from the inner tubing 214*b*, which typically carries a working fluid 143 or proppant.

Although the treatment well tiltmeter system and its methods of use are described herein in connection with treatment wells, the apparatus and techniques can be implemented for a wide variety of wellbore systems, such as for offset wells or surface wells, or any combination thereof, as desired. As well, the treatment well tiltmeter system can be used in conjunction with a wide variety of wellbore systems, such as offset well instrumentation and tiltmeters or surface well instrumentation and tiltmeters, or any combination thereof, as desired.

Accordingly, although the invention has been described in detail with reference to a particular preferred embodiment, persons possessing ordinary skill in the art to which this invention pertains will appreciate that various modifications and enhancements may be made without departing from the spirit and scope of the claims that follow.

The invention claimed is:

1. A treatment well tiltmeter system comprising an active treatment well comprising a bore hole extending from a surface into a subsurface strata;

an active flowstream within the bore hole, the active flowstream comprising a movable fluid;

a tiltmeter array located within the bore hole of the active treatment well, the tiltmeter array comprising at least one tiltmeter assembly, each of the at least one tiltmeter assembly comprising at least one tiltmeter sensor; and means for communication between the tiltmeter array and the surface;

wherein the tiltmeter array provides data regarding at least one of movement of the movable fluid, and effects of the movement of the movable fluid on the subsurface strata.

2. The treatment well tiltmeter system of claim 1, wherein the means for communication is a wireline extending from the surface to the tiltmeter array.

3. The treatment well tiltmeter system of claim 2, wherein the wireline is retrievable.

4. The treatment well tiltmeter system of claim 2, further comprising an external power supply electrically connected to the wireline.

5. The treatment well tiltmeter system of claim 2, further comprising an external computer connected to the wireline.

6. The treatment well tiltmeter system of claim 2, wherein the wireline comprises:

an electrically conductive cable; and a secondary conductor electrically insulated from the electrically conductive cable.

7. The treatment well tiltmeter system of claim 1, wherein the means for communication is a wireless link.

8. The treatment well tiltmeter system of claim 1, wherein the means for communication comprises a retrievable memory within the tiltmeter array.

9. The treatment well tiltmeter system of claim 1, wherein the active treatment well has a perforation zone, and the tiltmeter array is arranged in the active treatment well such that at least one tiltmeter assembly is located above the perforation zone.

10. The treatment well tiltmeter system of claim 1, further comprising means for injecting the movable fluid from the surface into the bore hole.

11. The treatment well tiltmeter system of claim 1, wherein the tiltmeter array comprises a plurality of tiltmeter assemblies, the treatment well tiltmeter system further comprising:

an interconnect wireline between each of the plurality of tiltmeter assemblies.

12. The treatment well tiltmeter system of claim 1, wherein the tiltmeter array comprises a plurality of tiltmeter assemblies, the treatment well tiltmeter system further comprising:

a wireless connection between at least two of the plurality of tiltmeter assemblies.

13. The treatment well tiltmeter system of claim 1, wherein the active treatment well comprises a casing having a hollow bore, and wherein the tiltmeter array is located within the hollow bore.

14. The treatment well tiltmeter system of claim 13, wherein each of the at least one tiltmeter assembly further comprises means for holding each of the at least one tiltmeter assembly within the hollow bore.

15. The treatment well tiltmeter system of claim 14, wherein the means for holding the at least one tiltmeter assembly within the hollow bore comprises a bowspring connector in contact with the hollow bore.

16. The treatment well tiltmeter system of claim 14, wherein the means for holding the at least one tiltmeter assembly within the hollow bore comprises at least one magnet.

17. The treatment well tiltmeter system of claim 1, wherein the active well comprises a casing having a hollow bore located within the bore hole, wherein the tiltmeter array is located between the casing and the strata.

18. The treatment well tiltmeter system of claim 17, wherein each of the at least one tiltmeter assembly is cemented on the casing.

19. The treatment well tiltmeter system of claim 17, wherein each of the at least one tiltmeter assembly is strapped to the outer surface of the casing.

20. The treatment well tiltmeter system of claim 1, wherein the active well comprises a casing having a hollow bore located within the bore hole, an inner tubing having a hollow bore located within the hollow bore of the casing, wherein an annular region is defined between the inner tubing and the casing, and wherein the tiltmeter array is located within the annular region.

21. The treatment well tiltmeter system of claim 20, wherein each of the at least one tiltmeter assembly is magnetically attached to the casing.

22. The treatment well tiltmeter system of claim 21, further comprising: means for mechanical isolation between each of the at least one tiltmeter assembly and the inner tubing.

23. The treatment well tiltmeter system of claim 22, wherein means for mechanical isolation between each of the at least one tiltmeter assembly and the inner tubing comprises a spring.

24. The treatment well tiltmeter system of claim 1, wherein each of the at least one tiltmeter assembly further comprises means for leveling the at least one tiltmeter sensor.

25. The treatment well tiltmeter system of claim 1, wherein at least one tiltmeter assembly further comprises a tool selected from the group consisting of accelerometers, geophones, temperature sensors, pressure sensors, and gyroscopes.

26. The treatment well tiltmeter system of claim 1, wherein the active flowstream comprises a fluid injected from the surface into the subsurface strata.

27. The treatment well tiltmeter system of claim 1, wherein a treatment selected from the group consisting of hydraulic fracture stimulation, waste injection, produced water re-injection, water flooding, steam flooding, and $CO_2$ flooding is occurring in the active treatment well.

28. The treatment well tiltmeter system of claim 1, wherein the active flowstream comprises a fluid flowing out of the active treatment well and to the surface.

29. The treatment well tiltmeter system of claim 1, wherein a hydraulic fracture treatment is occurring in the active treatment well, and the active flowstream comprises a hydraulic fracturing fluid.

30. The treatment well tiltmeter system of claim 1, wherein each of the at least one tiltmeter assembly further comprises means for storing data from the at least one tiltmeter sensor.

31. The treatment well tiltmeter system of claim 1, wherein each of the at least one tiltmeter assembly further comprises means for sending data from the at least one tiltmeter sensor to the surface.

32. The treatment well tiltmeter system of claim 1, wherein each of the at least one tiltmeter assembly further comprises an internal power source.

33. The treatment well tiltmeter system of claim 1, further comprising: an external computer having a wireless connection with at least one of the at least one tiltmeter assembly.

34. An apparatus, comprising:

an active treatment well comprising a bore hole extending from a surface into a strata;

a casing located within the bore hole, the casing having an exterior surface and an interior surface, which interior surface is defined by a hollow bore;

a movable fluid located within the bore hole; and a tiltmeter array located within the bore hole, the tiltmeter array comprising at least one tiltmeter assembly, each of the at least one tiltmeter assembly comprising at least one tiltmeter sensor for measuring the effect of the movable fluid on the strata.

35. The apparatus of claim 34, further comprising a wireline extending from the surface to the tiltmeter array.

36. The apparatus of claim 35, wherein the wireline is retrievable.

37. The apparatus of claim 35, further comprising an external power supply electrically connected to the wireline.

38. The apparatus of claim 35, further comprising an external computer connected to the wireline.

39. The apparatus of claim 35, wherein the wireline comprises:

an electrically conductive cable; and a secondary conductor electrically insulated from the electrically conductive cable.

40. The apparatus of claim 34, further comprising a wireless communication link between the tiltmeter array and the surface.

41. The apparatus of claim 34, further comprising a retrievable memory within the tiltmeter array.

42. The apparatus of claim 34, further comprising strap connectors attaching at least one tiltmeter assembly to the exterior surface of the casing.

43. The apparatus of claim 34, wherein the tiltmeter array comprises a plurality of tiltmeter assemblies, the apparatus further comprising:

an interconnect wireline between each of the plurality of tiltmeter assemblies.

44. The apparatus of claim 34, wherein the tiltmeter array comprises a plurality of tiltmeter assemblies, the apparatus further comprising:

a wireless connection between at least two of the plurality of tiltmeter assemblies.

45. The apparatus of claim 34, wherein the tiltmeter array is located within the hollow bore of the casing.

46. The apparatus of claim 45, wherein the tiltmeter array is centralized within the hollow bore.

47. The apparatus of claim 46, further comprising a bowspring connector in contact with the interior surface of the casing and in contact with the at least one tiltmeter assembly.

48. The apparatus of claim 34, further comprising at least one magnet attaching the at least one tiltmeter assembly to the interior surface of the casing.

49. The apparatus of claim 34, wherein the tiltmeter array is located between the exterior surface of the casing and the strata.

50. The apparatus of claim 49, wherein each of the at least one tiltmeter assembly is cemented on the exterior surface of the casing.

51. The apparatus of claim 49, wherein each of the at least one tiltmeter assembly is strapped to the casing.

52. The apparatus of claim 34, further comprising an inner tubing located within the hollow bore of the casing, the inner tubing having an exterior surface and an interior surface, which interior surface is defined by a hollow bore;

an annular region defined by the exterior surface of the inner tubing and the interior surface of the casing, and wherein the tiltmeter array is located within the annular region.

53. The apparatus of claim 52, wherein each of the at least one tiltmeter assembly is magnetically attached to the interior surface of the casing.

54. The apparatus of claim 53, further comprising means for mechanical isolation between each of the at least one tiltmeter assembly and the exterior surface of the inner tubing.

55. The apparatus of claim 54, wherein the means for mechanical isolation comprises a spring.

56. The apparatus of claim 34, wherein each of the at least one tiltmeter assembly further comprises means for leveling the at least one tiltmeter sensor.

57. The apparatus of claim 34, wherein each of the at least one tiltmeter assembly further comprises an accelerometer.

58. The apparatus of claim 34, wherein each of the at least one tiltmeter assembly further comprises a geophone.

59. The apparatus of claim 34, wherein each of the at least one tiltmeter assembly further comprises a temperature sensor.

60. The apparatus of claim 34, wherein each of the at least one tiltmeter assembly further comprises a pressure sensor.

61. The apparatus of claim 34, wherein each of the at least one tiltmeter assembly further comprises a gyroscope.

62. The apparatus of claim 34, wherein each of the at least one tiltmeter assembly further comprises means for storing data from the at least one tiltmeter sensor.

63. The apparatus of claim 34, wherein each of the at least one tiltmeter assembly further comprises means for sending data from the at least one tiltmeter sensor to the surface.

64. The apparatus of claim 34, wherein each of the at least one tiltmeter assembly further comprises an internal power source.

65. The apparatus of claim 34, further comprising an external computer having a wireless connection with at least one of the at least one tiltmeter assembly.

66. A process, comprising:

providing an active treatment well comprising a bore hole extending from a surface into subsurface strata;

installing a tiltmeter array within the bore hole, the tiltmeter array comprising at least one tiltmeter assembly, each of the at least one tiltmeter assembly comprising at least one tiltmeter sensor;

flowing a fluid through the bore hole; and using the tiltmeter array to measure the effect on the subsurface strata caused by the flow of the fluid.

67. The process of claim 66, further comprising providing a wireline between the tiltmeter array and the surface.

68. The process of claim 67, wherein the wireline is retrievable.

69. The process of claim 67, further comprising connecting an external power supply electrically to the wireline.

70. The process of claim 67, further comprising connecting an external computer to the wireline.

71. The process of claim 67, wherein the wireline comprises:

an electrically conductive cable; and a secondary conductor electrically insulated from the electrically conductive cable.

72. The process of claim 66, further comprising providing a communication link between the tiltmeter array and the surface.

73. The process of claim 72, wherein the communication link is a wireline.

74. The process of claim 72, wherein the communication link is a wireless link.

75. The process of claim 66, further comprising providing a retrievable memory within the tiltmeter array.

76. The process of claim 66, further comprising providing means for injecting the fluid from the surface into the bore hole.

77. The process of claim 66, wherein the tiltmeter array comprises a plurality of tiltmeter assemblies, the process further comprising providing an interconnect wireline between each of the plurality of tiltmeter assemblies.

78. The process of claim 66, wherein the tiltmeter array comprises a plurality of tiltmeter assemblies, the process further comprising providing a wireless connection between at least two of the plurality of assemblies.

79. The process of claim 66, wherein the active treatment well comprises a casing having a hollow bore, and wherein the tiltmeter array is located within the hollow bore.

80. The process of claim 79, wherein each of the at least one tiltmeter assembly further comprises means for holding each of the at least one tiltmeter assembly within the hollow bore.

81. The process of claim 80, wherein the means for holding the at least one tiltmeter assembly within the hollow bore comprises a bowspring connector in contact with the hollow bore.

82. The process of claim 80, wherein the means for holding the at least one tiltmeter assembly within the hollow bore comprises at least one magnet.

83. The process of claim 66, wherein the active well comprises a casing having a hollow bore located within the bore hole, and wherein the tiltmeter array is located between the casing and the strata.

84. The process of claim 83, wherein each of the at least one tiltmeter assembly is cemented on the casing.

85. The process of claim 83, wherein each of the at least one tiltmeter assembly is strapped to the casing.

86. The process of claim 66, wherein the active well comprises a casing having a hollow bore located within the bore hole, an inner tubing having a hollow bore located within the hollow bore of the casing, wherein an annular region is defined between the inner tubing and the casing, and wherein the tiltmeter array is located within the annular region.

87. The process of claim 86, wherein each of the at least one tiltmeter assembly is magnetically attached to the casing.

88. The process of claim 87, further comprising providing means for mechanical isolation between each of the at least one tiltmeter assembly and the inner tubing.

89. The process of claim 88, wherein the provided means for mechanical isolation between each of the at least one tiltmeter assembly and the inner tubing comprises a spring.

90. The process of claim 66, wherein each of the at least one tiltmeter assembly further comprises means for leveling the at least one tiltmeter sensor.

91. The process of claim 66, wherein at least one tiltmeter assembly further comprises a tool selected from the group consisting of accelerometers, geophones, temperature sensors, pressure sensors, and gyroscopes.

92. The process of claim 66 further comprising performing a treatment selected from the group consisting of hydraulic fracture stimulation, waste injection, produced water re-injection, water flooding, steam flooding, and $CO_2$ flooding in the active treatment well.

93. The process of claim 66, wherein the flowing of the fluid through the bore hole comprises flowing a fluid out of the active treatment well and to the surface.

94. The process of claim 66, further comprising performing a hydraulic fracture treatment in the active treatment well, and the fluid flowed through the bore hole is a fracturing fluid.

95. The process of claim 66, wherein the flowing of the fluid through the bore hole comprises injecting a fluid from the surface into the subsurface strata.

96. The process of claim 66, wherein each of the at least one tiltmeter assembly further comprises means for storing data from the at least one tiltmeter sensor.

97. The process of claim 66, wherein each of the at least one tiltmeter assembly further comprises means for sending data from the at least one tiltmeter sensor to the surface.

98. The process of claim 66, wherein each of the at least one tiltmeter assembly further comprises an internal power source.

99. The process of claim 66, further comprising establishing a wireless connection between an external computer and at least one of the at least one tiltmeter assembly.

100. The process of claim 66, further comprising sending data from the tiltmeter array to the surface.

101. The process of claim 66, wherein each of the at least one tiltmeter assembly further comprises means for storing data from the at least one tiltmeter sensor.

102. The process of claim 66, wherein each of the at least one tiltmeter assembly further comprises means for sending data from the at least one tiltmeter sensor to the surface.

103. The process of claim 66, further comprising recording tilt data with at least one of the at least one tiltmeter assembly.

104. The process of claim 103, further comprising transferring the tilt data to the surface.

105. The process of claim 104, further comprising extracting strata deformation information from the transferred tilt data.

106. The process of claim 105, further comprising preparing a geomechanical model of strata deformation.

107. The process of claim 106, further comprising comparing the geomechanical model to the extracted strata deformation information.

108. The process of claim 107, further comprising iteratively preparing the geomechanical model based on the comparison of the geomechanical model to the extracted strata deformation information.

109. The process of claim 107, further comprising displaying the extracted strata deformation information.

110. The process of claim 107, further comprising displaying the geomechanical model.

111. The treatment well tiltmeter system of claim 1, wherein the active treatment well has a perforation zone, and the tiltmeter array is arranged in the active treatment well such that at least one tiltmeter assembly is located within the perforation zone.

112. The treatment well tiltmeter system of claim 1, wherein the active treatment well has a perforation zone, and the tiltmeter array is arranged in the active treatment well such that at least one tiltmeter assembly is located below the perforation zone.

* * * * *

UNITED STATES PATENT AND TRADEMARK OFFICE

CERTIFICATE OF CORRECTION

PATENT NO. : 7,028,772 B2
APPLICATION NO. : 10/258669
DATED : April 18, 2006
INVENTOR(S) : Wright et al.

It is certified that error appears in the above-identified patent and that said Letters Patent is hereby corrected as shown below:

In the specification:
Column 14, line 57, change “nanqradians” to -- nanoradians --.
Column 16, line 3, change “input signals 21” to -- input signals 211 --.

In claim 78:
Column 27, line 47, add “tiltmeter” before “assemblies”.

In claim 83:
Column 27, line 62, add “treatment” before “well”.

In claim 86:
Column 28, line 3, add “treatment” before “well”.

Signed and Sealed this

Fifteenth Day of August, 2006

JON W. DUDAS
*Director of the United States Patent and Trademark Office*